US012721403B2

(12) United States Patent
Eldem et al.

(10) Patent No.: US 12,721,403 B2
(45) **Date of Patent: *Sep. 1, 2026**

(54) ARTICLE OF FOOTWEAR INCLUDING A HEEL STABILIZING ELEMENT

(71) Applicant: Nike, Inc., Beaverton, OR (US)

(72) Inventors: Can Eldem, Portland, OR (US); Eric Fauble, Portland, OR (US); Althea R. Fyfe, Portland, OR (US); David Nickless, Beaverton, OR (US)

(73) Assignee: NIKE, INC., Beaverton, OR (US)

( * ) Notice: Subject to any disclaimer, the term of this patent is extended or adjusted under 35 U.S.C. 154(b) by 22 days.

This patent is subject to a terminal disclaimer.

(21) Appl. No.: 18/490,343

(22) Filed: Oct. 19, 2023

(65) Prior Publication Data

US 2024/0130475 A1 Apr. 25, 2024
US 2024/0225192 A9 Jul. 11, 2024

Related U.S. Application Data

(60) Provisional application No. 63/476,317, filed on Dec. 20, 2022, provisional application No. 63/380,190,
(Continued)

(51) Int. Cl.
*A43B 21/28* (2006.01)
*A43B 13/18* (2006.01)
*A43B 13/20* (2006.01)

(52) U.S. Cl.
CPC ..... *A43B 21/285* (2013.01); *A43B 13/189* (2013.01); *A43B 13/20* (2013.01)

(58) Field of Classification Search
CPC ..... A43B 7/144; A43B 7/24; A43B 13/122; A43B 13/125; A43B 13/127;
(Continued)

(56) References Cited

U.S. PATENT DOCUMENTS 1,494,236 A * 5/1924 Greathouse ..... A43B 3/18 36/58.5
2,119,274 A 5/1938 Hartwell et al.
(Continued)

FOREIGN PATENT DOCUMENTS

CN 115120005 A 9/2022

OTHER PUBLICATIONS

International Search Report and Written Opinion for PCT/US23/077315 completed Jan. 16, 2024. (16pgs).
(Continued)

*Primary Examiner* — F Griffin Hall
(74) *Attorney, Agent, or Firm* — Bookoff McAndrews, PLLC

(57) ABSTRACT

An article of footwear, with an upper; a heel region including a posterior end of the article of footwear, a mid-foot region, a forefoot region including an anterior end of the article of footwear, a medial side, and a lateral side. A sole structure is coupled to the upper, having a midsole having an outer side surface. The midsole has a first cushioning element extending from the posterior end toward the anterior end, with one or more engagement areas. The article of footwear further includes a heel clip extending from a first end on the medial side to a second end on the lateral side, the heel clip including an outer surface, an inner surface, a base extending from a first end to a second end and the base including a bottom surface, and a support, the base and the support forming the outer surface of the heel clip.

16 Claims, 57 Drawing Sheets

Related U.S. Application Data filed on Oct. 19, 2022, provisional application No. 63/380,183, filed on Oct. 19, 2022.

(58) Field of Classification Search
CPC ..... A43B 13/189; A43B 13/20; A43B 23/08; A43B 23/088; A43B 23/16; A43B 23/17
See application file for complete search history.

(56) References Cited

U.S. PATENT DOCUMENTS

| | | | | |
|---|---|---|---|---|
| 4,854,055 | A * | 8/1989 | Sugiyama | A43B 5/001 36/68 |
| 5,713,141 | A | 2/1998 | Mitchell et al. | |
| 5,952,065 | A | 9/1999 | Mitchell et al. | |
| 6,582,786 | B1 | 6/2003 | Bonk et al. | |
| 8,584,377 | B2 * | 11/2013 | Blevens | A43B 7/14 36/114 |
| 8,677,656 | B2 * | 3/2014 | Nishiwaki | A43B 7/20 36/69 |
| 10,159,307 | B2 * | 12/2018 | Case | A43B 13/188 |
| 10,321,735 | B2 * | 6/2019 | Connell | A43B 13/188 |
| 10,524,540 | B1 * | 1/2020 | Eldem | A43B 7/1415 |
| 10,524,542 | B2 * | 1/2020 | Avar | A43B 23/08 |
| 10,568,385 | B2 * | 2/2020 | Beers | A43B 23/08 |
| 10,932,524 | B2 * | 3/2021 | Eldem | A43B 3/0063 |
| 11,058,174 | B2 * | 7/2021 | Hale | A43B 13/20 |
| 11,259,593 | B2 * | 3/2022 | Amoako | A43B 13/125 |
| 11,388,952 | B2 * | 7/2022 | Nakaya | A43B 7/24 |
| 11,490,691 | B2 * | 11/2022 | Takashima | A43B 23/0275 |
| 11,517,074 | B2 * | 12/2022 | VanDomelen | A43B 13/20 |
| 11,622,601 | B2 * | 4/2023 | Piacentini | A43B 7/144 36/25 R |
| 12,178,284 | B2 * | 12/2024 | Brooks | A43B 13/188 |
| 2002/0017036 | A1 | 2/2002 | Berger et al. | |
| 2004/0025375 | A1 | 2/2004 | Turner et al. | |
| 2004/0055180 | A1 | 3/2004 | Manz et al. | |
| 2004/0148799 | A1 | 8/2004 | Lussier et al. | |
| 2004/0168350 | A1 | 9/2004 | Mathieu et al. | |
| 2004/0244226 | A1 * | 12/2004 | Farys | A43B 23/088 36/69 |
| 2007/0000154 | A1 | 1/2007 | DiBenedetto et al. | |
| 2007/0119075 | A1 | 5/2007 | Schindler et al. | |
| 2010/0236096 | A1 | 9/2010 | Pauk et al. | |
| 2010/0251565 | A1 | 10/2010 | Litchfield et al. | |
| 2011/0308109 | A1 | 12/2011 | Sokolowski | |
| 2012/0167413 | A1 | 7/2012 | Marvin et al. | |
| 2012/0255205 | A1 | 10/2012 | Jensen et al. | |
| 2013/0192087 | A1 | 8/2013 | Litchfield et al. | |
| 2014/0130376 | A1 | 5/2014 | Fahmi et al. | |
| 2015/0013185 | A1 | 1/2015 | Elder et al. | |
| 2016/0353836 | A1 | 12/2016 | Luedecke et al. | |
| 2017/0258179 | A1 | 9/2017 | Conant et al. | |
| 2018/0084864 | A1 | 3/2018 | Takada et al. | |
| 2018/0103727 | A1 | 4/2018 | Fracassi | |
| 2018/0213886 | A1 | 8/2018 | Connell et al. | |
| 2019/0200700 | A1 | 7/2019 | Hale | |
| 2019/0231027 | A1 | 8/2019 | Eldem et al. | |
| 2019/0365048 | A1 | 12/2019 | Fontaine | |
| 2021/0145118 | A1 * | 5/2021 | Campos | A43B 13/189 |
| 2021/0145119 | A1 | 5/2021 | Campos, II et al. | |
| 2021/0227929 | A1 | 7/2021 | Ni et al. | |
| 2021/0330026 | A1 | 10/2021 | Takamasu et al. | |
| 2021/0337927 | A1 | 11/2021 | Eldem et al. | |
| 2021/0368918 | A1 | 12/2021 | Lyke | |
| 2022/0061457 | A1 | 3/2022 | Girard et al. | |
| 2022/0287408 | A1 | 9/2022 | Eldem et al. | |
| 2023/0033366 | A1 | 2/2023 | Farina | |
| 2024/0122300 | A1 | 4/2024 | Farina | |

OTHER PUBLICATIONS

Taiwan Search Report, TW App. No. 112139984, completed Jun. 12, 2024. (1 page).

* cited by examiner

ARTICLE OF FOOTWEAR INCLUDING A HEEL STABILIZING ELEMENT

CROSS-REFERENCE TO RELATED APPLICATION(S)

This application claims priority to U.S. Provisional Application No. 63/380,183, filed Oct. 19, 2022, U.S. Provisional Application No. 63/380,190, filed Oct. 19, 2022, U.S. Provisional Application No. 63/476,317, filed Dec. 20, 2022, the entireties of which are incorporated herein by reference.

FIELD

The present disclosure relates generally to sole structures for articles of footwear, and more particularly, to sole structures incorporating a fluid-filled bladder and a heel stabilizing element.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
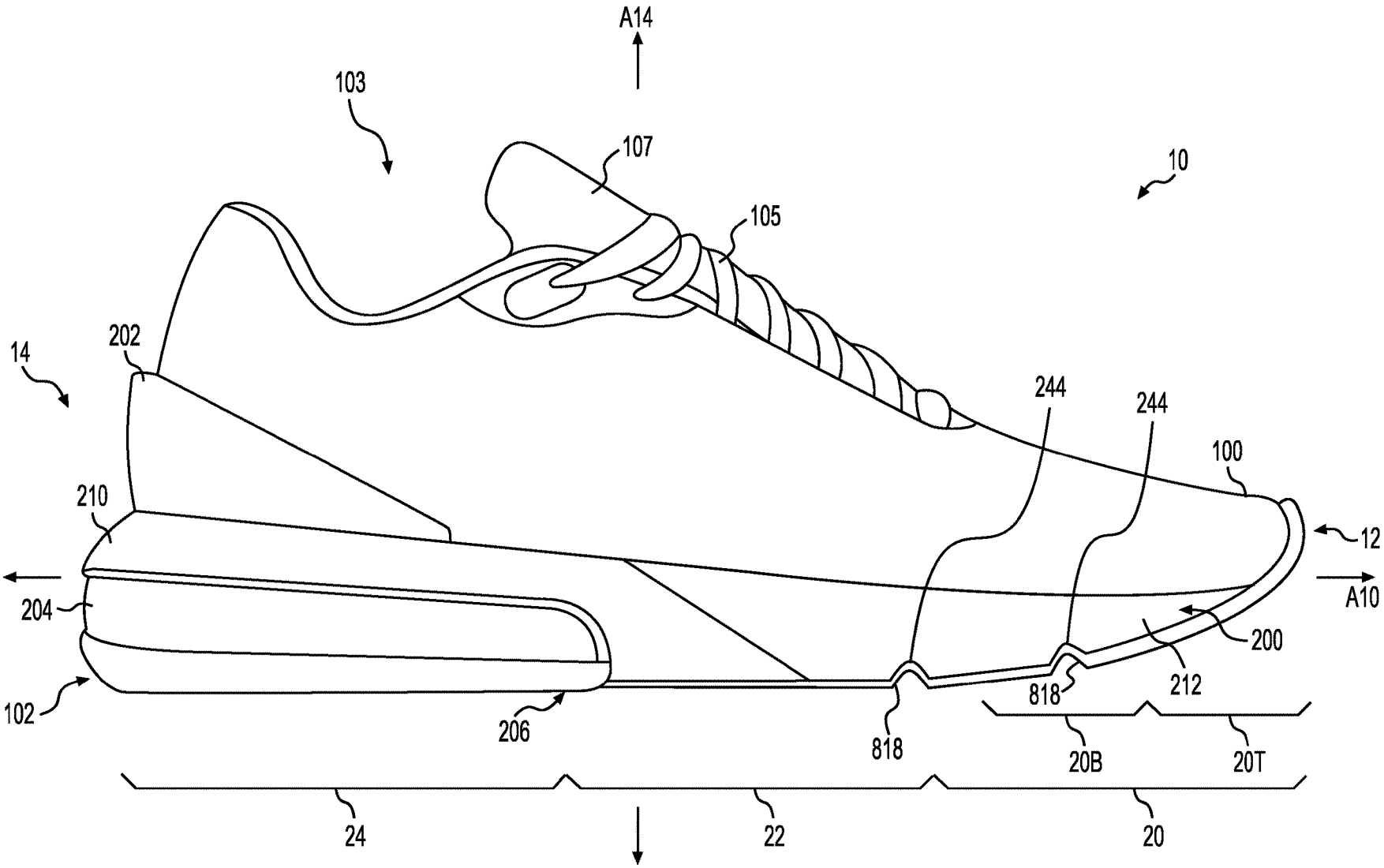
FIG. 1 is a side view of an article of footwear.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In the discussion that follows, terms "about," "approximately," "substantially," and the like, when used in describing a numerical value, denote a variation of +/−10% of that value, unless specified otherwise.

The present disclosure is directed to an article of footwear, such as an article of footwear 10 shown in FIG. 1, that provides unique underfoot cushioning and responsiveness during use. Referring to FIG. 1, the article of footwear 10 includes an upper 100 and a sole structure 102, where the sole structure 102 is configured to provides the underfoot cushioning and responsiveness to the article of footwear 10 as discussed below.

The footwear 10 also includes an anterior end 12 associated with a forward-most point of the article of footwear 10, and a posterior end 14 corresponding to a rearward-most point of the footwear 10. For ease of discussion, the footwear 10 is discussed with reference to a longitudinal axis A10, a medial-lateral axis A12 (not shown in FIG. 1), and a vertical axis A14, where the longitudinal axis A10, the medial-lateral axis A12, and the vertical axis A14 are perpendicular to each other. The longitudinal axis A10 of the footwear 10 extends along a length of the footwear 10 from the anterior end 12 to the posterior end 14 (also shown below in FIG. 13), and generally divides the footwear 10 into a medial side 16 and a lateral side 18 (best shown below in FIG. 13). The medial-lateral axis A12 extends from medial side 16 to lateral side 18. Accordingly, the medial side 16 and the lateral side 18 respectively correspond with opposite sides of the footwear 10 and extend from the anterior end 12 to the posterior end 14. The vertical axis A14 extends from a bottom (i.e., ground-contacting portion) of the footwear 10 to a top of the footwear 10.

The article of footwear 10 is divided into a plurality of regions, including, for example, a forefoot region 20, a mid-foot region 22, and a heel region 24. As illustrated in FIG. 1, the forefoot region 20 is further subdivided into a toe portion 20T corresponding with phalanges and a ball portion 20B associated with metatarsal bones of a foot. The mid-foot region 22 corresponds with an arch area of the foot, and the heel region 24 corresponds with rear portions of the foot, including a calcaneus bone.

Still referring to FIG. 1, the upper 100 includes interior surfaces (not shown) that define an interior void configured to, for example, receive and secure a foot for support on sole structure 102. The upper 100 is formed from one or more materials that are stitched, adhesively bonded, or otherwise joined together to form the interior void. Suitable materials of the upper include, but are not limited to, mesh, textiles, foam, leather, and synthetic leather. The materials may be selected and located to impart properties of durability, air-permeability, wear-resistance, flexibility, and comfort.

In some examples, the upper 100 includes a strobel (not shown) having a bottom surface opposing the sole structure 102 and an opposing top surface defining a footbed of the interior void. Stitching or adhesives secures the strobel to the upper 100. The footbed is contoured to conform to a profile of the bottom surface (e.g., plantar) of the foot. The upper 100 can also incorporate additional layers such as an insole or sockliner (not shown) that are disposed on the strobel and reside within the interior void of the upper 100 to receive a plantar surface of the foot. These layers may enhance the comfort of the article of footwear 10. An ankle opening 103 in the heel region 24 provides access to the interior void. For example, the ankle opening 103 receives a foot to secure the foot within the void and facilitate entry and removal of the foot from and to the interior void.

In some examples, one or more fasteners 105 extend along the upper 100 to adjust a fit of the interior void around the foot and to accommodate entry and removal of the foot therefrom. The fasteners 105 include laces, straps, cords, hook-and-loop, or any other suitable type of fastener. The upper 100 includes a tongue portion 107 that extends between the interior void and the fasteners.

The sole structure 102 includes a midsole 200, which includes reliefs 244 for the article of footwear 10 to flex (described in detail below with respect to FIG. 3C), a first cushioning element 212, a second cushioning element 204, and an outsole 206. The article of footwear 10 includes a heel wrap 210 and a heel clip 202. The heel wrap 210 and the heel clip 202 are attachable to the midsole 200 (as described in greater detail in FIG. 12). Outsole 206 includes raised portions 818 for the article of footwear 10 to flex (described in detail below with respect to FIG. 7A). The outsole 206 defines a ground engaging surface of the article of footwear 10. The midsole 200 is configured to impart a unique underfoot cushioning, stability, and responsiveness to the article of footwear 10. The heel clip 202 is configured to impart stability to the article of footwear 10. The second cushioning element 204 is configured to impart cushioning and responsiveness to the article of footwear 10. The outsole 206 is configured to impart traction and abrasion resistance to the article of footwear 10. The heel wrap 210 is configured to provide additional tactile feel to the article of footwear 10. The heel wrap 210 extends from a portion of the mid-foot region 22 through the heel region 24, and also around the posterior end 14 of the article of footwear 10. The first cushioning element 212 extends from the anterior end 12 to a portion of the heel region 24.

Figure 2:
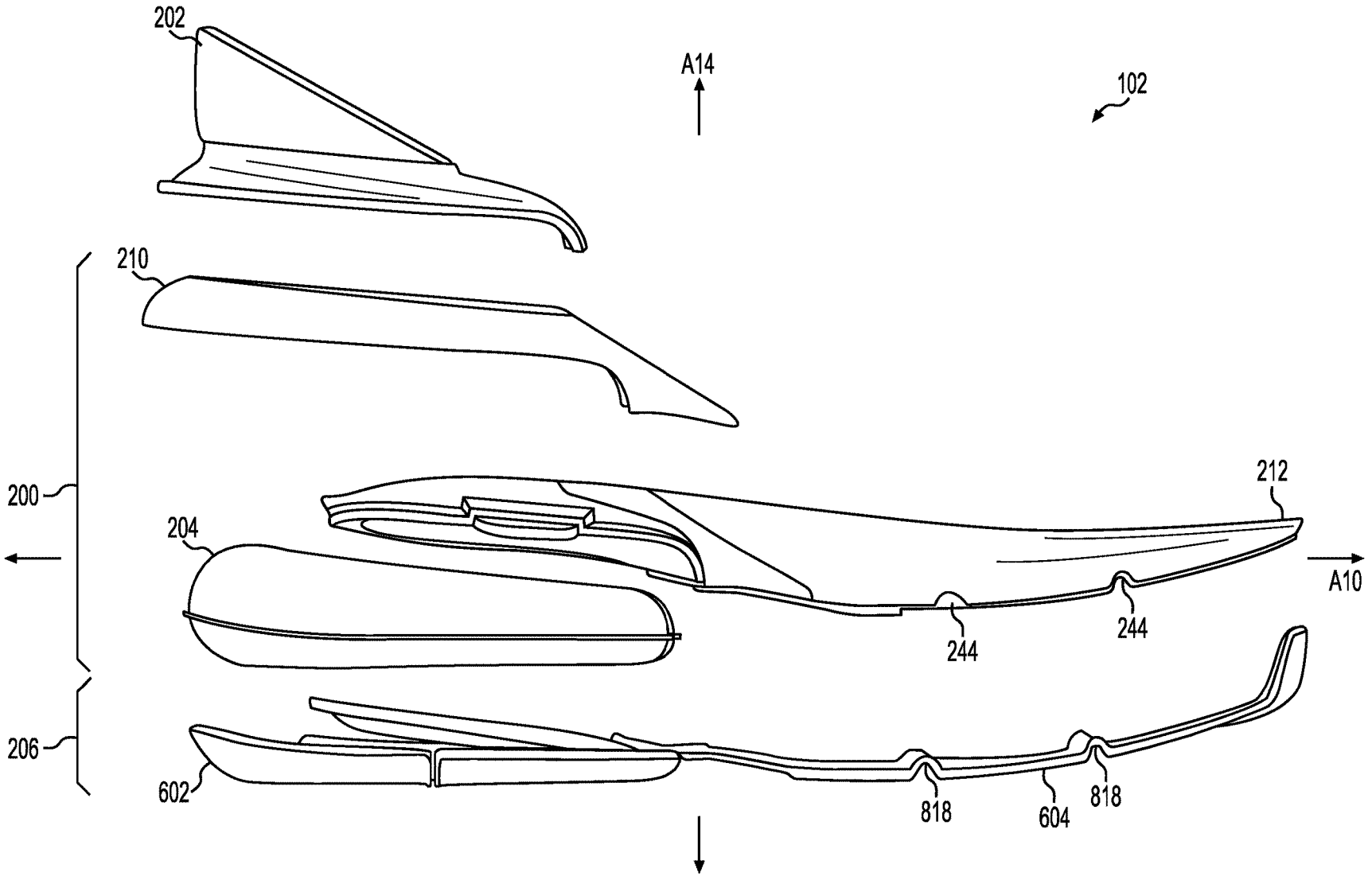
FIG. 2 is an exploded side view of a sole structure of the article of footwear of FIG. 1.

FIG. 2 depicts the second cushioning element 204, the first cushioning element 212, a heel cup 602 (described in greater detail in FIG. 6), and an outsole layer 604 (described in greater detail in FIG. 7A) in an exploded component view of the sole structure 102. Also shown in FIG. 2 are the heel clip 202 and the heel wrap 210 in an exploded component view of a portion of the article of footwear 10. In one embodiment, the sole structure 102 could be formed as a unitary structure.

Figure 3A:
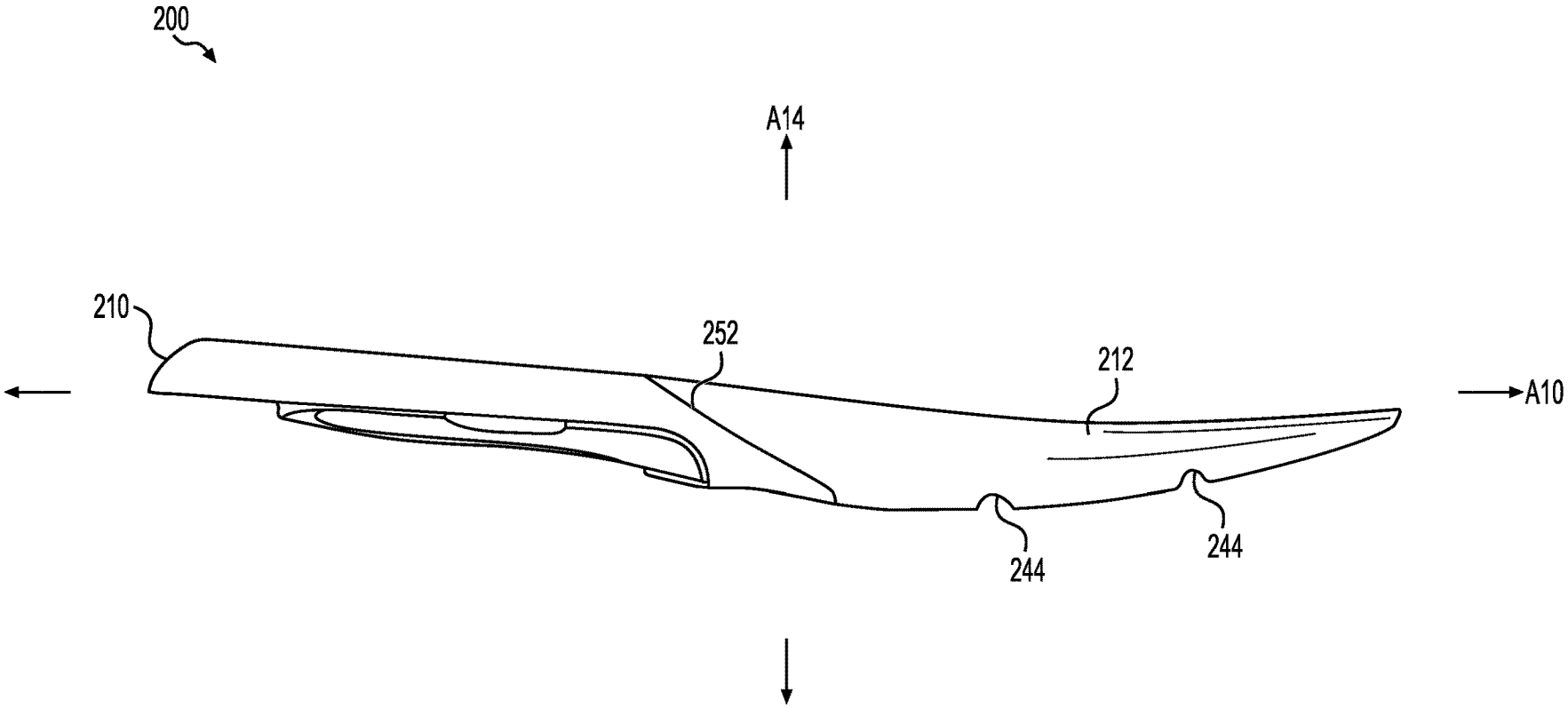
FIG. 3A is a side view of a midsole of the article of footwear of FIG. 1.

The heel wrap 210 and the first cushioning element 212 are attached (e.g., directly attached) in the mid-foot region 22 (also shown in FIG. 3A). The cushioning element 212 includes an elastomeric material. It is contemplated that the cushioning element 212 may include any other material to impart properties of cushioning to the article of footwear 10.

Figure 3B:
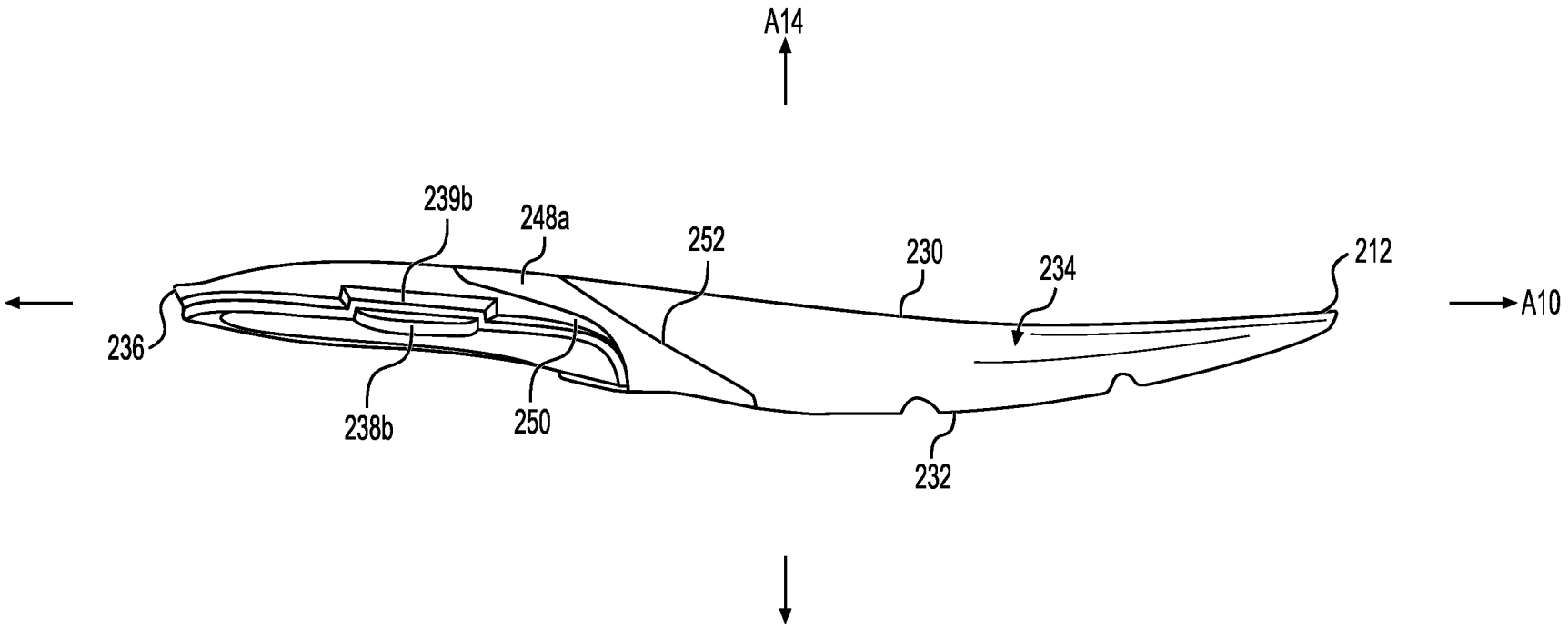
FIG. 3B is a side view of a first cushioning element of the midsole of FIG. 3A.

With reference to FIG. 3B, the first cushioning element 212 includes a top surface 230, a bottom surface 232, and an outer side surface 234. The first cushioning element 212 further includes a terminal end 236. The terminal end 236 is a portion of the first cushioning element 212 disposed within the heel region 24. The outer side surface 234 is bounded at its top by the top surface 230 and is bounded at its bottom by the bottom surface 232.

The bottom surface 232 includes one or more recessed portions (e.g., a medial recessed portion 238*a* (shown in FIG. 3C) and a lateral recessed portion 238*b*). The recessed portions 238*a* and 238*b* are portions of the bottom surface 232 that are cut-outs of material of the bottom surface 232. The recessed portions 238*a* and 238*b* expose an inner portion of the first cushioning element 212. The recessed portions 238*a* and 238*b* are each shown with a substantially D-shaped cross-section, although any other shapes are also contemplated. The recessed portions 238*a* and 238*b* include any shape suitable for communicating with other components of the article of footwear 10. The bottom surface 232 further includes stepped recessed portions (e.g., a medial stepped recessed portion 239*a* (shown in FIG. 3C) and a lateral stepped recessed portion 239*b*). The stepped recessed portions 239*a* and 239*b* are additional cut-outs of material from the bottom surface 232. The stepped recessed portions 239*a* and 239*b* have substantially rectangular cross-sections. The stepped recessed portions 239*a* and 239*b* are disposed in a horizontal plane (a plane defined by longitudinal axis A10 and medial-lateral axis A12) different than a horizontal plane of the recessed portions 238*a* and 238*b*. In an exemplary embodiment, the stepped recessed portions 239*a* and 239*b* are disposed above the recessed portions 238*a* and 238*b* (relative to vertical axis A14) when the bottom surface 232 is facing a ground surface. Additionally, the stepped recessed portions 239*a* and 239*b* include a vertical depth that is greater than a vertical depth of the stepped portions 238*a* and 238*b*. The stepped recessed portions 239*a* and 239*b* include a horizontal width that is wider than a horizontal width of the recessed portions 238*a* and 238*b*. In alternate embodiments, the stepped recessed portions 239*a* and 239*b* are narrower and/or shorter than the recessed portions 238*a* and 238*b*. The stepped recessed portions 239*a* and 239*b* include any shape suitable for communicating with other components of the article of footwear 10.

A heel portion of the bottom surface 232 rests in a plane along the vertical axis A14 that is different from a plane along the vertical axis A14 of a mid-foot portion and a heel portion of the bottom surface 232. The portions of the bottom surface 232 resting in different planes corresponds with portions of the bottom surface 232 having different thicknesses when compared to one another. For example, the heel portion of the bottom surface 232 has a first thickness and the mid-foot portion and the forefoot portion of the bottom surface 232 have a second thickness.

The outer surface 234 of the first cushioning element 212 further includes at least one engagement area 248*a*. The engagements area 248*a* is a recessed portion of the outer side surface 234. The engagement area 248*a* extends along an entire height of the outer side surface 234. The height of the outer side surface 234 is the distance between the top surface 230 and the bottom surface 232. The engagement area 248*a* is a lateral engagement area disposed on the lateral side 18.

The engagement area 248*a* is bounded at a posterior side by a posterior segment 250. The engagement area 248*a* is bounded at an anterior side by an anterior segment 252. The anterior segment 252 is a posterior-facing edge of the first cushioning element 212. Although only shown on the lateral side 18, the anterior segment 252 is present on both the medial side 16 and the lateral side 18. The engagement area 248*a* has a substantially hour glass shape or is otherwise complementary in shape to one or more protruding sections 228*a*/228*b* of the heel wrap 210 (see FIG. 3G). It is contemplated that in alternative embodiments, the engagement area 248*a* has a shape suitable for engaging with other components of the article of footwear 10. A medial engagement area (not shown) is disposed on the medial side 16 of first cushioning element 212 opposite the lateral engagement area 248*a*. The medial engagement area is substantially similar or the same as lateral engagement area 248*a*.

Figure 3C:
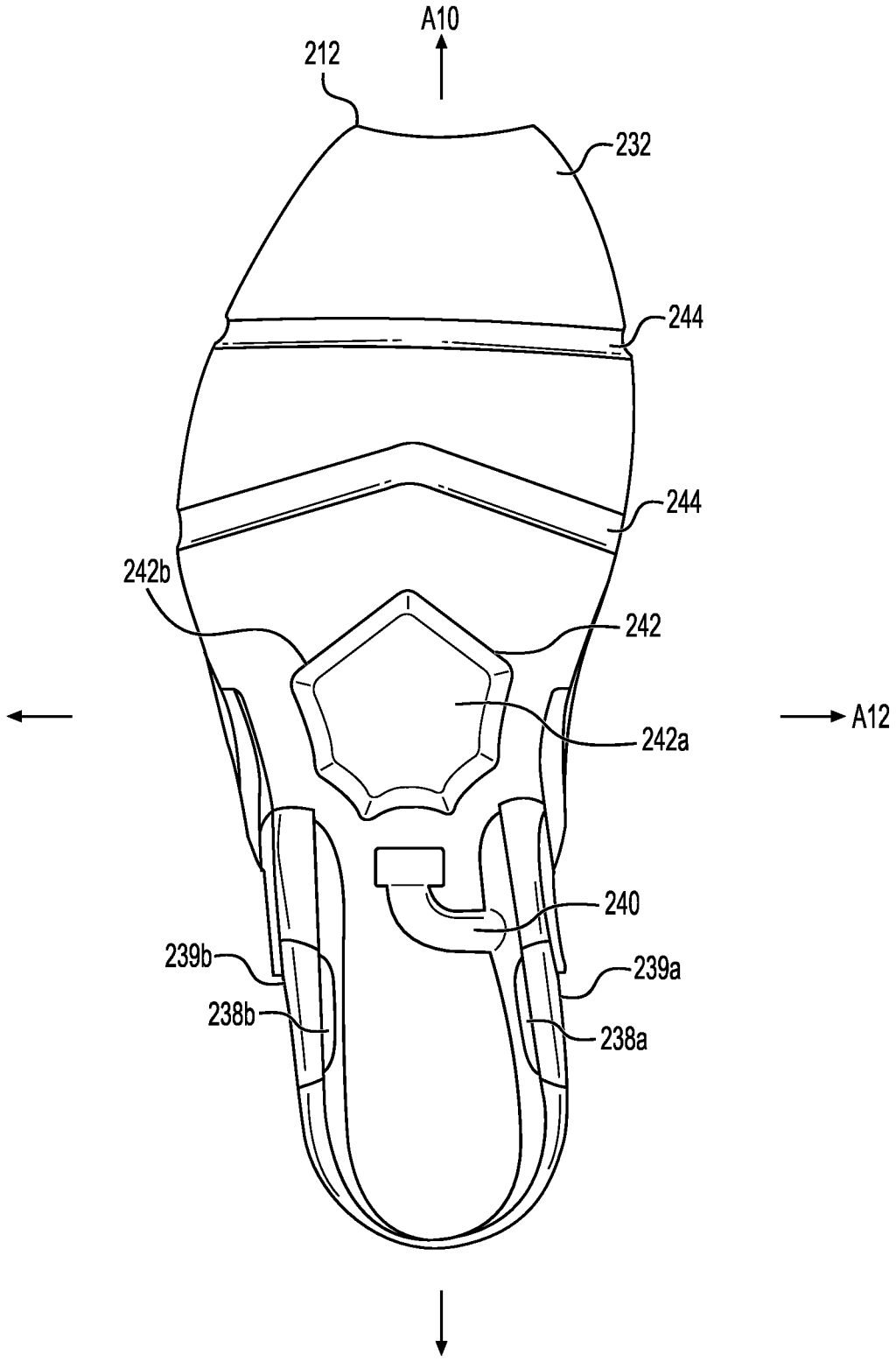
FIG. 3C is a bottom view of the first cushioning element of FIG. 3B.

Referring to FIG. 3C, the bottom surface 232 includes a receiving area 240 and an extended portion 242. In an exemplary embodiment, the receiving area 240 is a trough extending into a portion of the bottom surface 232. The receiving area 240 is a portion of the bottom surface 232 that has had material removed from it. In other words, the receiving area 240 is a recessed portion of the bottom surface 232. The receiving area 240 is curved. The receiving area 240 has a substantially J-shape. The extended portion 242 protrudes outwardly from a center portion of the bottom surface 232. In other words, the extended portion 242 is a raised portion of the bottom surface 232. The extended portion 242 includes an interior base 242*a* and a peripheral edge 242*b*. The peripheral edge 242*b* has a shape that substantially, or completely, surrounds the interior base 242*a*. It is contemplated that the extended portion 242 includes any shape such as a circle, triangle, square, rectangle, or irregular. In an exemplary embodiment, the interior base 242*a* and the peripheral edge 242*b* are 7-pointed. The shape of the extended portion 242 includes any shape suitable for providing a desired perception of feel to the article of footwear 10.

Additionally, the bottom surface 232 includes one or more reliefs 244. The reliefs 244 extend from the medial side 16 to the lateral side 18. One of the reliefs 244 includes a chevron shape. Another of the reliefs 244 includes any other shape such as a linear shape or the like. In an alternative embodiment, each the reliefs 244 may have the same shape as any of the other reliefs 244.

Figure 3D:
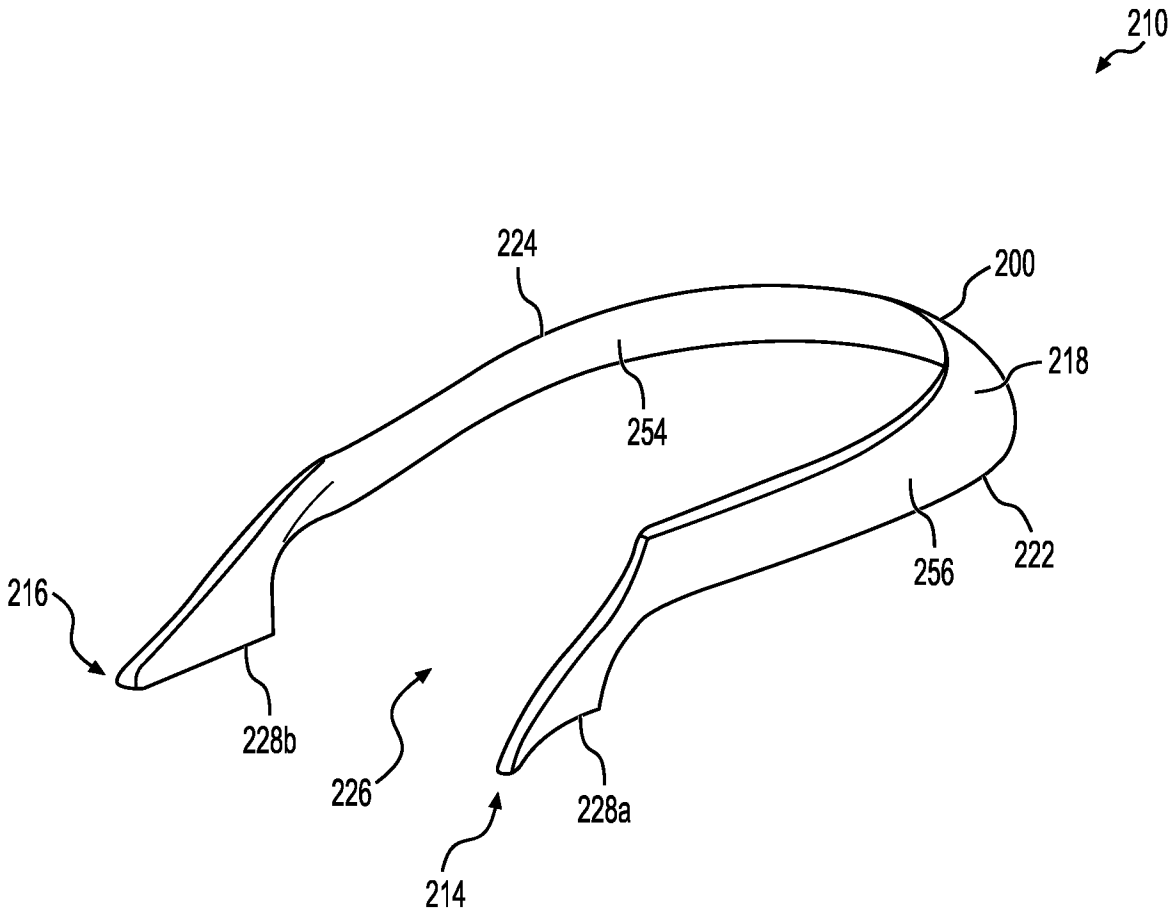
FIG. 3D is a top perspective view of a heel wrap of the midsole of FIG. 3A.

Referring to FIG. 3D, the heel wrap 210 extends from a first end 214 to a second end 216. The first end 214 is present on the medial side 16. The second end 216 is present on the lateral side 18. The heel wrap 210 includes a body 218 having a base or back section 220, a medial side 222, and a lateral side 224. The medial and lateral sides 222 and 224 are coupled to the base section 220 such that the heel wrap 210 forms a substantially "U" shape having an opening (or gap) 226 between the medial and lateral sides 222 and 224.

Heel wrap 210 also includes one or more protruding sections (or fins) 228*a* and 228*b* that extend from body 218 in a direction away from the upper 100 (e.g., toward the ground). The protruding section 228*a* is a first protruding section and protruding section 228*b* is a second protruding section. First protruding section 228*a* is disposed at the first end 214 on the medial side 16. Second protruding section 228*b* is disposed at the second end 216 on the lateral side 18. The protruding section 228*a* is a portion of the heel wrap 210 extending toward the ground from the respective medial side 222. The protruding section 228*b* is a portion of the heel wrap 210 extending toward the ground from the respective lateral side 224. Each of the protruding sections 228*a* and 228*b* include a respective anterior-facing edge. The protruding sections 228*a* and 228*b* have a downward taper in the anterior direction. When the article of footwear is oriented so that the outsole 206 is in contact with the ground, the protruding sections 228*a* and 228*b* extend toward the ground.

Figure 3E:
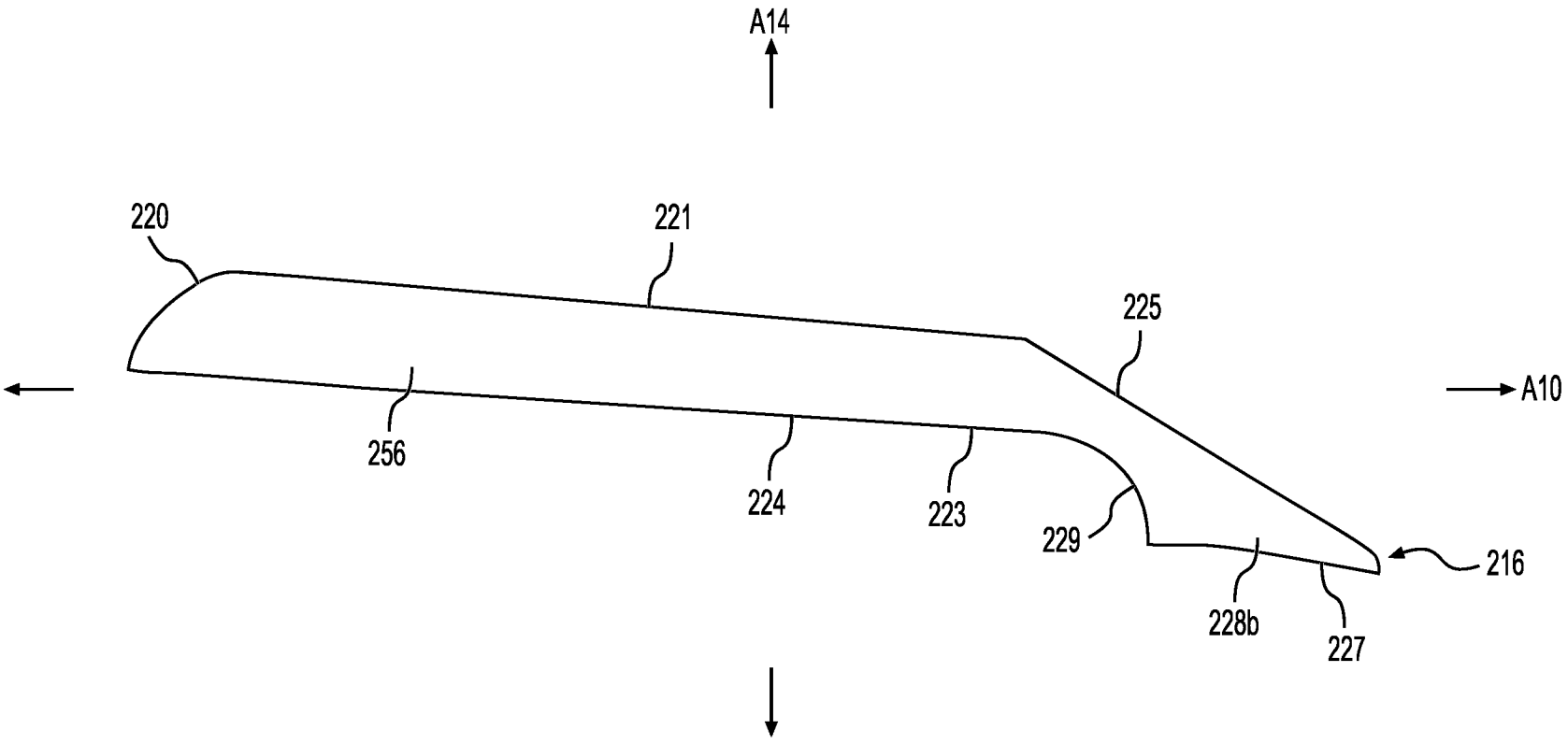
FIG. 3E is a side view of the heel wrap of the midsole of FIG. 3D.

With reference to FIG. 3E, the heel wrap 210 further includes a top surface 221 and a first bottom surface 223. The protruding sections 228*a* and 228*b* each include a curve 229 at the posterior facing portion of the protruding sections 228*a* and 228*b*, an incline 225 at the anterior-facing edge of the protruding sections 228*a* and 228*b*, and a second bottom surface 227. The curve 229 corresponds with a posterior-facing transition region between the medial or lateral sides 222 or 224 and the protruding sections 228*a* or 228*b* respectively. The curve 229 also corresponds with a transition region between the first bottom surface 223 and the second bottom surface 227. Incline 225 corresponds with an anterior-facing transition region between the medial or lateral sides 222 or 224 and the protruding sections 228*a* or 228*b* respectively. The incline 225 also corresponds with a transition region between the top surface 221 and the first or second ends 214 or 216. The protruding sections 228*a* and 228*b* are substantially triangular shaped. In alternative embodiments, the one or more protruding sections 228*a* and 228*b* are rounded, square, or any other shape capable of attaching the heel wrap 210 to the first cushioning element 212.

The first protruding section 228*a* and the second protruding section 228*b* are disposed at similar and/or overlapping longitudinal positions on opposing sides of the central longitudinal axis of the heel wrap 210. In some embodiments, first protruding section 228*a* and second protruding section 228*b* are symmetrical, although it is contemplated that they may have different shapes.

Figure 3F:
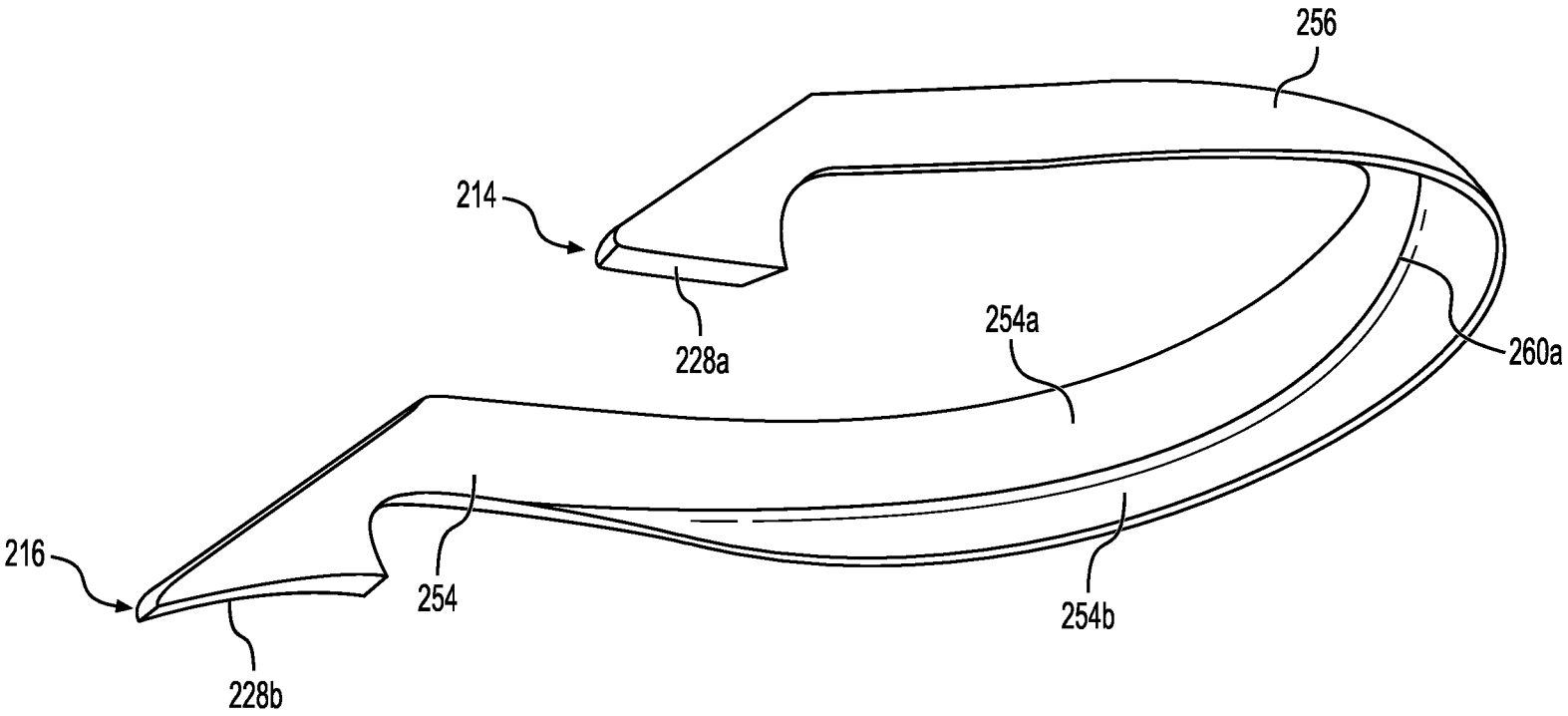
FIG. 3F is a bottom perspective view of the heel wrap of FIG. 3D.

Referring to FIG. 3F, the heel wrap 210 includes an inner surface 254, and an outer surface 256. The inner surface 254 further includes an inner rim 260. However, it is also contemplated that in some embodiments, inner surface 254 does not include an inner rim and has a substantially smooth and continuous surface 254 (see, e.g., FIG. 3D). The inner rim 260 extends along a substantial entirety or an entirety of inner surface 254 from the first end 214 to the second end 216. The inner rim 260 includes a continuous flat edge 260*a* that faces toward the bottom of the heel clip (i.e., toward the ground when outsole 206 is in contact with the ground). The inner rim 260 further divides the inner surface 254 into a first (top) portion 254*a* and a second (bottom) portion 254*b*. Thus, the first portion 254*a* is positioned above the second portion 254*b*. The second portion 254*b* is recessed relative to first portion 254*a*. Thus, the thickness of first portion 254*a* in the direction from the inner surface 254 to the outer surface 256 is greater than the thickness of second portion 254*b* along the same direction.

Figure 3G:
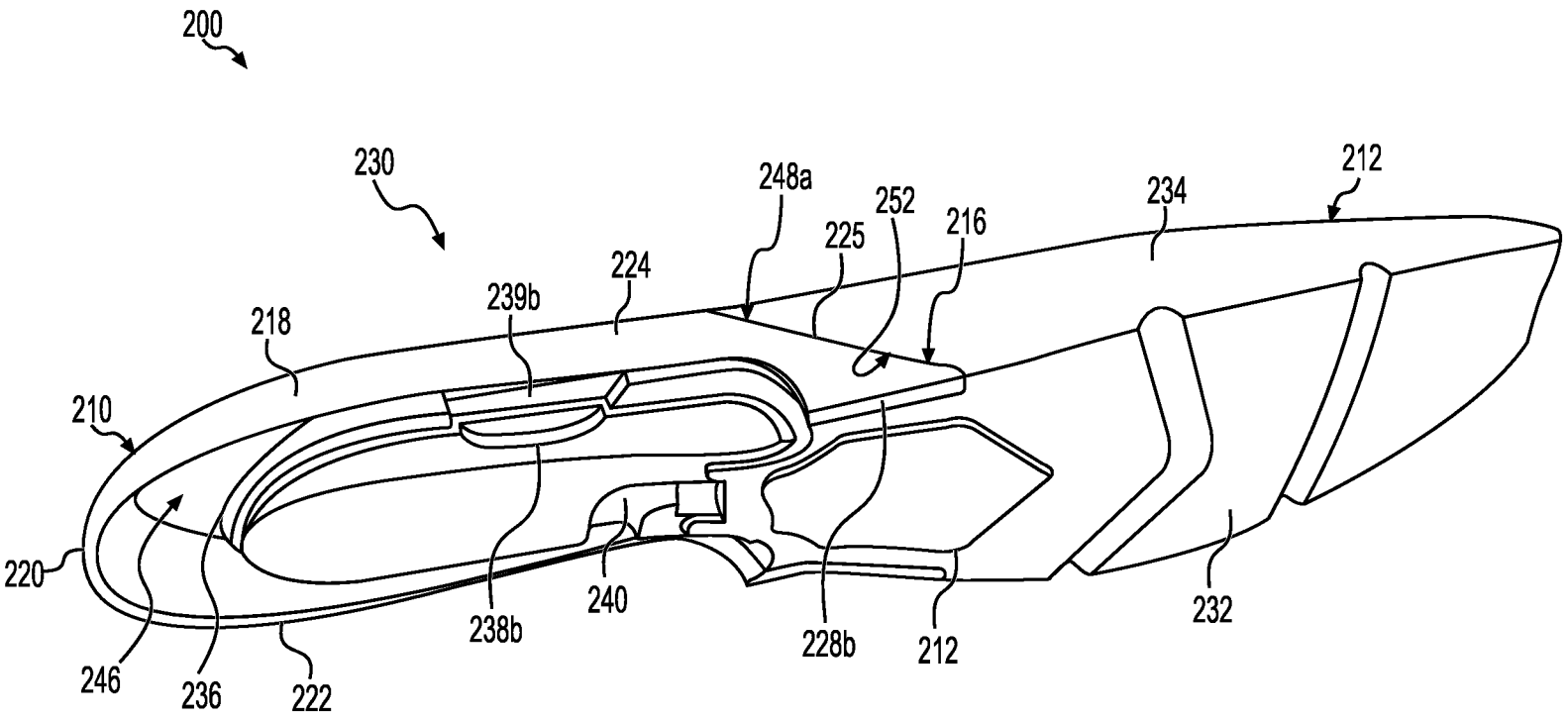
FIG. 3G is a bottom perspective view of the midsole of FIG. 3A.

Referring to FIG. 3G, the heel wrap 210 and the first cushioning element 212 are attached to one another on both the medial side 16 and the lateral side 18. The attachment points of the heel wrap 210 and the first cushioning element 212 are located in the mid-foot region 22. On the medial side, the protruding section 228*a* is received by the medial engagement area 248*b*. The first end 214 of the protruding section 228*a* is substantially flush with the medial engagement area 248*b*. On the lateral side, the protruding section 228*b* is received by the lateral engagement area 248*a*. The second end 216 of the protruding section 228*b* is substantially flush with the lateral engagement area 248*a*. The incline 225 and the anterior-facing edge of the respective protruding section 228*a* abuts the anterior segment 252 on the medial side 16. Although not shown, on the lateral side 18, the incline 225 and the anterior-facing edge of the respective protruding section 228*b* abuts the anterior segment 252. The heel wrap 210 is attached to the first cushioning element 212 by stock fit, adhesive fit, friction, or the like. Outer surfaces of the heel wrap 210 and the first cushioning element 212 are substantially flush with one another to form a smooth transition between them on their outer surfaces. A gap 246 for receiving the heel clip 202 is disposed between the posterior end of the first cushioning element 212 and the heel wrap 210 in an unassembled state.

Figure 4A:
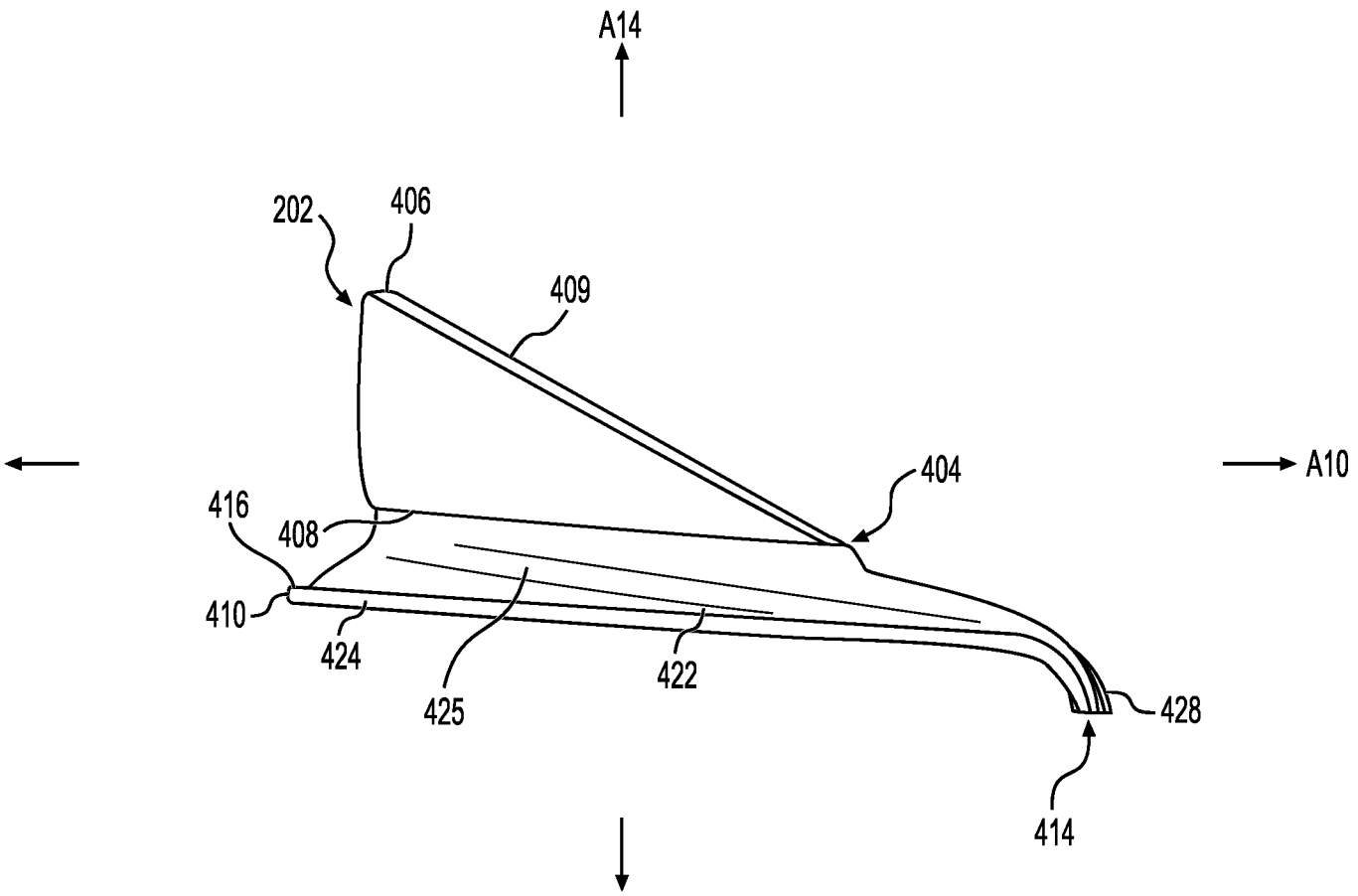
FIG. 4A is a side view of a heel clip of the article of footwear of FIG. 1.
Figure 4B:
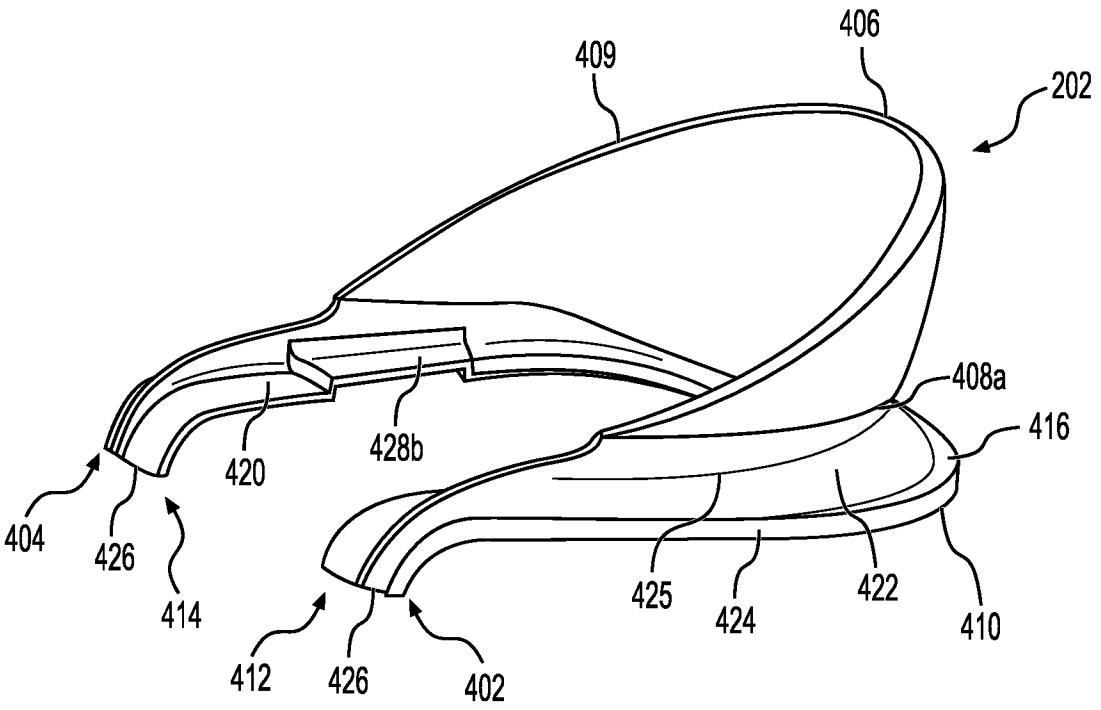
FIG. 4B is a top perspective view of the heel clip of FIG. 4A.

Referring to FIGS. 4A and 4B, the heel clip 202 extends from a first end 402 to a second end 404 (shown in FIG. 4B). The heel clip 202 includes a support 409 and a base 410. A height of the heel clip 202 increases from the second end 404 in the heel region of the lateral side 18 to a vertex 406 located at a lateral center of the heel clip 202, and then decreases to the first end 402. The heel clip 202 is similarly formed along the medial side 16, such that the height of the heel clip 202 increases from the first end 402 in the heel region of the medial side 16 to the vertex 406, and then decreases to the second end 404.

The support 409 is cupped around the posterior end 14 of the upper 100 between the lateral side 18 and the medial side 16. In other words, the support 409 is parabolic. The parabolic support 409 decreases in dimension moving away from base 410. It is contemplated that in alternative embodiments, the support 409 may have a shape suitable for providing support to the heel of a user of the article of footwear 10. The support 409 further includes a lower rim 408. The lower rim 408 is formed on a bottom surface of the support 409 at the interface of support 409 and base 410. The lower rim 408 corresponds with a bottom most portion of the support 409 having a greater thickness than an immediately adjacent portion of the heel clip 202 at base 410. The lower rim 408 abuts the top surface of heel wrap 210 when coupled with heel clip 202.

The base 410 is disposed adjacent to the lower rim 408. Base 410 extends from a first end 412 disposed on the medial side 16 to a second end 414 disposed on the lateral side 18. The first end 412 of the base 410 and the second end 414 of the base 410 are disposed at the first end 402 of the heel clip 202 and the second end 404 of the heel clip 202. The base 410 is U-shaped. Base 410 further includes a first (upper) surface 416, a second (bottom) surface 418, a third (inner) surface 420, and a fourth (outer) surface 422. Fourth surface 422 is disposed adjacent to the lower rim 408, and is positioned between the inner rim and upper surface 416. Third surface 420 is disposed adjacent to the lower rim 408. Third surface 420 is recessed from lower rim 408. First surface 416 is adjacent to fourth surface 422 and first surface 416 is adjacent to third surface 420. First surface 416 and third surface 420 are separated by the support 409. The portion of first surface 416 adjacent to fourth surface 422 forms a lip or flange 424. A receiving area 425 is formed between the lower rim 408 and the flange 424. Receiving area 425 corresponds with the fourth surface 422. Receiving area 425 is recessed compared to the base 410 and the support 409. In examples where the heel wrap 210 is not present, the receiving area 425 may be removed and the base 410 may abut the support 409. A portion of third surface 420 includes a pair of opposing protrusions 428*a* and 428*b*. The opposing protrusions include a medial protrusion 428*a* (shown in FIG. 4C) and a lateral protrusion 428*b*. Opposing protrusions 428*a* and 428*b* are portions of the third surface 420 that are raised when compared with other portions of the third surface 420. Protrusions 428*a* and 428*b* are rectangular in shape. It is contemplated that in alternative embodiments, protrusions 428*a* and 428*b* are square, rounded, or any other shape.

Base 410 includes a pair of opposing protrusions (e.g., hooks) 426. Protrusions 426 are disposed at the first end 412 and the second end 414. The base 410 curves downwards at its ends 412 and 414 such that there is a drop (along vertical axis A14) from the first surface 416 to the first and second ends 412 and 414, respectively, at an anterior-most portion of the heel clip 202. Protrusions 426 correspond with the drop from the first surface 416 to the first and second ends 412 and 414 at the anterior-most portions of the heel clip 202. In other words, the first end 412 and the second end 414 have a curved shape comprising a substantially hook-shaped curve. The protrusions 426 curve in a direction away from the base 410 (toward the ground).

Figure 4C:
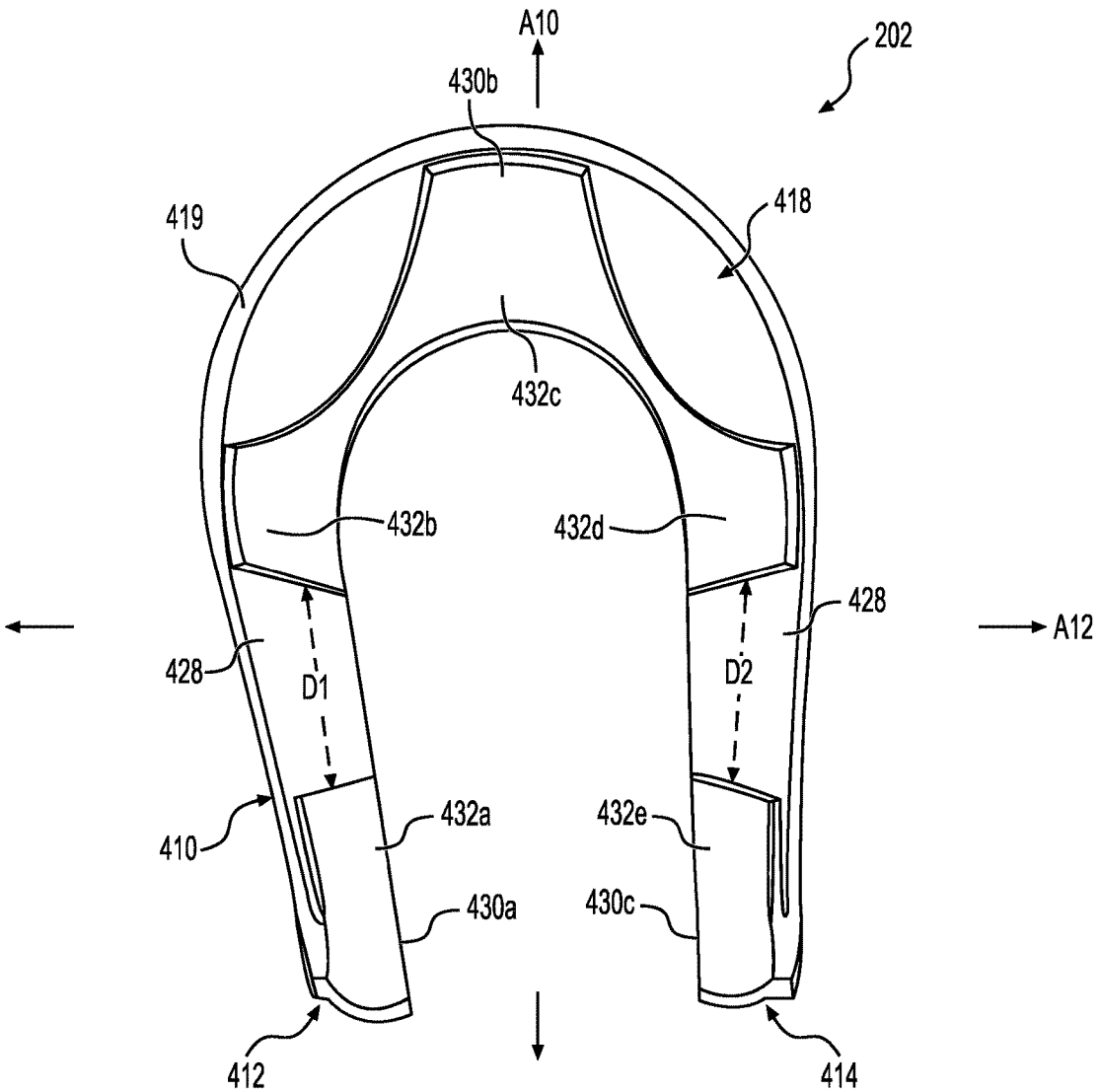
FIG. 4C is a bottom view of the heel clip of FIG. 4A.

With reference to FIG. 4C, the second surface 418 is a recessed portion of base 410. Base 410 includes protruding portions 430 extending from the second surface 418. In an exemplary embodiment, protruding portions 430 include protruding portions 430*a*, 430*b*, and 430*c*. Portions 430 are raised portions of the base 410 disposed on the second surface 418. In other words, the portions 430 extend away from the second surface 418 toward a ground surface. Portions 430 are bounded at an outer-most edge by an outer edge 419. Outer edge 419 is an outer most edge of the base 410. Outer edge 419 is also be a bottom-most edge of the base 410. In some examples, second surface 418 may not be recessed and thus base 410 may have a substantially flat second surface 418.

Each portion 430*a*, 430*b*, and 430*c* include one or more protruding segments 432. Portions 430*a* and 430*c* are symmetrical with another about a central longitudinal axis of the heel wrap 210. Portion 430*b* is disposed posterior portions 430*a* and 430*c*. The segments 432 are an individual portion of their respective one or more portions 430. Portion 430B includes segments 432*b*, 432*c*, and 432*d*. Segments 432*b*, 432*c*, and 432*d* extend either laterally or longitudinally on second surface 418. Segments 432*b*, 432*c*, and 432*d* are interconnected. In an alternative embodiment, segments 432*b*, 432*c*, and 432*d* may not be interconnected and may form their own respective individual mold segment that are spaced apart by second surface 418. Portions 430*a* and 430*c* are disposed opposite one another at the respective first end 412 and the second end 414, respectively. Portions 430*a* and 430*c* include respective segments 432*a* and 432*e*, respectively. It is contemplated that in an alternative embodiment, portions 430*a* and 430*c* are asymmetrical. Segments 432*a* and 432*b* are spaced apart from one another by a distance D1. Distance D1 corresponds to a length of one of the protrusions 428*a* or 428*b*. Segments 432*d* and 432*e* are spaced apart from one another by a distance D2. Distance D2 corresponds to a length of one of the protrusions 428*a* or 428*b*. In an exemplary embodiment, distances D1 and D2 range from about 0.5 mm and about 75 mm. In some embodiments, D1 and D2 are substantially the same or equal to one another. In alternate embodiments, distances D1 and D2 are different from one another.

Figure 5A:
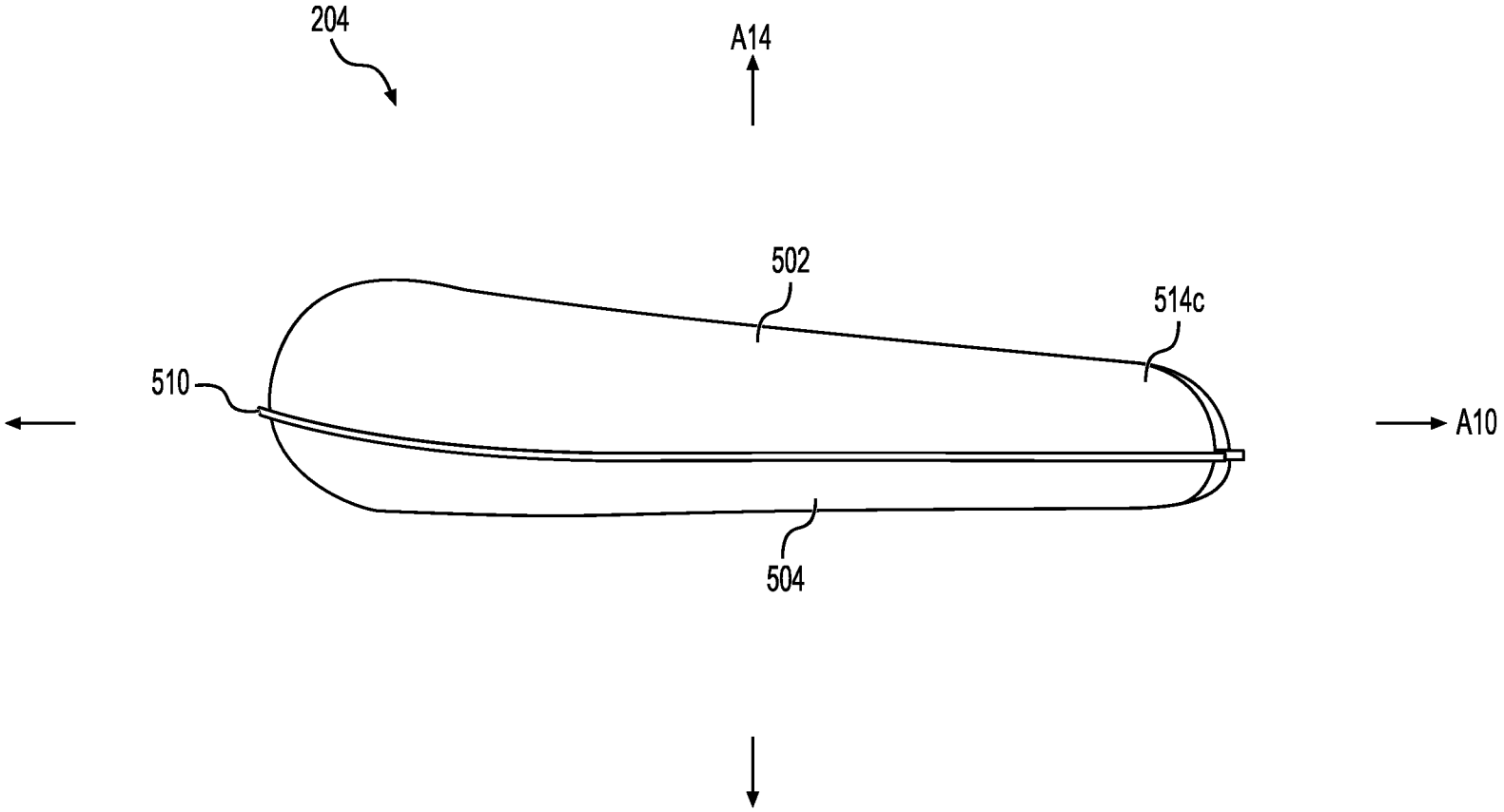
FIG. 5A is a side view of a second cushioning element of the article of footwear of FIG. 1.

Referring to FIG. 5A, the cushioning element 204 of includes an opposing pair of barrier films 502 and 504, which can be joined to each other at discrete locations to define a chamber 506 (shown in FIG. 5B), a web area 508 (shown in FIG. 5C), and a peripheral seam 510. Cushioning element 204 may be an airbag or a bladder.

Figure 5B:
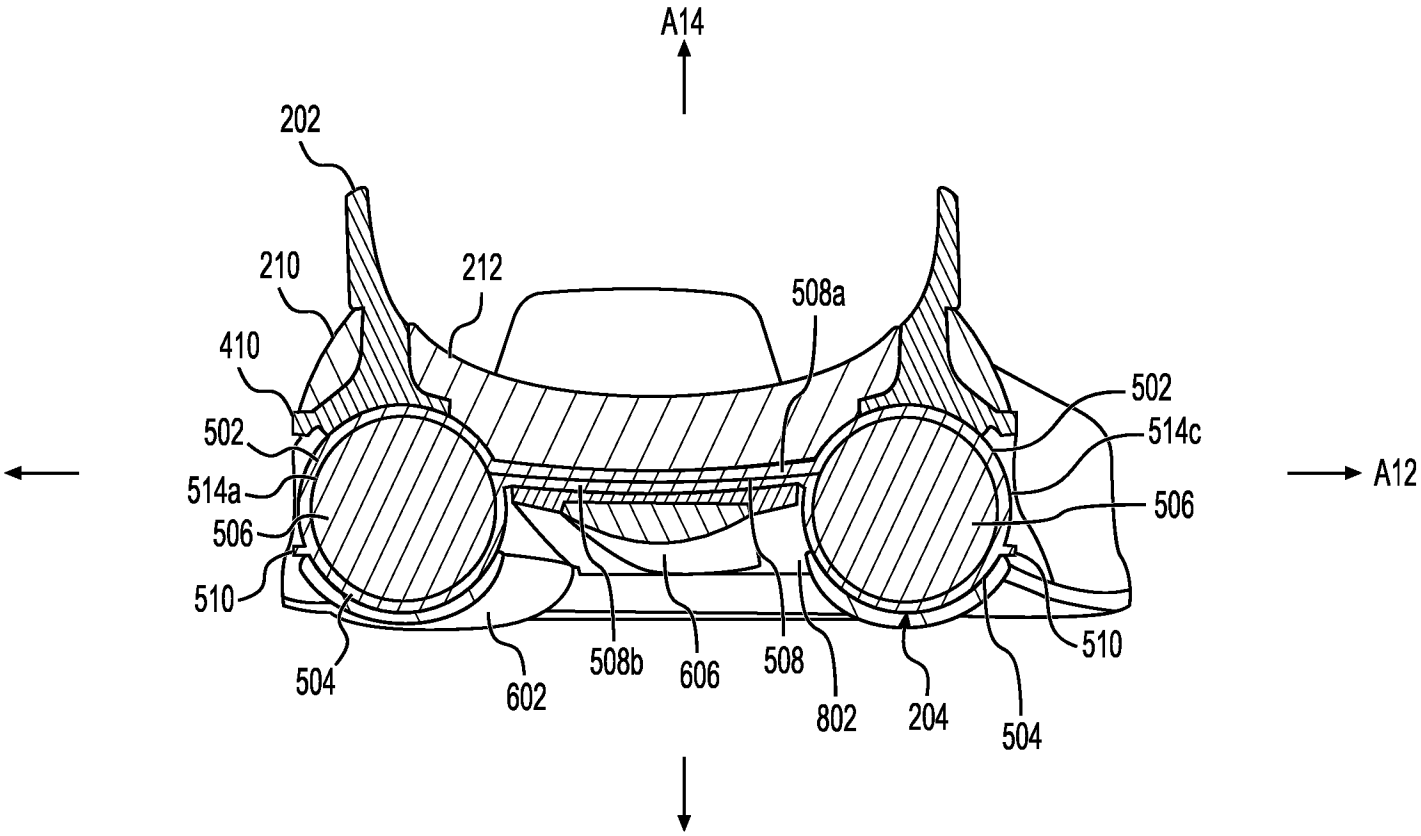
FIG. 5B is a rear cross-sectional view of the sole structure of FIG. 12 taken along line 5B-5B.

Referring to FIG. 5B, the barrier films 502 and 504 include a first, upper barrier film 502 and a second, lower barrier film 504. Alternatively, the chamber 506 could be produced from any suitable combination of one or more barrier films. Web area 508 is an area where opposing barrier films 502 and 504 are bonded directly to one another without an intervening gap between the films. Web area 508 includes a first (upper) surface 508A disposed on a first side of the web area 508 facing the upper 100, and a second (lower) surface 508B disposed on an opposing second side of the web area 508 facing the ground surface.

In some implementations, the upper barrier film 502 and the lower barrier film 504 cooperate to define a geometry (e.g., thicknesses, width, and lengths) of the chamber 506. For example, the web area 508 and the peripheral seam 510 cooperate to bound and extend around the chamber 506 to seal the fluid (e.g., air) within the chamber 506. Thus, the chamber 506 is associated with an area of the cushioning element 204 where interior surfaces of the upper and lower barrier films 502 and 504 are not joined together and, thus, are separated from one another. A space formed between opposing interior surfaces of the upper and lower barrier films 502 and 504 defines an interior void of the chamber 506. Similarly, exterior surfaces of the upper and lower barrier films 502 and 504 define an exterior profile of the chamber 506. Accordingly, the upper and lower barrier films 502 and 504 define respective upper and lower surfaces of the cushioning element 204.

Figure 5C:
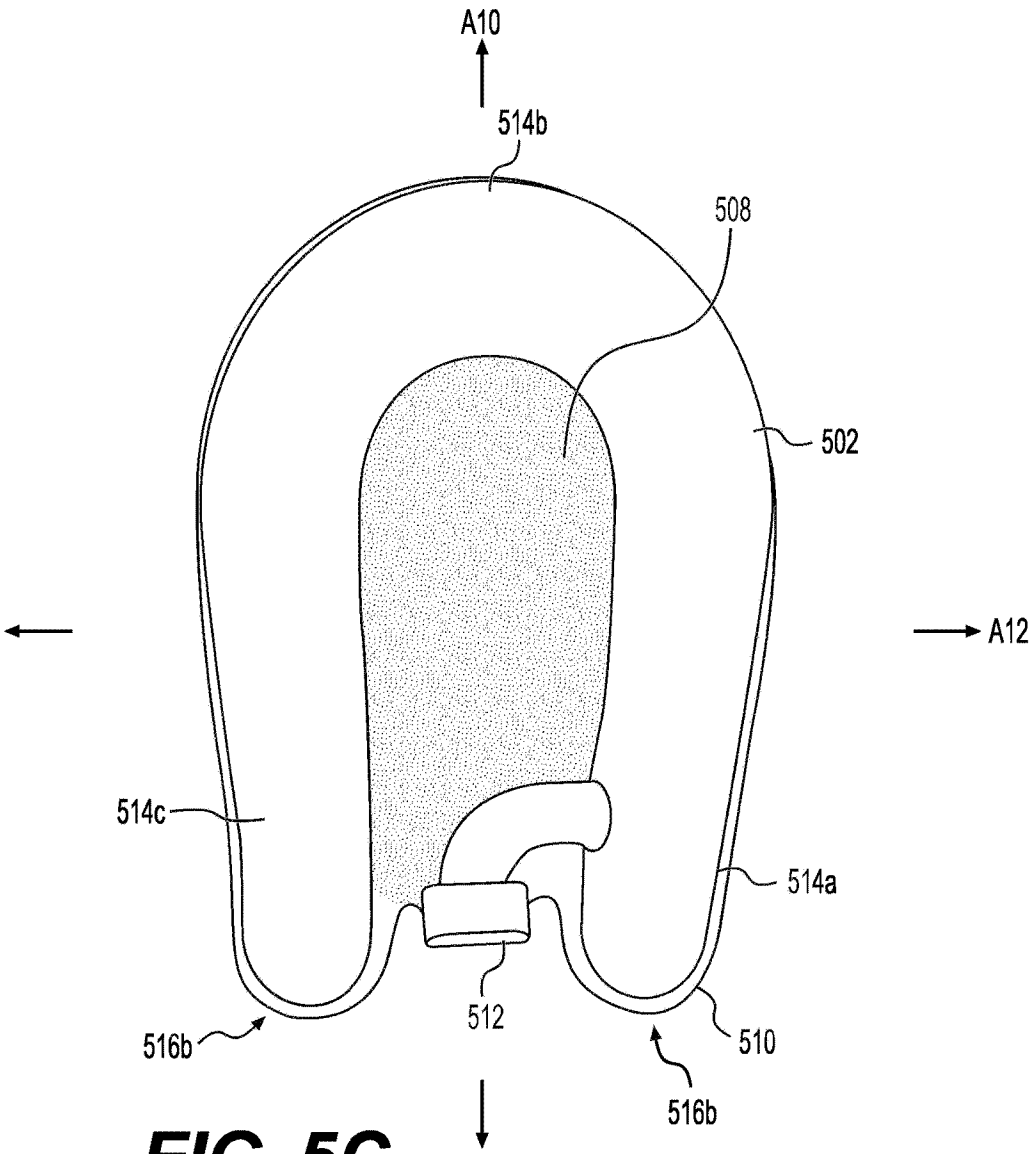
FIG. 5C is a top view of the second cushioning element of FIG. 5A.

Referring to FIG. 5C, the second cushioning element 204 includes a plurality of segments 514*a*, 514*b*, and 514*c*. In some implementations, the upper barrier film 502 and the lower barrier film 504 cooperate to define a geometry (e.g., thicknesses, width, and lengths) of each of the segments 514*a*, 514*b*, and 514*c*. For example, the seam 510 and the web area 508 cooperate to bound and extend around each of the segments 514*a*, 514*b*, and 514*c* to seal the fluid (e.g., air) within each of the segments 514*a*, 514*b*, and 514*c*. Thus, in some implementations, each segment 514*a*, 514*b*, and 514*c* is associated with an area of the second cushioning element 204 where the upper and lower film 502 and 504 are not joined together and, thus, are separated from one another to form respective chambers 506.

In the illustrated example, the second cushioning element 204 includes a series of connected segments 514*a*, 514*b*, and 514*c* disposed within the heel region 24 of the sole structure 102. Additionally or alternatively, the second cushioning element 204 could be located within the forefoot or mid-foot regions 20 and 22 of the sole structure. The medial segment 514*a* extends along the medial side 16 of the sole structure 102 in the heel region 24 and terminates at a first distal end 516*a* within the mid-foot region 22. Likewise, a lateral segment 514*c* extends along the lateral side 18 of the sole structure 102 in the heel region 24 and terminates at a second distal end 516*b* within the mid-foot region 22. The posterior segment 514*b* extends around the posterior end 14 of the heel region 24 and fluidly couples to the medial segment 514*a* and the lateral segment 514*c*.

The posterior segment 514*b* extends along a substantially curved path to connect a posterior end of the medial segment 514*a* to a posterior end of the lateral segment 514*c*. Furthermore, the posterior segment 514B is continuously formed with each of the medial segment 514A and the lateral segment 514C. Accordingly, the second cushioning element 204 generally defines a horse-shoe shape or U-shape, wherein the posterior segment 514*b* couples to the medial segment 514*a* and the lateral segment 514*c* at respective ones of the medial side 16 and the lateral side 18. In alternative embodiments, the medial segment 514*a* and the lateral segment 514*c* have different lengths. For example, the lateral segment 514*c* could extend farther along the lateral side 18 and into the mid-foot region 22 than the medial segment 514*c* extends along the medial side 16 into the mid-foot region 22.

Each segment 514*a*, 514*b*, and 514*c* is tubular and defines a substantially circular cross-sectional shape. Accordingly, diameters of the segments 514*a*, 514*b*, and 514*c* correspond to both thicknesses and widths of the second cushioning element 204. The thicknesses of the second cushioning element 204 are defined by a distance between the upper barrier film 502 and the lower barrier film 504 in a direction from the ground-engaging surface to the upper 100, while the width of the second cushioning element 204 is defined by a distance across the chamber 506, taken perpendicular to the thickness of the second cushioning element 204. In alternative embodiments, thicknesses and widths of the second cushioning element 204 are different from each other.

At least two of the segments 514*a*, 514*b*, and 514*c* define different diameters of the second cushioning element 204. For example, one or more of segments 514*a*, 514*b*, and 514*c* have a greater diameter than one or more of the other segments 514*a*, 514*b*, and 514*c*. Additionally, the diameters of each the segments 514*a*, 514*b*, and 514*c* tapers from one end to another. As best shown in FIG. 5A, the diameter of the second cushioning element 204 tapers from the posterior end 14 to the mid-foot region 22 to provide a greater degree of cushioning for absorbing ground-reaction forces of greater magnitude that initially occur in the heel region 24 and lessen as the mid-foot region 22 of the sole structure 102 rolls for engagement with the ground surface. More specifically, the second cushioning element 204 tapers continuously and at a constant rate from a first diameter at the posterior end 14 to a second diameter at the mid-foot region 22.

Each of the segments 514*a*, 514*b*, and 514*c* are filled with the fluid to provide cushioning and stability for the foot during use of the footwear 10. In some implementations, compressibility of a first portion of the plurality of segments 514*a*, 514*b*, and 514*c* under an applied load may provide a responsive-type cushioning, while a second portion of the segments 514*a*, 514*b*, and 514*c* are configured to provide a soft-type cushioning under an applied load. Accordingly, the segments 514*a*, 514*b*, and 514*c* of the second cushioning element 204 cooperate to provide gradient cushioning to the article of footwear 10 that changes as the applied load changes (i.e., the greater the load, the more the segments 514*a*, 514*b*, and 514*c* are compressed and, thus, the more responsive the footwear 10 performs).

In some implementations, the segments 514*a*, 514*b*, and 514*c* are in fluid communication with one another to form a unitary pressure system for the second cushioning element 204. The unitary pressure system directs fluid through the segments 514*a*, 514*b*, and 514*c* when under an applied load as the segments 514*a*, 514*b*, and 514*c* compress or expand to provide cushioning, stability, and support by attenuating ground-reaction forces especially during forward running movements of the footwear 10. In some implementations, one or more of the segments 514*a*, 514*b*, and 514*c* are fluidly isolated from the other segments 514*a*, 514*b*, and 514*c* so that at least one of the segments 514*a*, 514*b*, and 514*c* can be pressurized differently.

In alternative embodiments, one or more cushioning materials, such as polymer foam and/or particulate matter, are enclosed by one or more of the segments 514*a*, 514*b*, and 514*c* in place of, or in addition to, the fluid to provide cushioning for the foot. In the alternative embodiments, the cushioning materials may provide one or more of the segments 514*a*, 514*b*, and 514*c* with cushioning properties different from the segments 514*a*, 514*b*, and 514*c* filled with the fluid. For example, the cushioning materials may be more or less responsive or provide greater impact absorption than the pressurized fluid.

Figure 6:
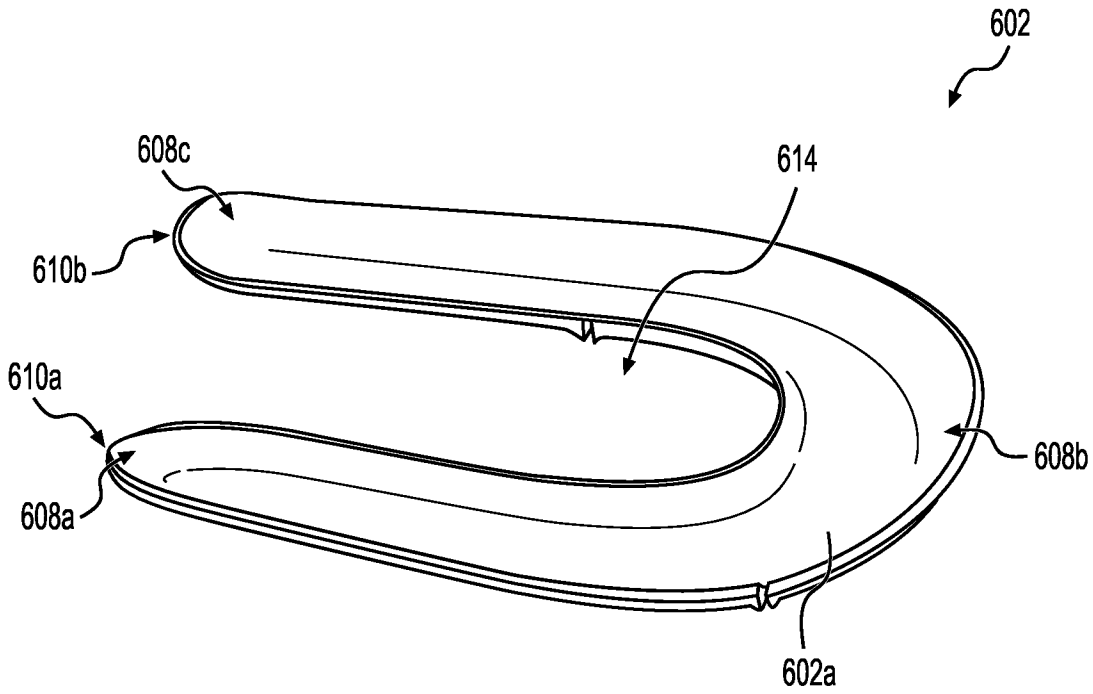
FIG. 6 is a top perspective view of a heel cup of the article of footwear of FIG. 1.

Referring to FIG. 6, the heel cup 602 includes a series of connected segments 608*a*, 608*b*, and 608*c* disposed within the heel region 24 of the sole structure 102. A medial segment 608*a* extends along the medial side 16 of the sole structure 102 in the heel region 24 and terminates at a first anterior end 610*a* within the mid-foot region 22. Likewise, a lateral segment 608*c* extends along the lateral side 18 of the sole structure 102 in the heel region 24 and terminates at a second anterior end 610*b* within the mid-foot region 22. The segments 608 of the heel cup 602 defines an opening 614. A posterior segment 608*b* extends around the posterior end 14 of the heel region 24 and couples to the medial segment 608*a* and the lateral segment 608*c*. The posterior segment 608*b* extends along a substantially curved path to connect a posterior end of the medial segment 608*a* to a posterior end of the lateral segment 608*c*.

The posterior segment 608*b* is continuously formed with each of the medial segment 608*a* and the lateral segment 608*c*. Accordingly, the heel cup 602 generally defines a horse-shoe shape or U-shape, wherein the posterior segment 608*b* couples to the medial segment 608*a* and the lateral segment 608*c* at respective ones of the medial side 16 and the lateral side 18. In alternative embodiments, the medial segment 608*a* and the lateral segment 608*c* have different lengths. For example, the lateral segment 608*c* extends farther along the lateral side 18 and into the mid-foot region 22 than the medial segment 608A extends along the medial side 16 into the mid-foot region 22.

Figure 10:
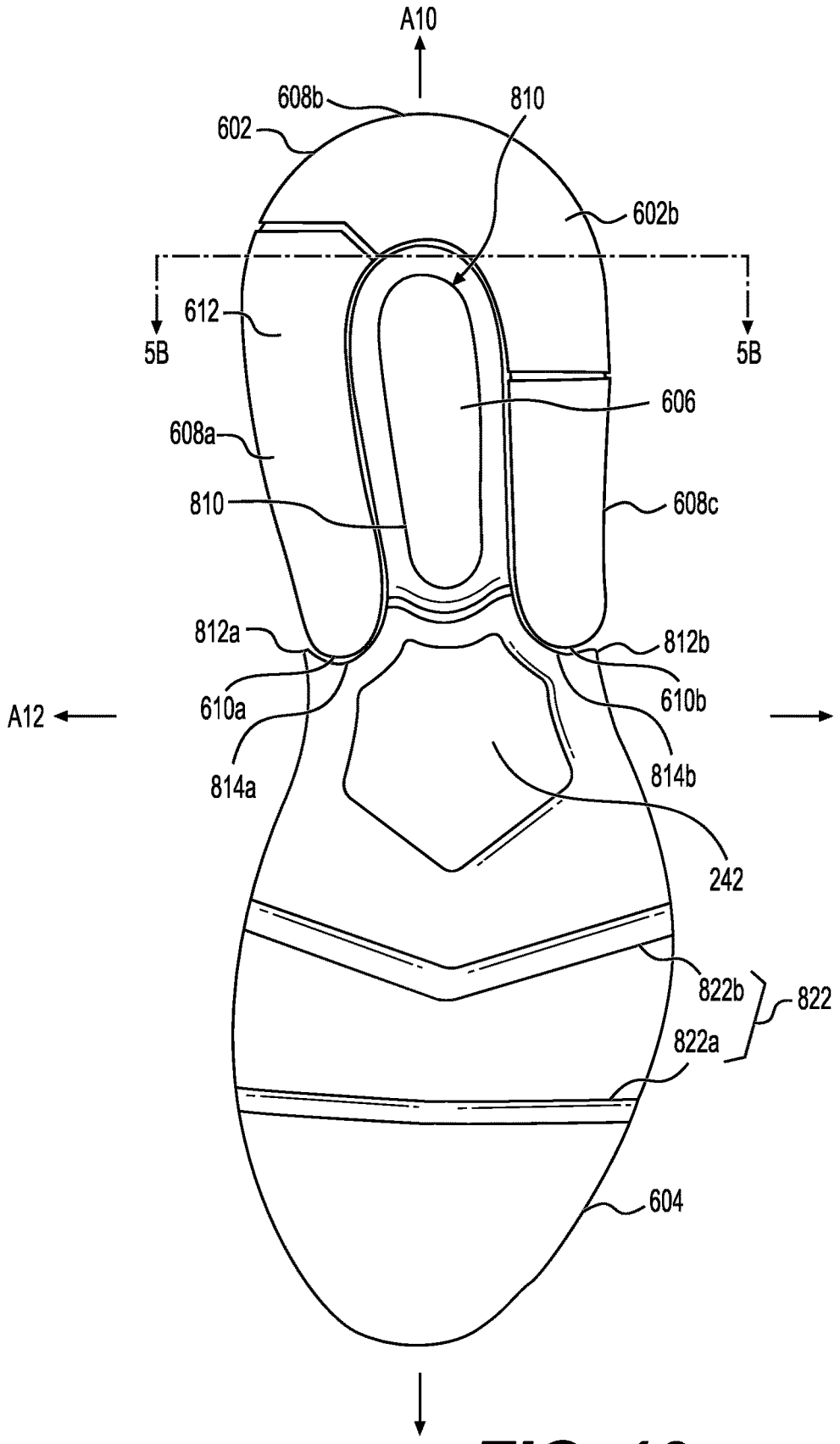
FIG. 10 is a bottom view of an outsole of the article of footwear of FIG. 1.

The heel cup 602 includes a first (top) surface 602A and a second (bottom) surface 602B (shown in FIG. 10). The first surface 602A is a recessed surface extending along each of the segments 608. The second surface 602B includes a plurality of traction elements 612 configured to engage with a ground surface to provide responsiveness and stability to the sole structure 102 during use, as described in U.S. Pat. No. 10,932,524 (Eldem), published Aug. 1, 2019, which is incorporated herein by reference in its entirety.

Figure 7A:
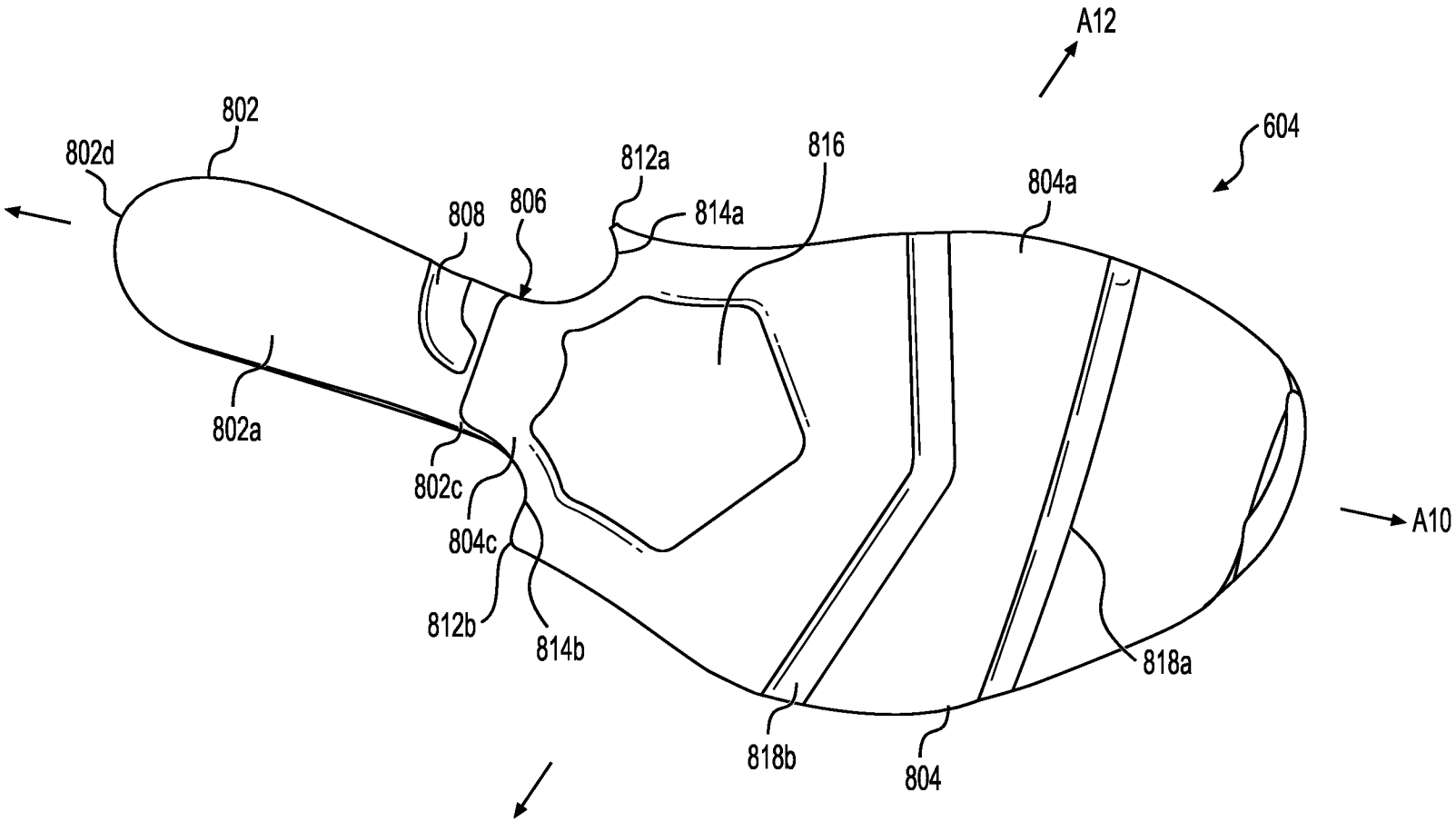
FIG. 7A is a top perspective view of an outsole layer of the article of footwear of FIG. 1.

Referring to FIG. 7A, the outsole layer 604 includes a heel portion 802, a body portion 804, and an overlapping or transition region 806. The heel portion 802 and the body portion 804 are attached to one another (e.g., directly attached) at the overlapping region 806. The overlapping region 806 is an area where the heel portion 802 and the body portion 804 intersect with one another. In an exemplary embodiment, overlapping region 806 is a transition from the heel portion 802 to the body portion 804. In some embodiments, overlapping region 806 has a thickness that is greater than a thickness of the heel portion 802 and the body portion 804.

Figure 7B:
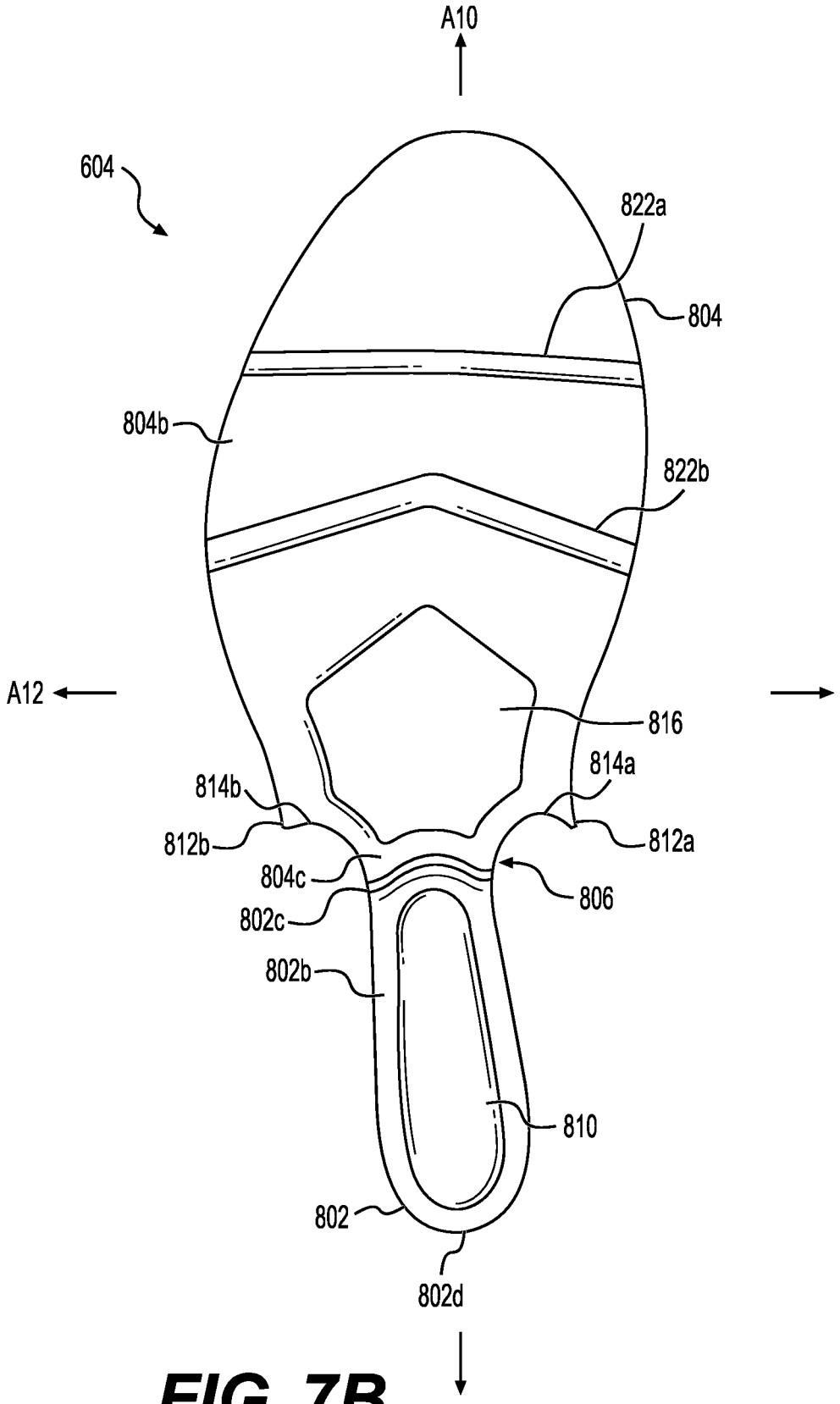
FIG. 7B is a bottom view of the outsole layer of FIG. 7A.

The heel portion 802 extends from the heel region 24 to the mid-foot region 22. The heel portion 802 extends toward the medial side 16 and the lateral side 18, but does not extend all the way to the medial side 16 and the lateral side 18 of the article of footwear 10. The heel portion 802 includes a first (top) surface 802*a*, a second (bottom) surface 802*b* (shown in FIG. 7B), an anterior end 802*c*, and a posterior end 802*d*. The anterior end 802*c* is a portion of the heel portion 802 closest to the overlapping region 806. The posterior end 802*d* is a portion of the heel portion 802 furthest away from the overlapping region 806. The first surface 802*a* includes a recessed portion 808 disposed near the anterior end 802*c*. Recessed portion 808 has a curved shaped. Recessed portion 808 is substantially J-shaped. It is contemplated that recessed portion 808 has any shape suitable for receiving the valve 512 of the second cushioning element 204. As shown in FIG. 7B, the second surface 802*b* includes a cut-out portion (recessed area) 810 disposed therein. Cut-out portion 810 is disposed in the heel region 24. Cut-out portion 810 extends from near the posterior end 802*d* to near the anterior end 802*c*. Cut-out portion 810 substantially spans a width of the heel portion 802.

The body portion 804 extends from the mid-foot region 22 to the anterior end 12. The body portion 804 extends from the medial side 16 to the lateral side 18 of the article of footwear 10. The body portion includes a first (top) surface 804*a* and a second (bottom) surface 804*b* (shown in FIG. 7B) opposite the first surface 804*a*. The body portion 804 includes a posterior end 804*c*. Posterior end 804*c* is an end of the body portion 804 disposed nearest the overlapping region 806. A medial side of the body portion 804 and a lateral side of the body portion 804 each includes one or more points 812. The one or more points 812 include medial point 812*a* and lateral point 812*b*. Between the point 812*a* and the posterior end 804*c* is a respective curved segment 814*a*. Between the point 812*b* and the posterior end 804*c* is a respective curved segment 814*b*. Curved segments 814 interconnect the anterior end 804*c* and the points 812.

The body portion 804 further includes a cavity 816. Cavity 816 is disposed near the posterior end 804*c*. Cavity 816 is disposed in the mid-foot region 22. A portion of cavity 816 extends into either of the forefoot region 20 or the heel region 24. Cavity 816 includes an irregular shape. Raised portions (flex points) 818 include a first raised portion 818A and a second raised portion 818B. Raised portions 818 have a shape that is linear, chevron-shaped, or the like. Alternatively, each of the raised portions 818 may have a shape that is similar to the other raised portion 818. Raised portions 818 are located nearer the anterior end 12 than the cavity 816. In other words, raised portion 818 is positioned more forward than the cavity 816 is positioned. The raised portions 818 are flexure points of the article of footwear 10.

Figure 8:
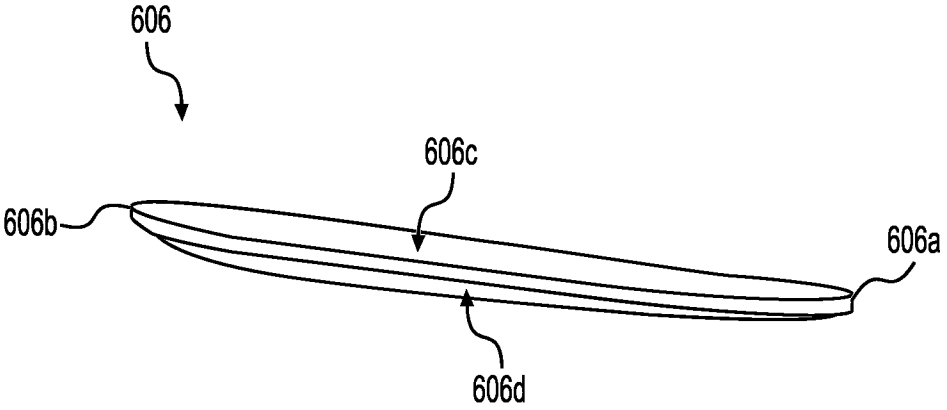
FIG. 8 is a side view of a heel pad of the article of footwear of FIG. 1.

Referring to FIG. 8, the heel pad 606 extends from a first end 606*a* to a second end 606*b*. The heel pad 606 includes a first (upper) surface 606*c* and a second (bottom) surfaced 606*d*. The heel pad 606 includes an oblong shape. The heel pad 606 may be ovular, triangular, circular, or any shape suitable to fit within cut-out portion 810. The heel pad 606 includes a rubber material. The heel pad 606 may alternatively be an elastomeric material suitable for engaging a ground surface.

Figure 9:
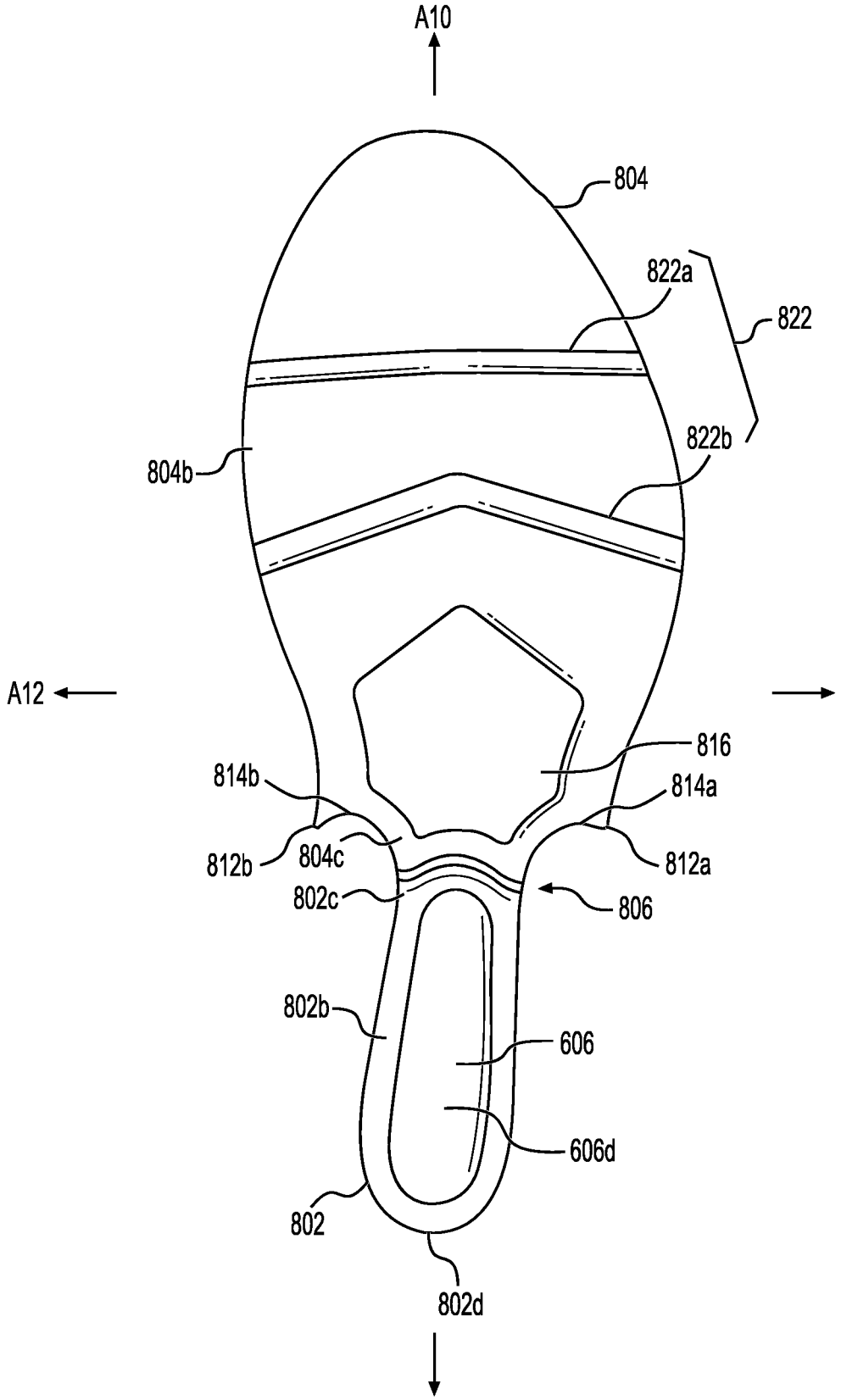
FIG. 9 is a bottom view of an assembled combination of the outsole layer and the heel pad of the article of footwear of FIG. 1.

Referring to FIG. 9, the first surface 606*c* (not shown in FIG. 9) of the heel pad 606 abuts the cut-out portion 810. In an exemplary embodiment, when the first surface 606*c* is engaged with the cut-out portion 810, the second surface 606*d* of the heel pad 606 rests in a horizontal plane that is different than a horizontal plane of the second surface 802*b* of the heel portion 802. In alternative embodiments, the second surface 606*d* rests flush with the second surface 802*b*.

As shown in FIG. 10, the outsole 206 is formed compositely. The heel cup 602, the outsole layer 604, and the heel pad 606 each form a portion of the ground-engaging surface of the outsole 206. Each of the heel cup 602 and the outsole layer 604 include a rubber material. The heel pad 606 includes an elastomeric or foam material. It is contemplated that in alternative embodiments, the outsole 206 may be formed as a single piece.

Referring to FIG. 10, the heel cup 602 and the outsole layer 604 are attached (e.g. directly attached) to one another. The distal ends 610*a* and 610*b* of the heel cup 602 cooperate with the curved segments 814 and the points 812 of the outsole layer 604. The heel pad 606 is disposed within the cut-out portion 810. The combination of the heel cup 602, the outsole layer 604, the heel pad 606, and the extend portion 242 forms the ground-engaging surface.

Figure 11A:
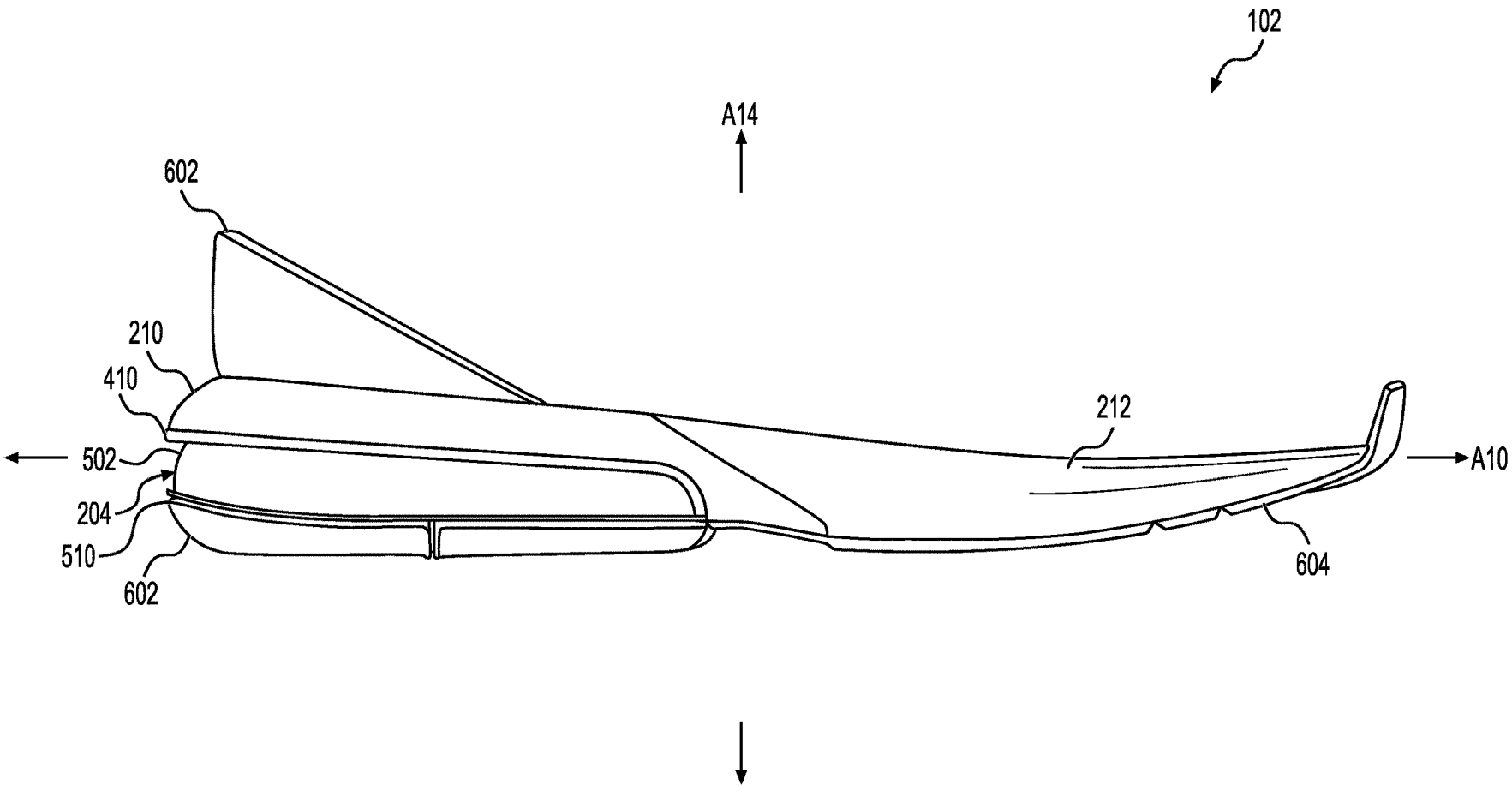
FIG. 11A is a side view of the sole structure of the article of footwear of FIG. 1.

Referring to FIG. 11A, the second cushioning element 204 is configured to cooperate with the first surface 602A of the heel cup 602. Specifically, the lower barrier film 504 is received by the first surface 602A of the heel cup 602. The second cushioning element 204 is further configured to cooperate with base 410. Specifically, the upper barrier film 502 is received by the bottom surface 418 of the base 410. Each of the mold segments 432 engages the upper barrier film 502. Protrusions 426 engage with the seam 510 and the distal ends 516A and 516B of the second cushioning element 204 so that base 410 and the second cushioning element 204 rest flush with one another. This engagement provides cushioning and responsiveness as well as added sensation. The heel portion 802 of outsole layer 604 is disposed within the opening 614 of the heel cup 602 and contacts the web area 508. The second cushioning element 204 is continuously exposed to the external environment.

Figure 11B:
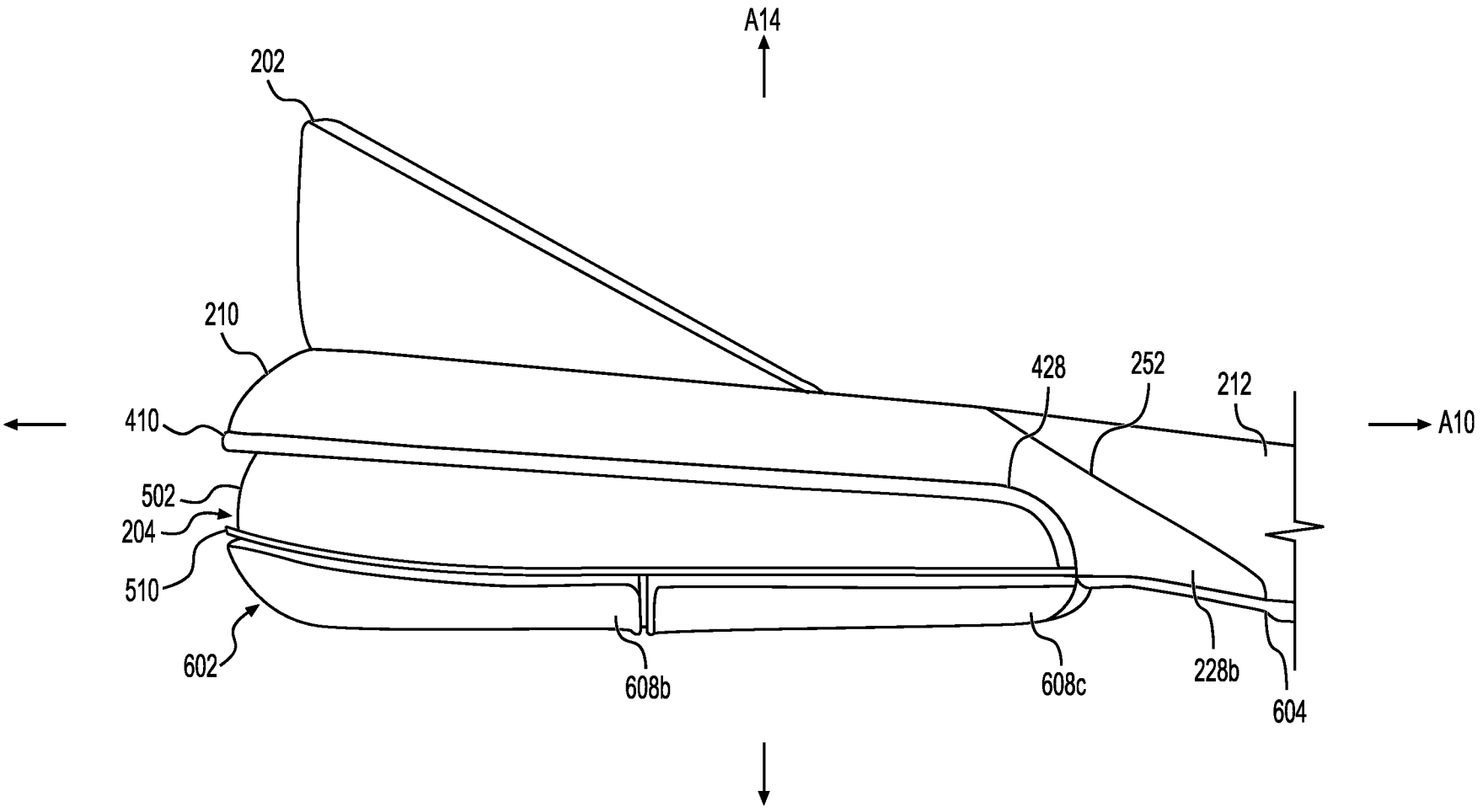
FIG. 11B is an enlargement of a portion of the sole structure of FIG. 13.

As shown in FIG. 11B, the midsole 200 is attached (e.g., directly attached) to the outsole layer 604. The extended portion 242 of the first cushioning element 212 extends through the cavity 816. The extended portion 242 forms a portion of the ground-engaging surface. The extended portion 242 rests flush with the second surface 804B of the body portion 804.

Figure 12:
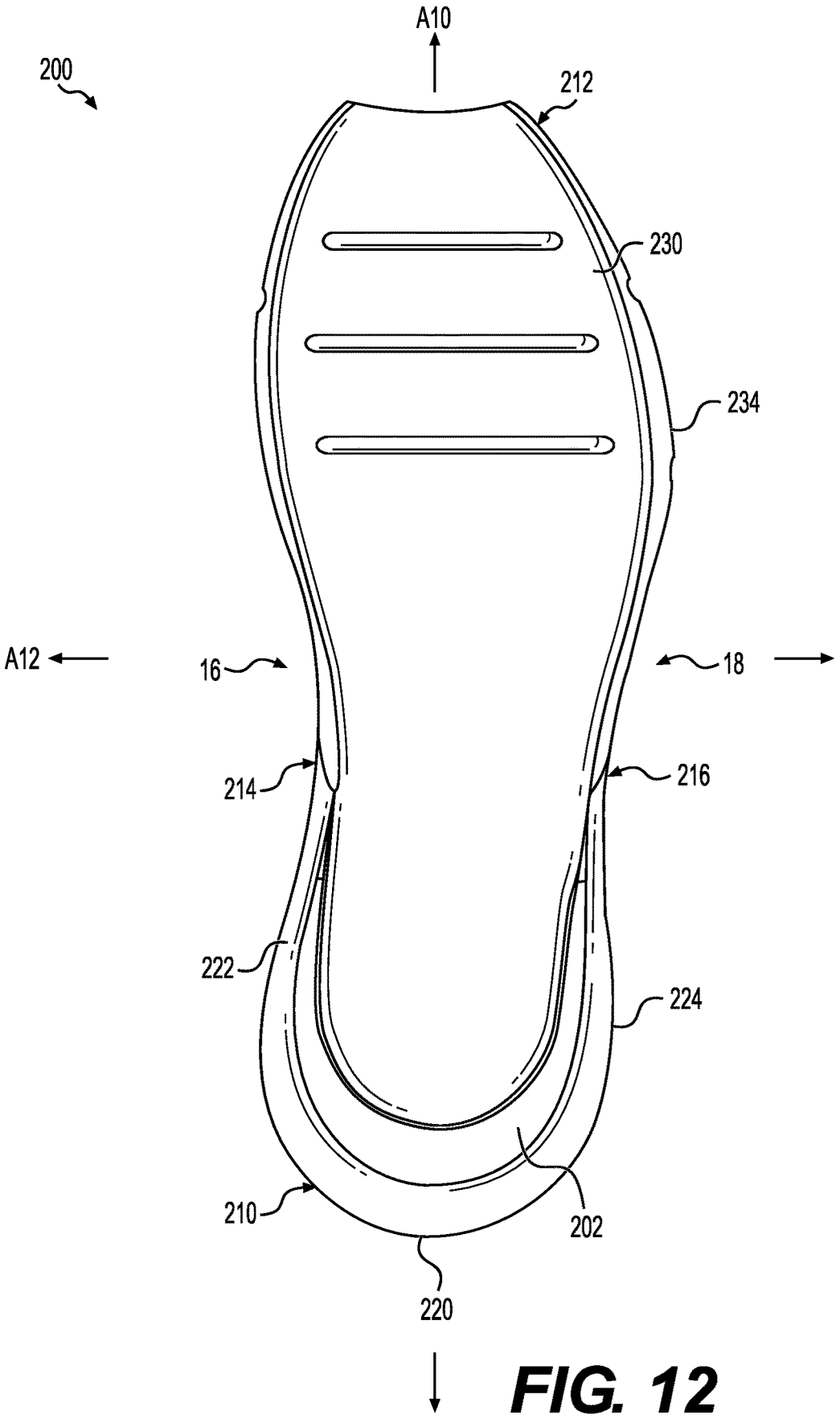
FIG. 12 is a top view of the midsole of FIG. 3A.

Referring to FIG. 12, the heel clip 202 is configured to cooperate with the heel wrap 210, and the heel clip 202 is configured to cooperate with the first cushioning element 212 of the midsole 200. Specifically, the base 410 of the heel clip 202 is disposed within the gap between the medial and lateral sides 222 and 224 of the heel wrap 210. The heel clip 202, the heel wrap 210, and the first cushioning element 212 are attached (e.g., directly attached) to one another. For example, the heel clip 202 is attached to the heel wrap 210. The heel wrap 210 is directly attached to the first cushioning element 212 and the heel clip 202. The heel wrap 210 and the heel clip 202 extend around the terminal end 236 of the first cushioning element 212. The heel wrap 210 being coupled to the first cushioning element 212 ensures that the article of footwear 10 has a substantially continuous and flush outer side surface extending from the midsole 200 through the heel wrap 210. As shown in FIG. 1, the height of the heel clip 202 is greater than the height of the midsole 200, such that the heel clip 202 extends above the midsole 200 and attaches to the upper 100 of the article of footwear 10.

Figure 13:
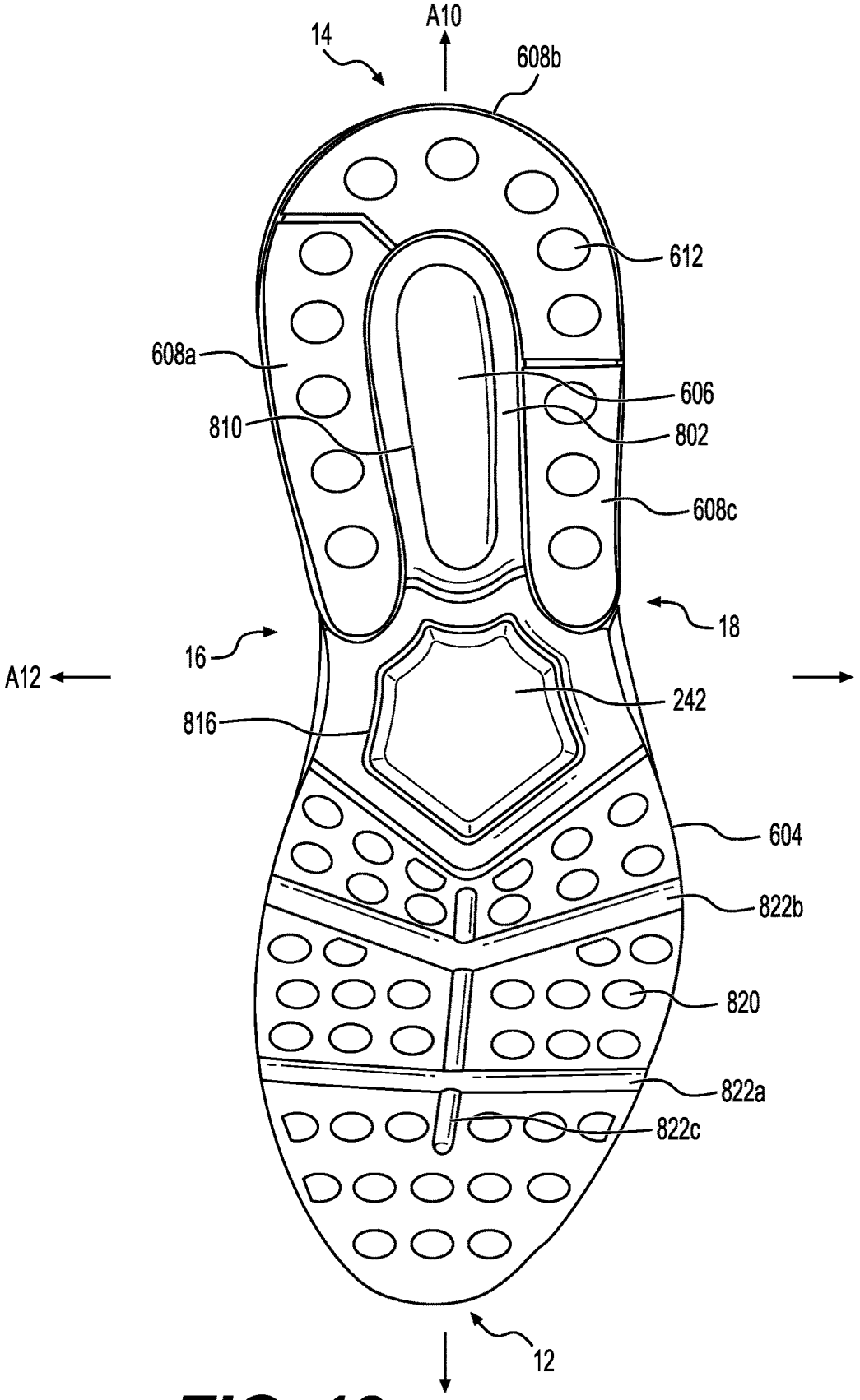
FIG. 13 is a bottom view of the article of footwear of FIG. 1.

Referring to FIG. 13, the second surface 804*b* includes a plurality of traction elements 820 configured to engage with a ground surface to provide responsiveness and stability to the sole structure 102 during use. The second surface 804*b* further includes one or more troughs 822 (e.g., troughs 822*a*, 822*b*, and 822*c*). The one or more troughs 822 are a recessed portion of the second surface 804*b*. The troughs 822*a* and 822*b* separate the plurality of traction elements 820 into distinct sections. The troughs 822*a* and 822*b* correspond in shape and location to the raised portions 818. Trough 822*c* extends longitudinally and through troughs 822*a* and 822*b*.

Figure 14:
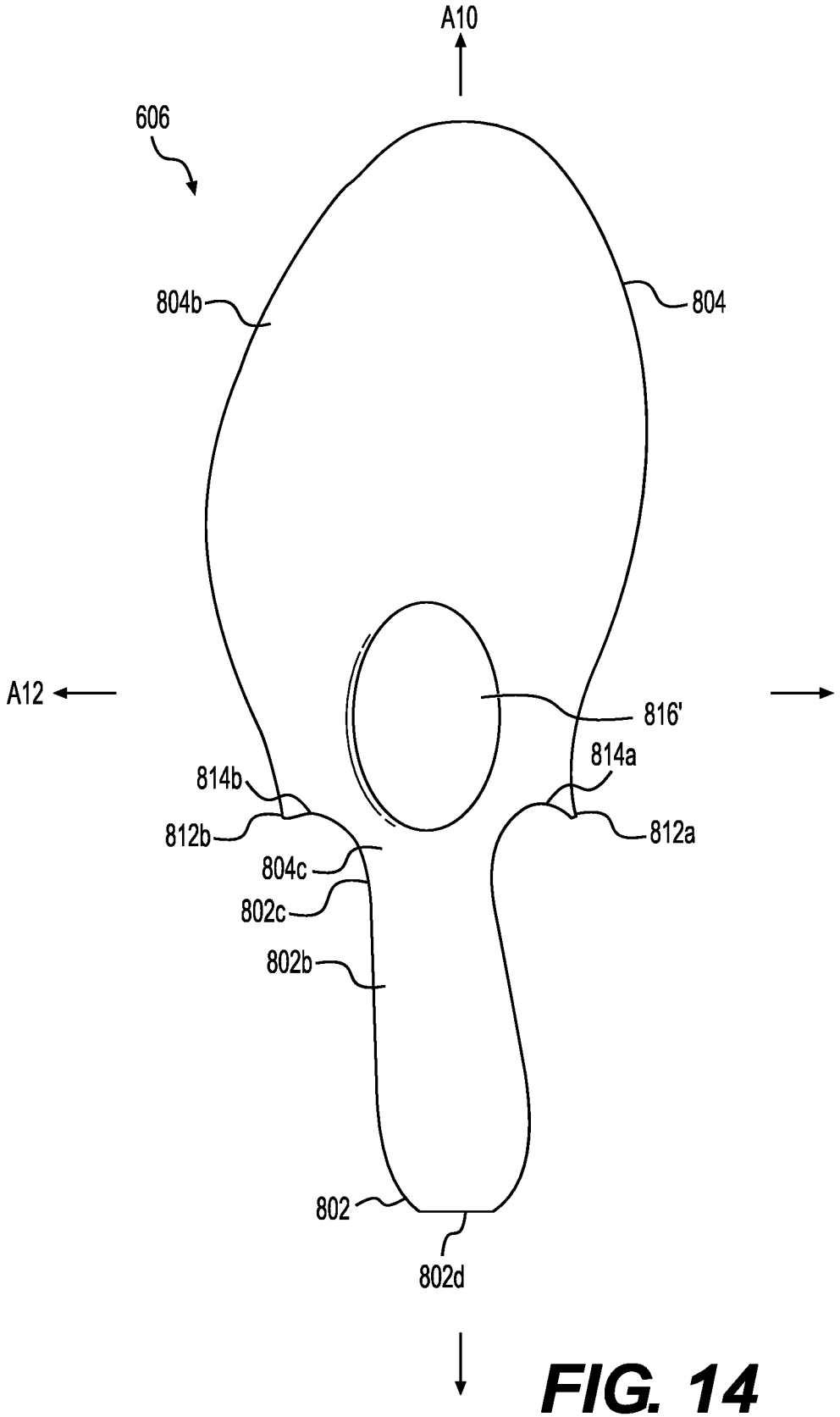
FIG. 14 is a bottom view of an alternative embodiment of the outsole layer of FIG. 7B.
Figure 15:
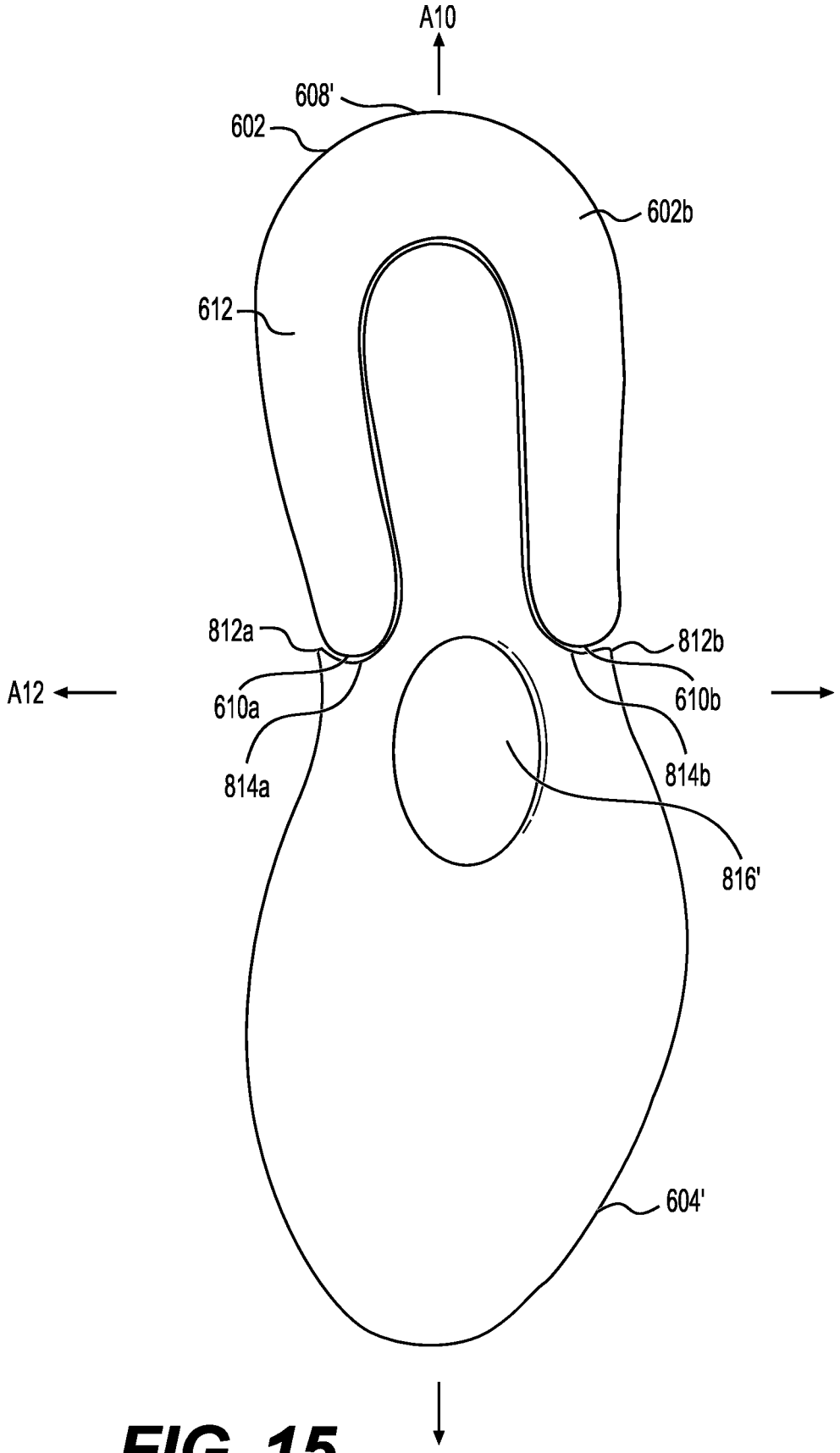
FIG. 15 is a bottom view of an alternative embodiment of an outsole of the article of footwear of FIG. 1.
Figure 16:
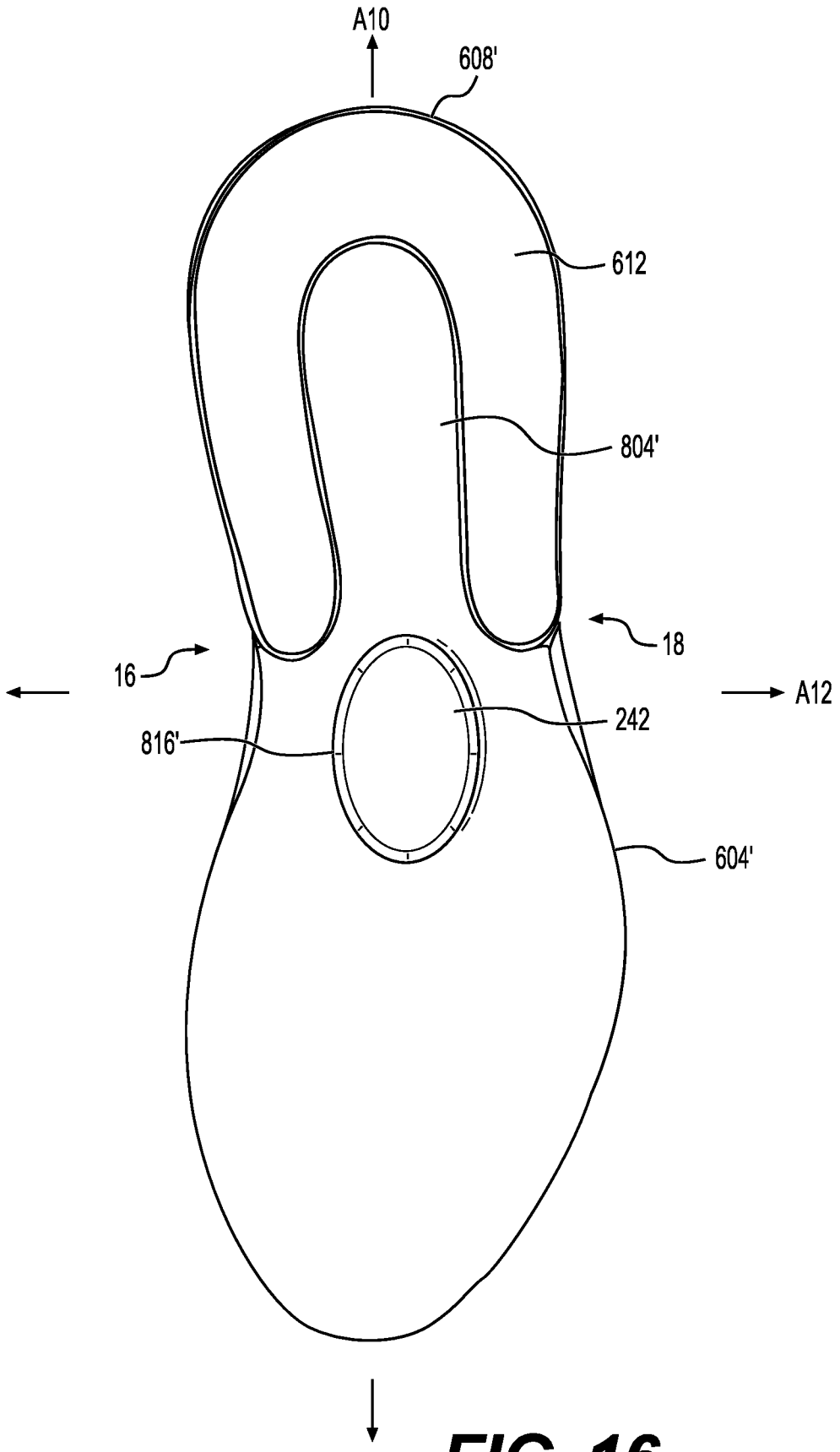
FIG. 16 is a bottom view of an alternative embodiment of an outsole of the article of footwear of FIG. 1.

FIGS. 14-16 depict alternative embodiments with a substantially smooth second surface 804*b* and an ovular cavity 816. In alternative embodiments, second surface 804*b* is a substantially smooth surface. In other words, second surface 804*b* is free of the plurality of traction elements 820 as well as free of the troughs 822. The heel cup 602 includes a single continuous segment 608' extending from the first distal end 610*a* to the second distal end 610*b*. The outsole layer 604' includes a single continuous portion 804'. It is contemplated that cavity 816' may be circular, ovular, triangular, or any shape suitable for receiving extended portion 242 of the first cushioning element 212.

Figure 17:
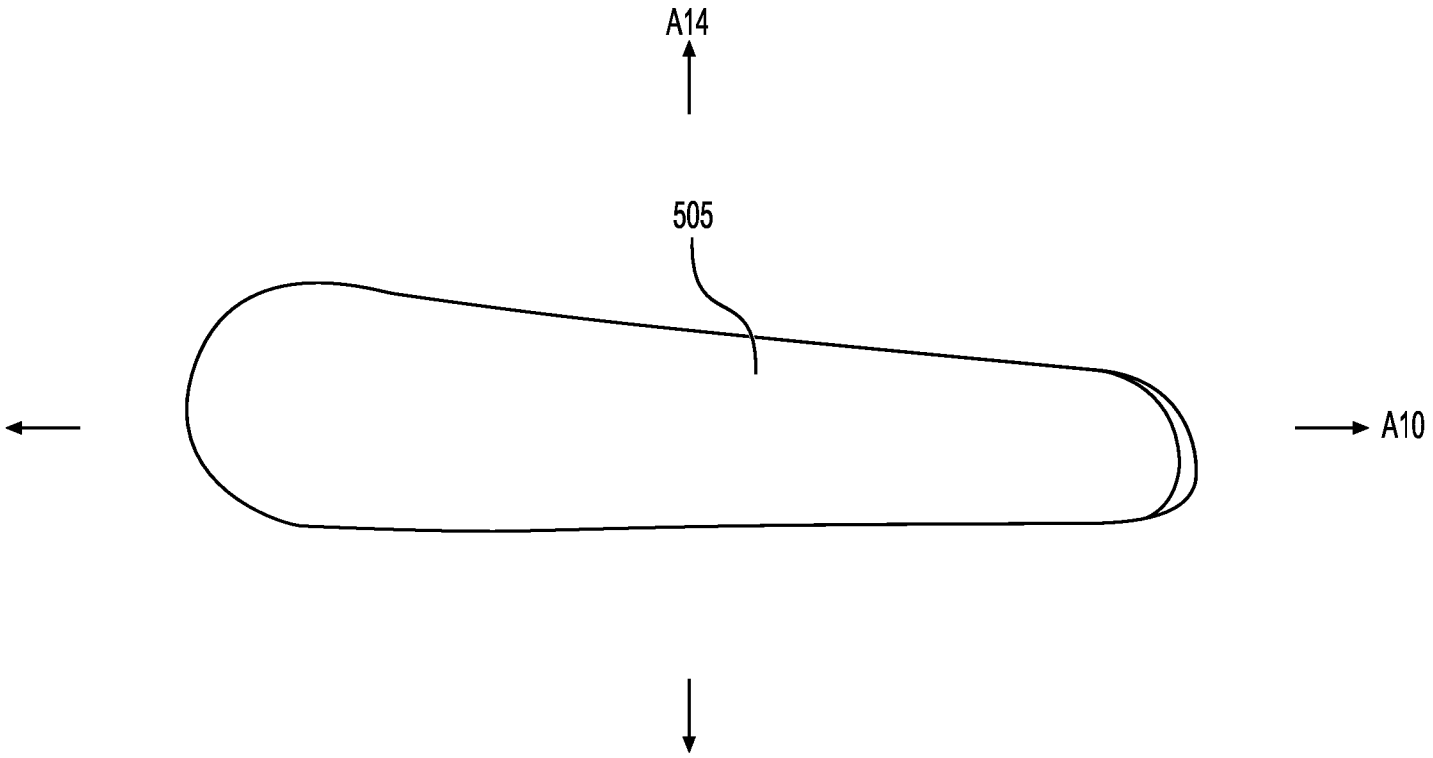
FIG. 17 is a side view of an alternative embodiment of the second cushioning element of FIG. 5A.

Although the seam 510 is illustrated as forming a relatively pronounced flange protruding outwardly from the second cushioning element 204, in an alternative embodiment shown in FIG. 17, the upper barrier film 502 and the lower barrier film 504 are flush with one another so that no seam is present and the upper barrier film 502 and the lower barrier film 504 form a continuous barrier film 505. Moreover, the upper barrier film 502 and the lower barrier film 504 may be joined together between the lateral side 18 of the sole structure 102 and the medial side 16 of the sole structure 102 to define the substantially continuous web area 508.

Figure 18:
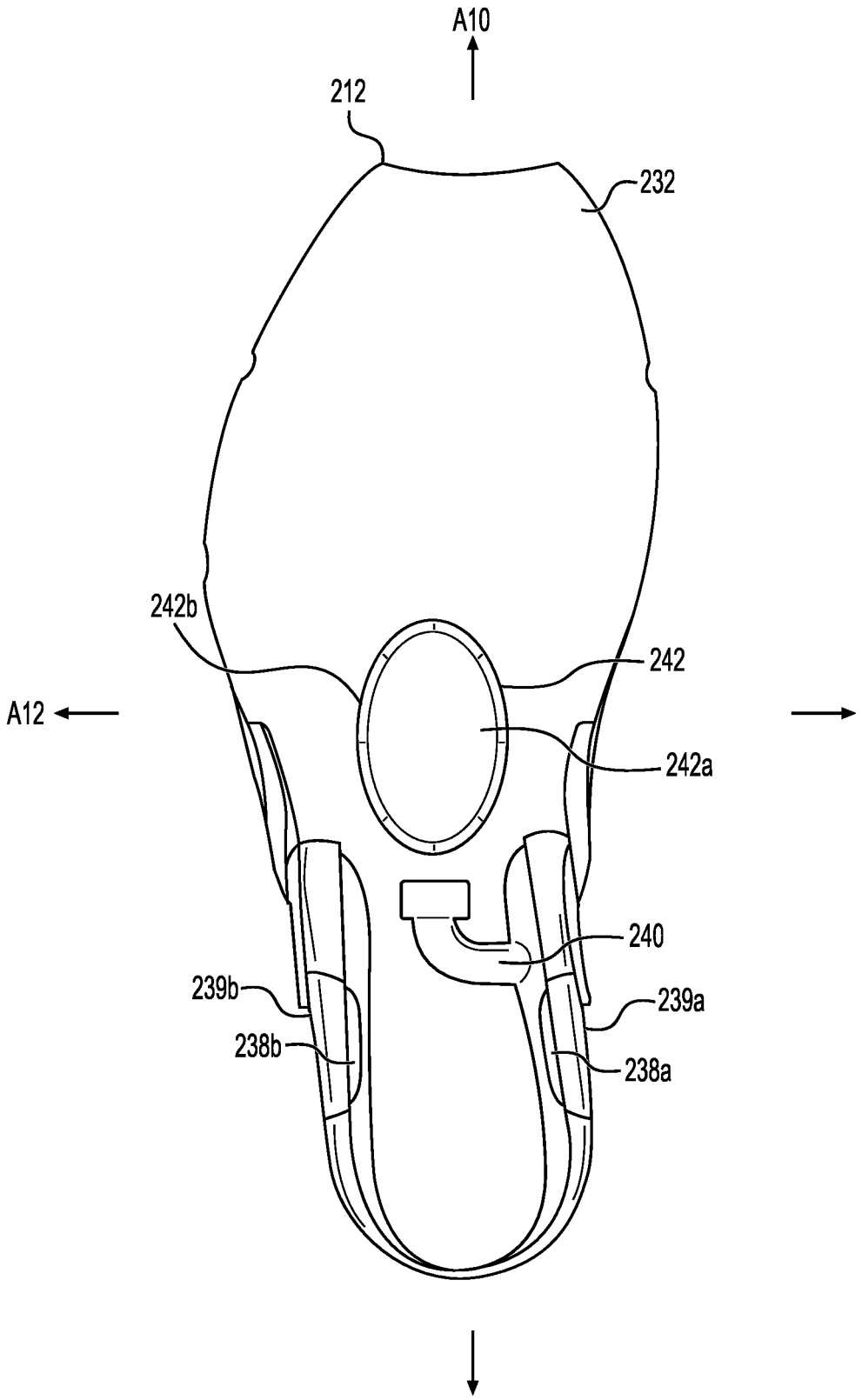
FIG. 18 is a bottom view of an alternative embodiment of the first cushioning element of FIG. 3C.

The extended portion 242 could be ovular or any other shape. In an alternative embodiment shown in FIG. 18, the interior base 242*a* and the peripheral edge 242*b* is ovular. In alternative embodiments, extended portion 242 is replaced with a fluid-filled bladder.

Figure 19:
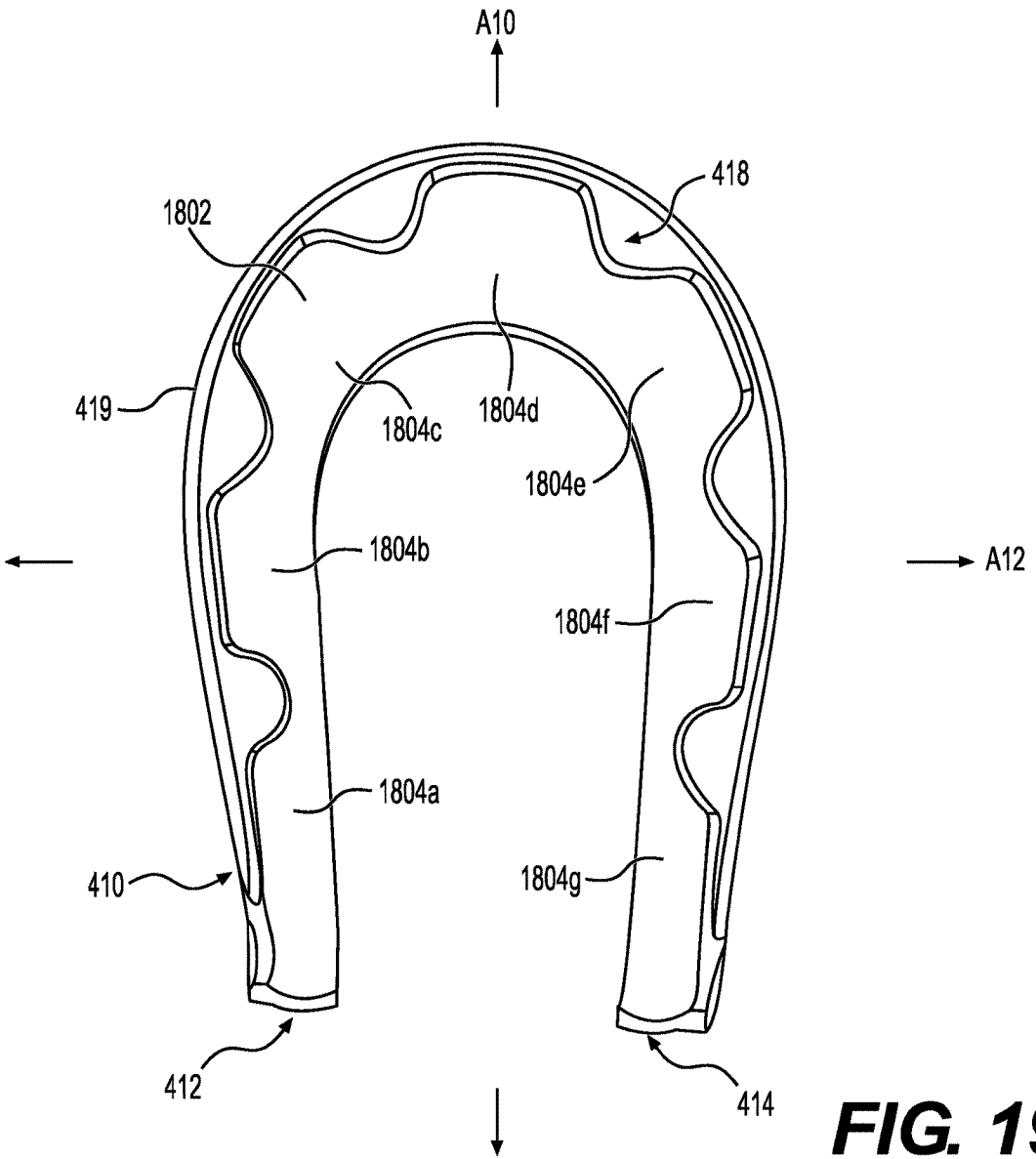
FIG. 19 is a bottom view of an alternative embodiment of the heel clip of FIG. 4C.

FIG. 19 shows an alternative embodiment of the heel clip 202. In particular, the second surface 418 could include a unitary protruding portion 1802, which is a raised portion that extends away from the second surface 418 towards a ground surface, and provides a desired sensation of feel to the article of footwear 10. The second surface 418 of this embodiment is similar to that described above with respect to FIG. 4C. The unitary protruding portion 1802 includes protruding segments 1804*a*, 1804*b*, 1804*c*, 1804*d*, 1804*e*, 1804*f*, and 1804*g*. Each segment is partially separated from an immediately adjacent segment by a recess. However, as seen in FIG. 19, adjacent segments are also connected to one another by material of unitary protruding portion 1802.

Segments 1804*a*, 1804*b*, and 1804*c* are disposed opposite of segments 1804*e*, 1804*f*, and 1804*g*, respectively, across the longitudinal axis A10. Segment 1804*d* is intersected by longitudinal axis A10 such that a portion of segment 1804*d* is disposed on the medial side of the article and a portion of segment 1804*d* is disposed on the lateral side of the article.

The number of segments 1804*a*, 1804*b*, 1804*c*, 1804*d*, 1804*e*, 1804*f*, and 1804*g* can be increased or decreased to provide a desired perception of feel to the article of footwear 10. In some embodiments, the segments provide additional loading points for the heel clip 202 relative to the cushioning element 204.

Figure 20:
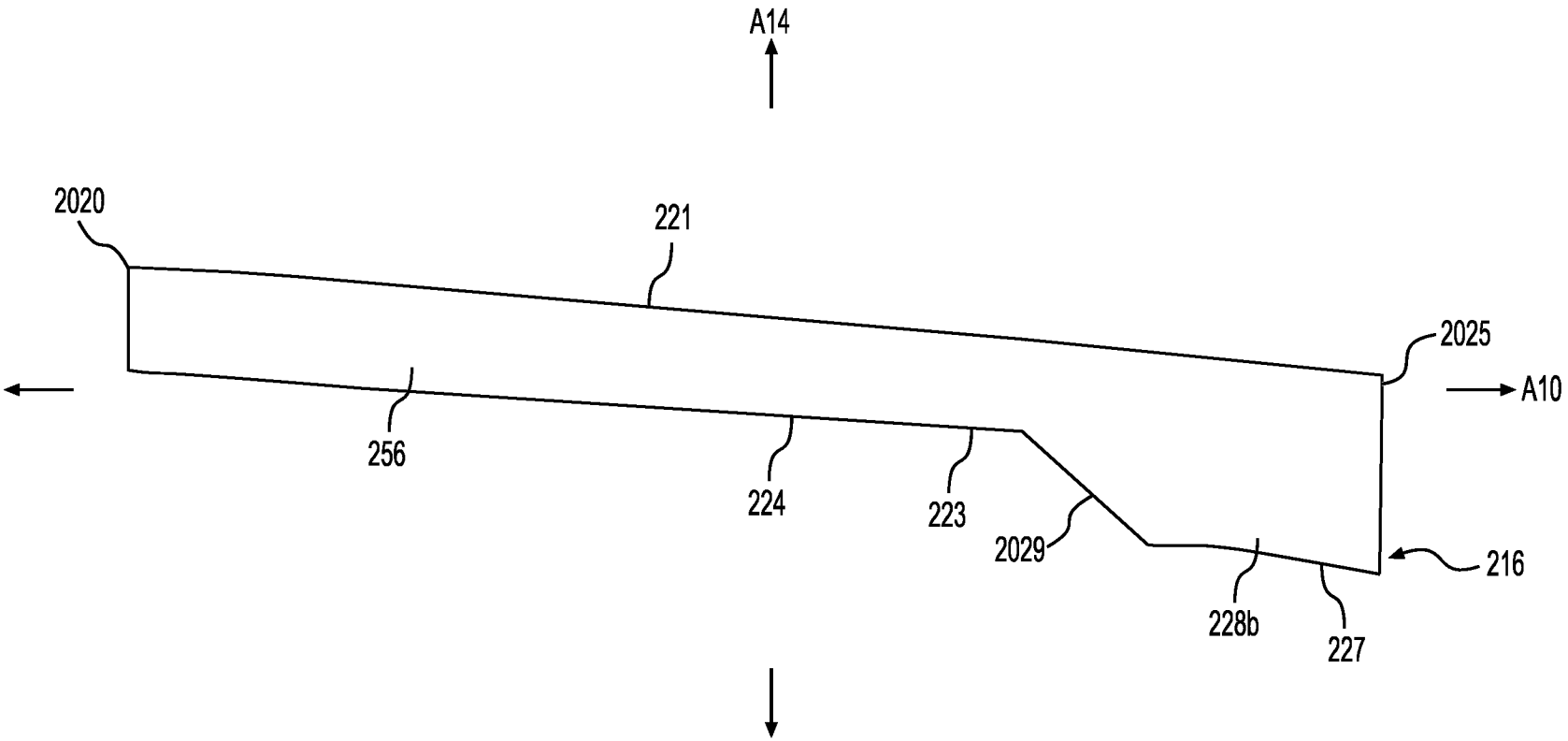
FIG. 20 is a side view of an alternative embodiment of the heel wrap of FIG. 3D.

FIG. 20 shows an alternative embodiment of the heel wrap 210. As shown in FIG. 20, heel wrap 2010 includes a back section 2020, a flat edge 2025, and a straight edge 2029. The protruding section 228*b* has a substantially trapezoidal shape.

Figure 21:
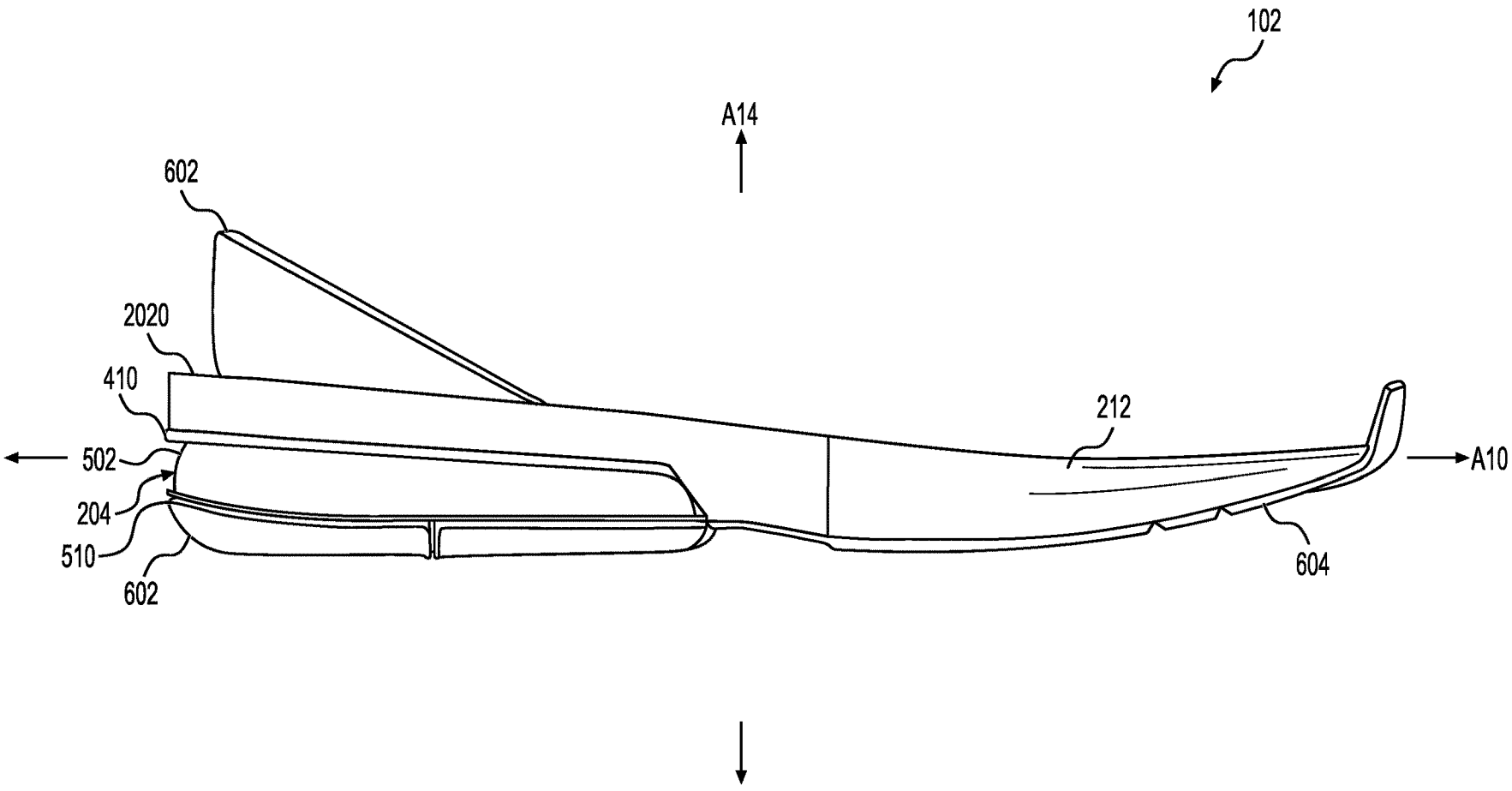
FIG. 21 is a side view of an alternative embodiment of the sole structure of FIG. 11A.

FIG. 21 shows an alternative embodiment of the sole structure 102 including the heel wrap 2010. The heel wrap 2010 forms substantially sharp edges when connected to the sole structure 102.

Figure 22:
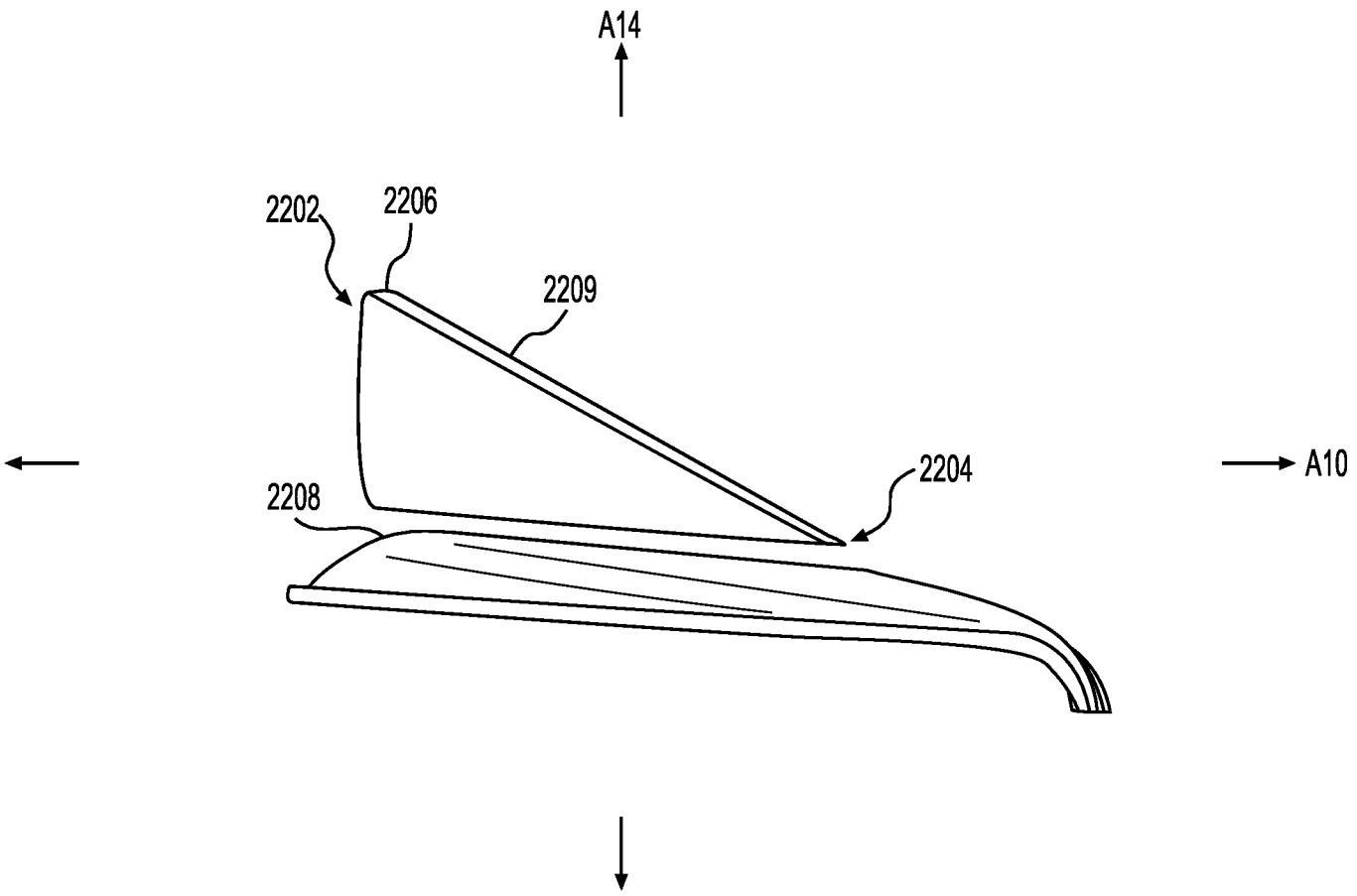
FIG. 22 is a side view of an alternative embodiment of the heel clip of FIG. 4A.

FIG. 22 shows an alternative embodiment of the heel clip 202 with a separate support 2202 and a separate base 2204. Support 2202 and base 2204 are of a non-unitary construction. Support 2202 is substantially similar to support 409. Base 2204 includes a substantially flat top 2208.

Figure 23:
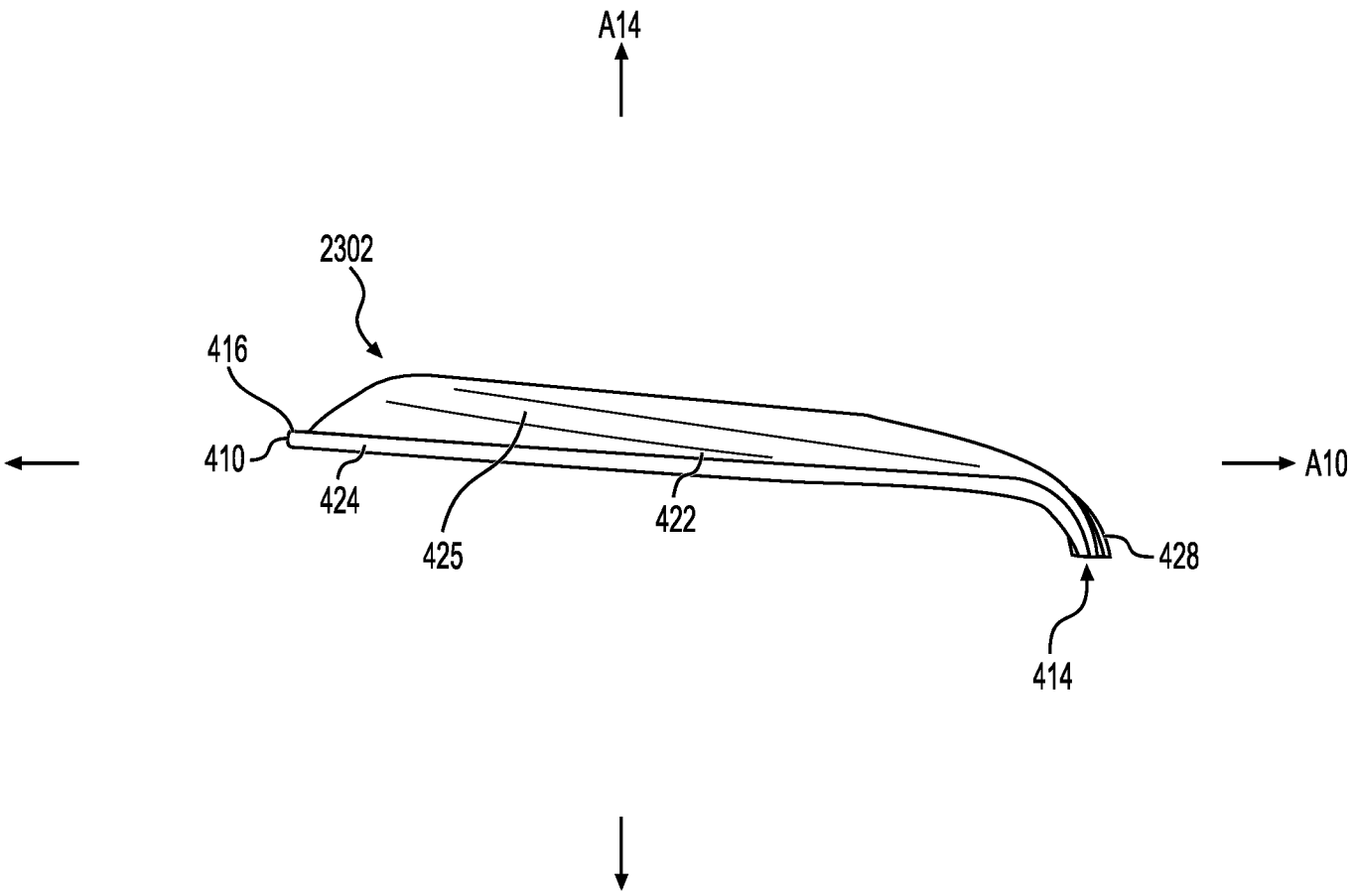
FIG. 23 is a side view of an alternative embodiment of the heel clip of FIG. 4A.

FIG. 23 shows an alternative embodiment of the heel clip 202. Heel clip 2302 only includes base 410.

Figure 24:
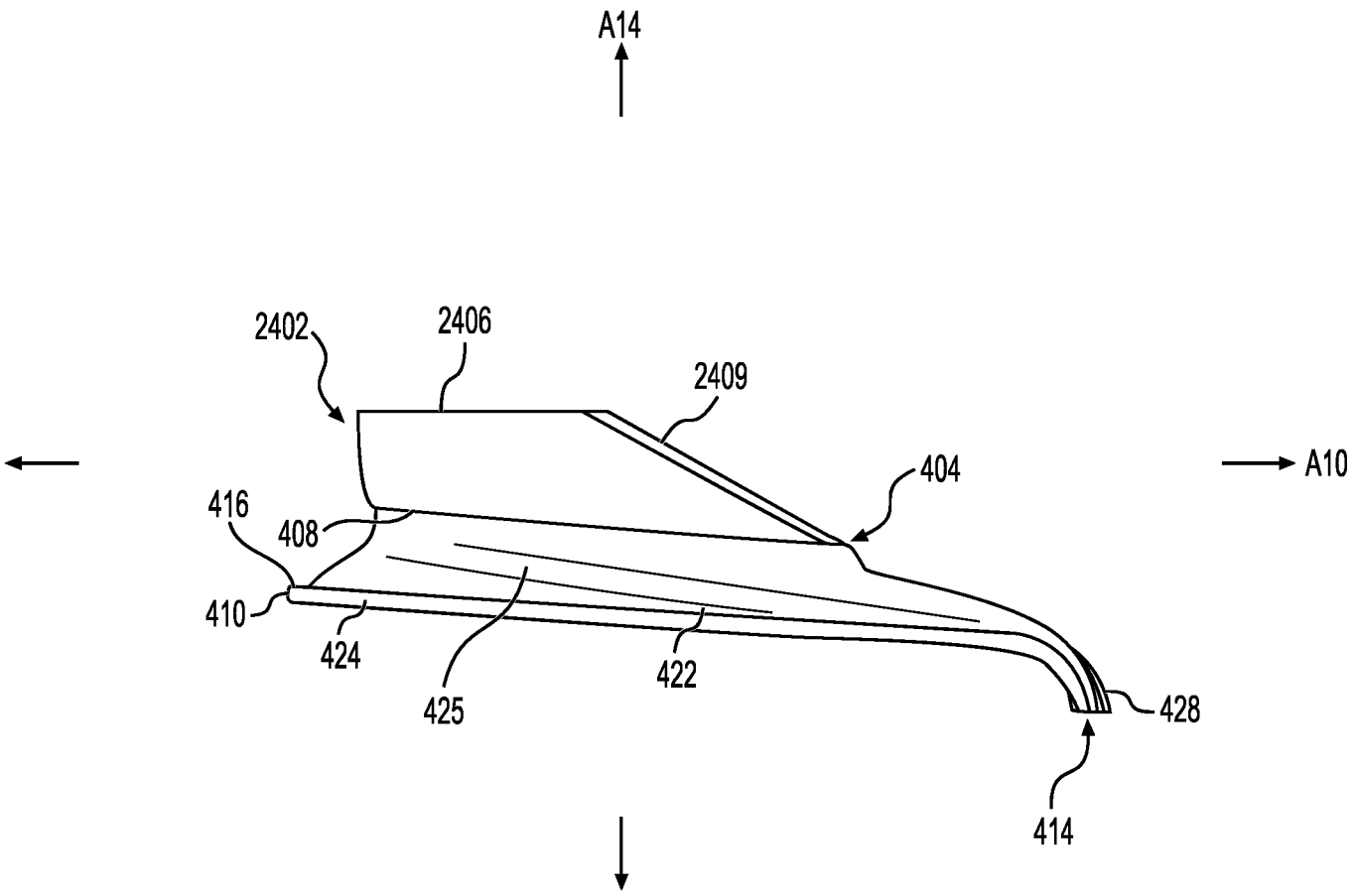
FIG. 24 is a side view of an alternative embodiment of the heel clip of FIG. 4A.

FIG. 24 shows an alternative embodiment of the heel clip 202 including a support 2402. Support 2402 includes a top surface 2406 and a front edge 2409. Support 2402 is substantially similar to the support 409 previously described above as part of the heel clip 202 except that instead of the vertex 406, the support 2402 has top surface 2406 that is flat or substantially flat.

Figure 25:
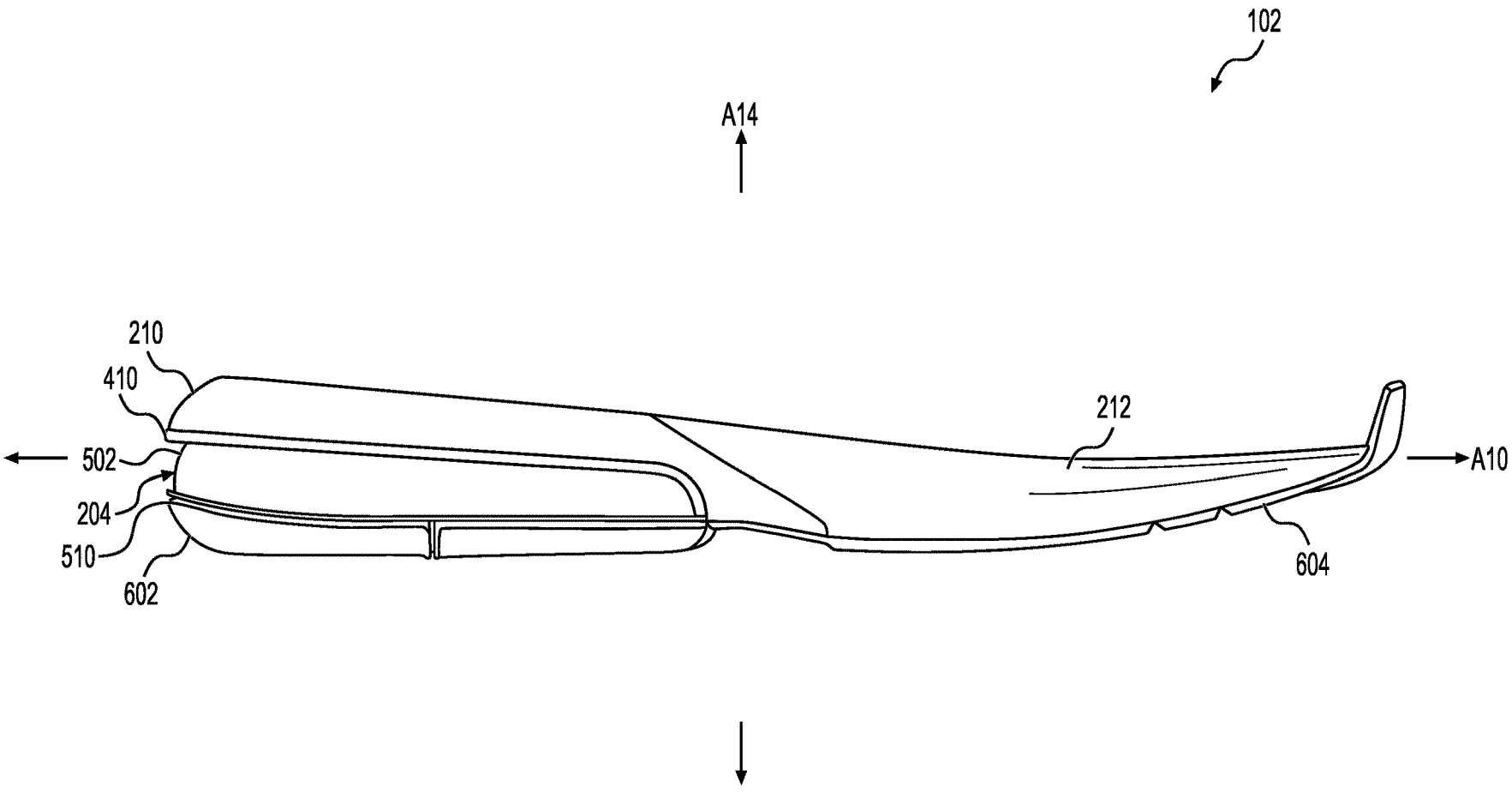
FIG. 25 is a side of an alternative embodiment of the sole structure of FIG. 11A.

FIG. 25 shows an alternative embodiment of the sole structure 102 including the heel clip 2302.

Figure 26:
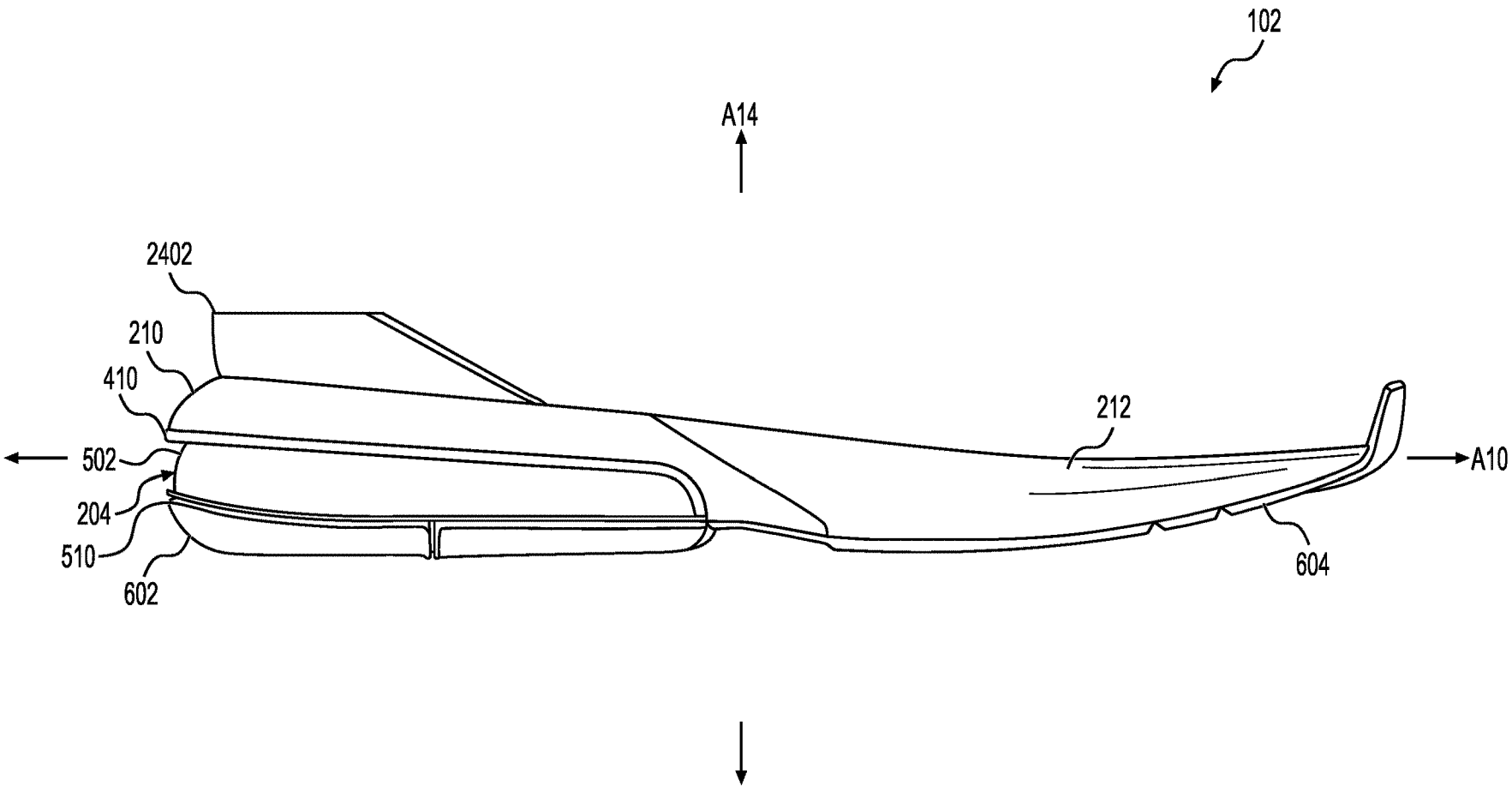
FIG. 26 is a side of an alternative embodiment of the sole structure of FIG. 11A.

FIG. 26 shows an alternative embodiment of the sole structure 102 including the heel clip 2402.

Figure 27:
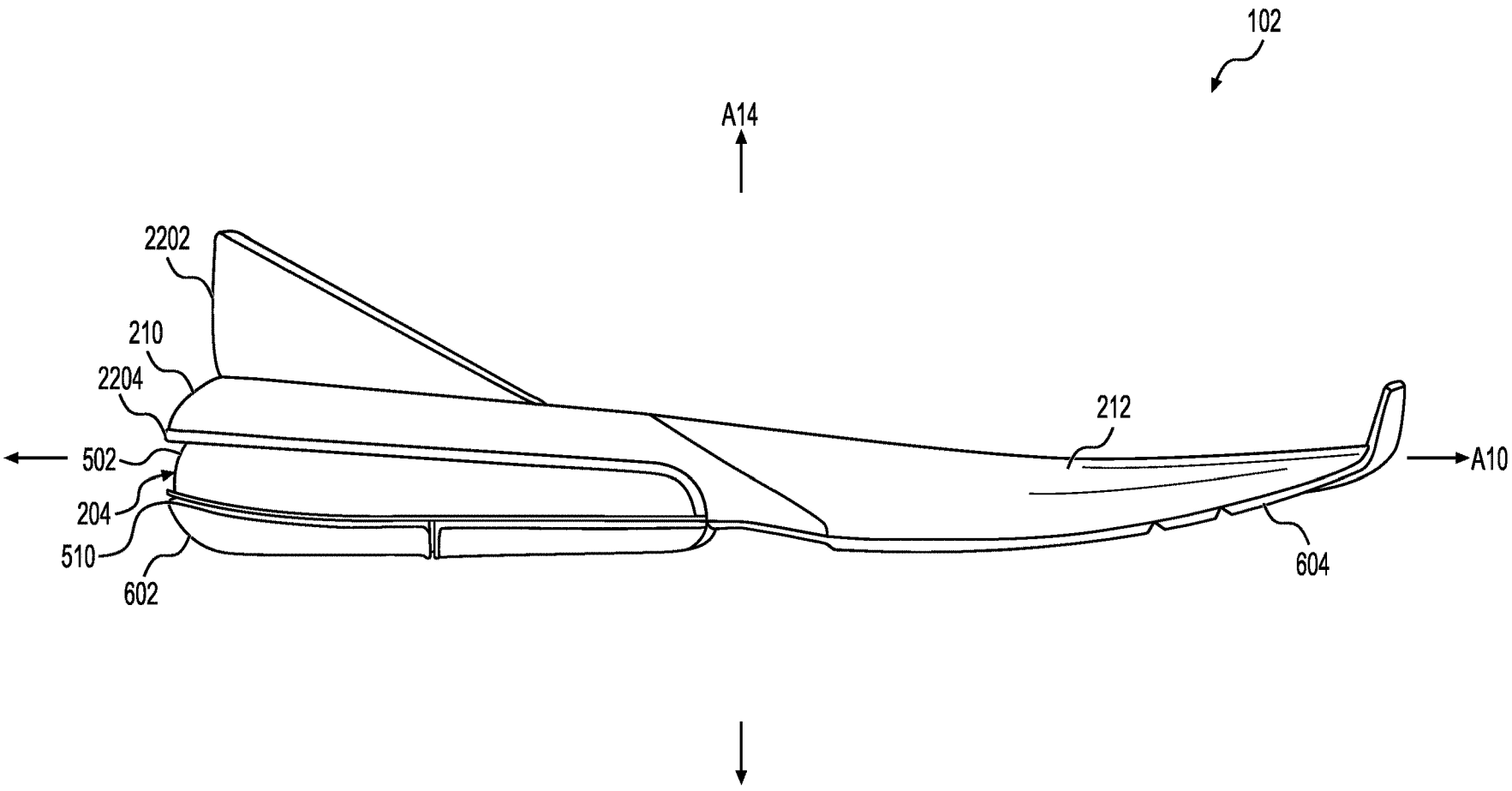
FIG. 27 is a side of an alternative embodiment of the sole structure of FIG. 11A

FIG. 27 shows an alternative embodiment of the sole structure 102 including the heel clip 2202.

Figure 28:
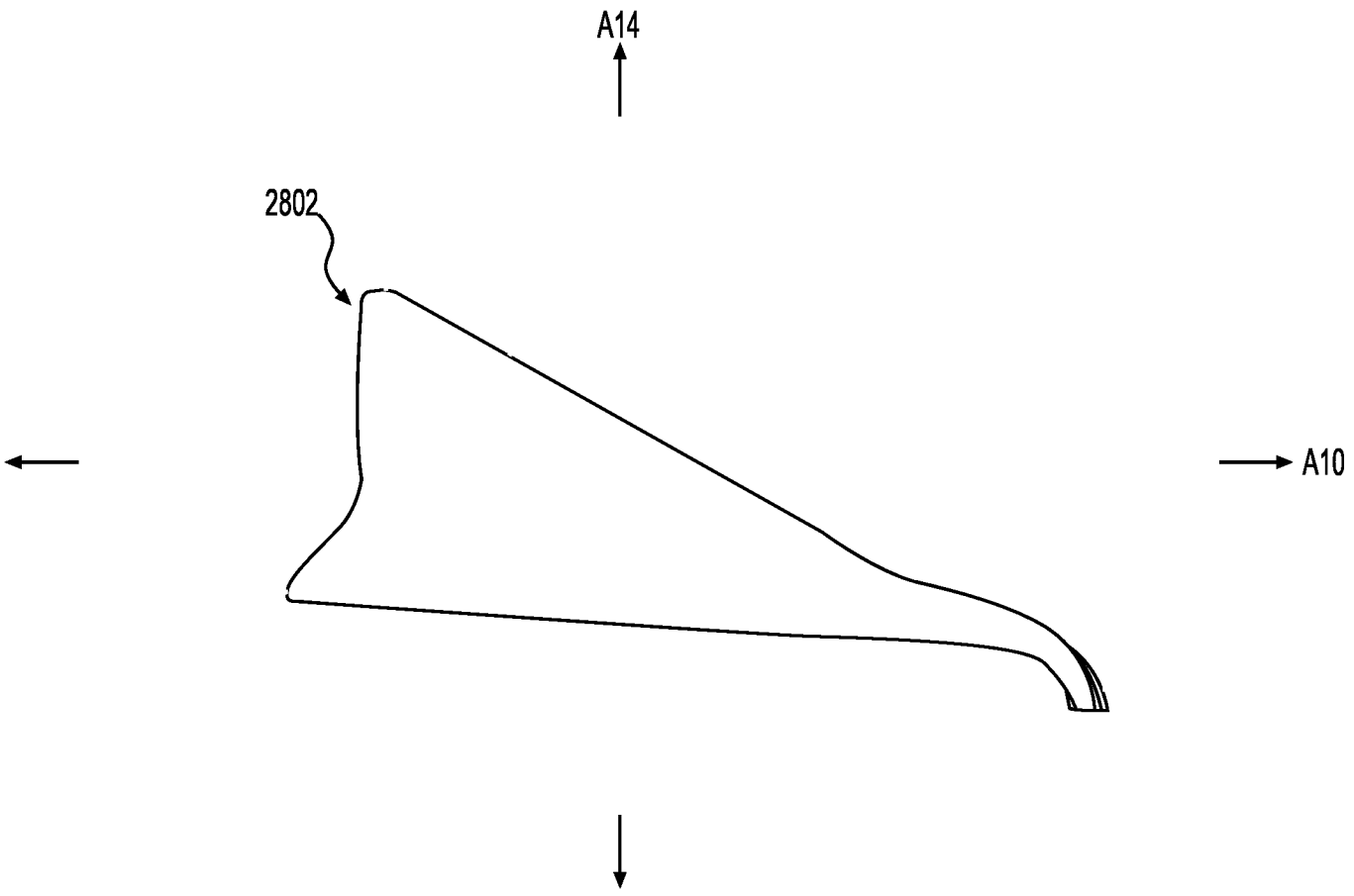
FIG. 28 is a side view of an alternative embodiment of the heel clip of FIG. 4A.

FIG. 28 shows an alternative embodiment of the heel clip 202, heel clip 2802. The heel clip 2802 does not include a receiving area 425 and has a substantially smooth outer surface.

Figure 29:
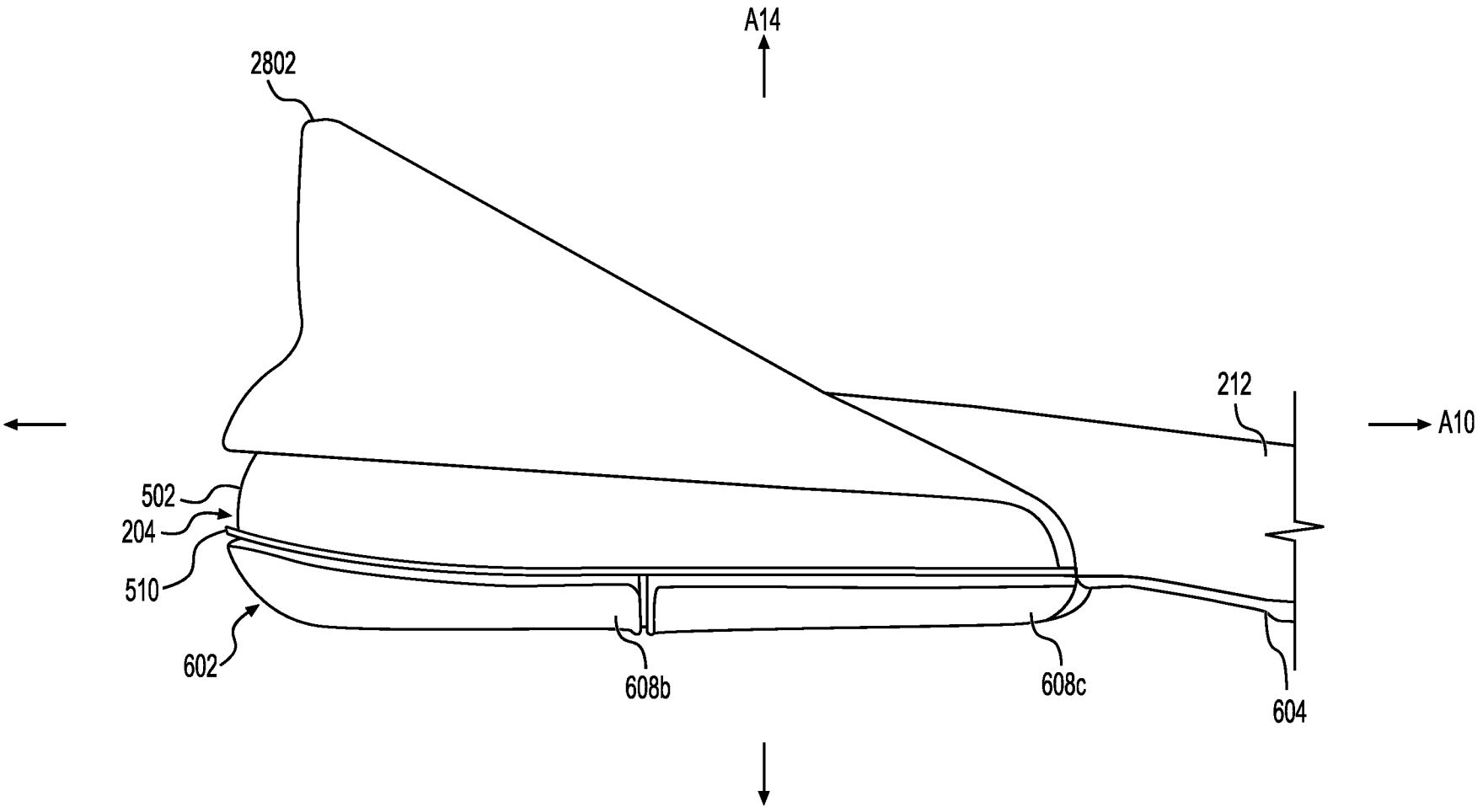
FIG. 29 is a side of an alternative embodiment of the sole structure of FIG. 11A.

FIG. 29 shows an alternative embodiment of the sole structure 102 including the heel clip 2802.

Figure 30:
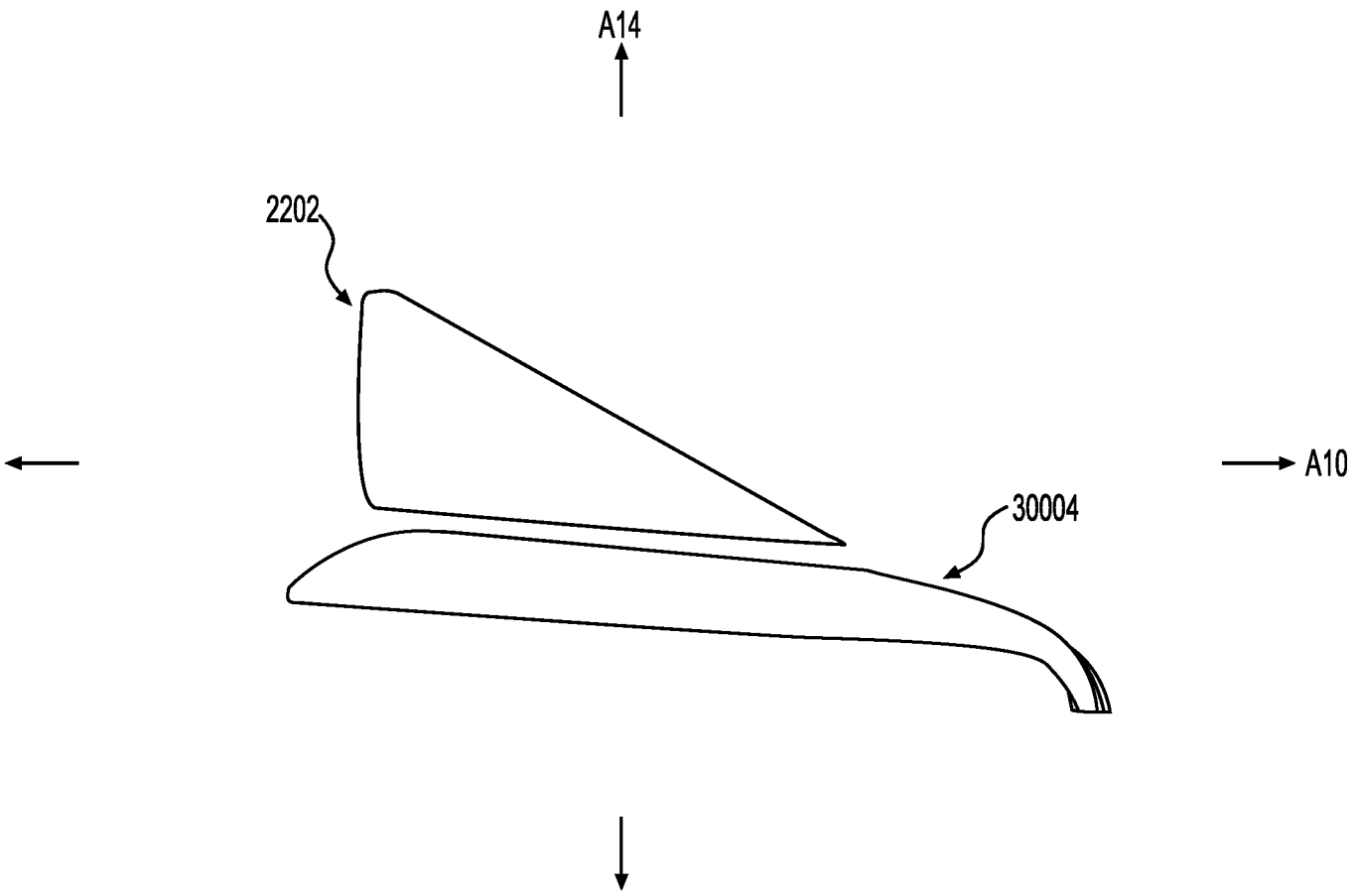
FIG. 30 is a side view of an alternative embodiment of the heel clip of FIG. 4A.

FIG. 30 shows an alternative embodiment of the heel clip 202 with the separate support 2202 and a separate base 3004. Support 2202 and base 3004 are of a non-unitary construction. Support 2202 is substantially similar to support 409. When coupled, support 2202 and base 3004 form an outer surface that is smooth.

Figure 31:
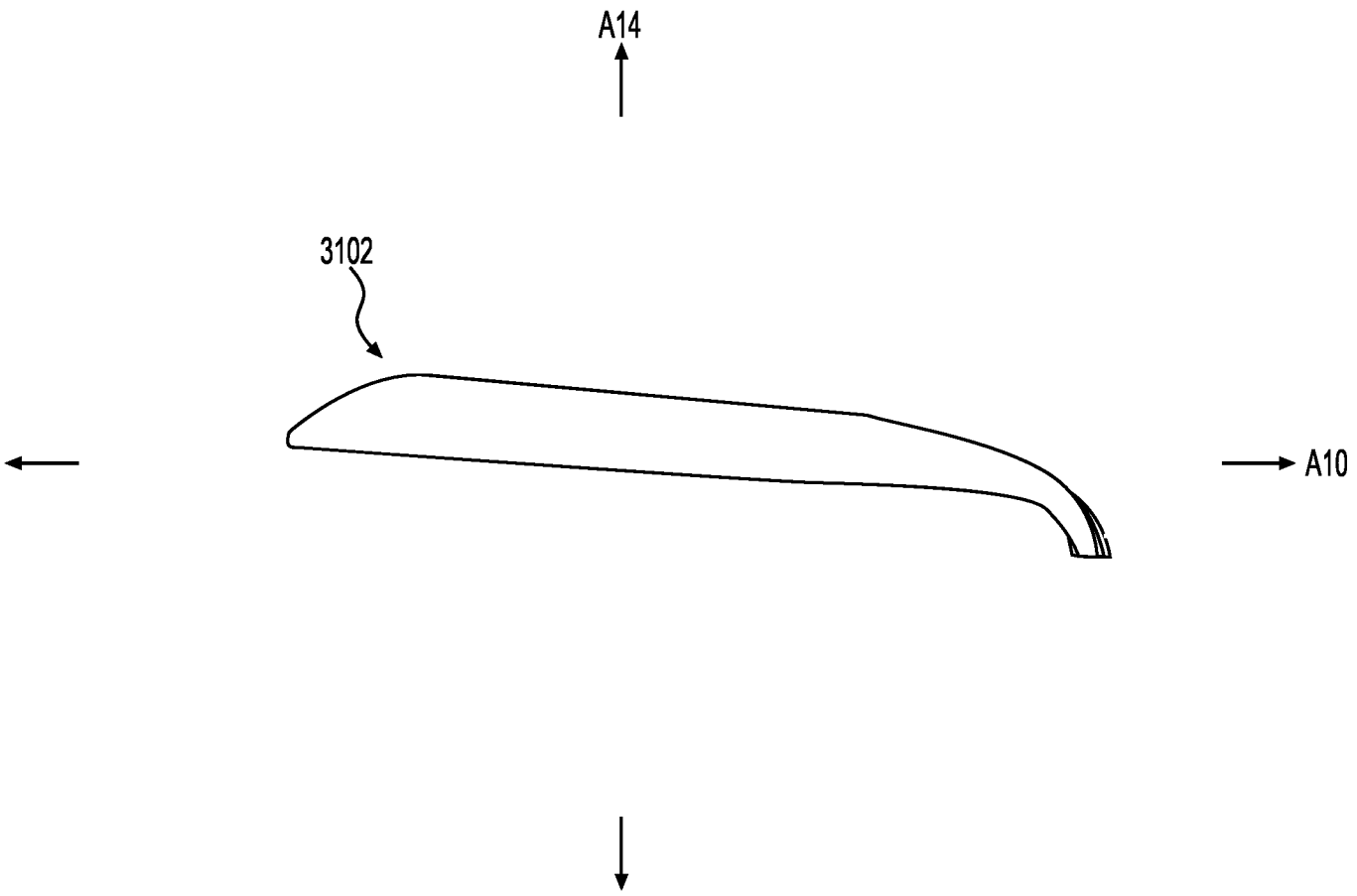
FIG. 31 is a side view of an alternative embodiment of the heel clip of FIG. 4A.

FIG. 31 shows an alternative embodiment of the heel clip 202, heel clip 3102. Heel clip 2302 only includes base 3004.

Figure 32:
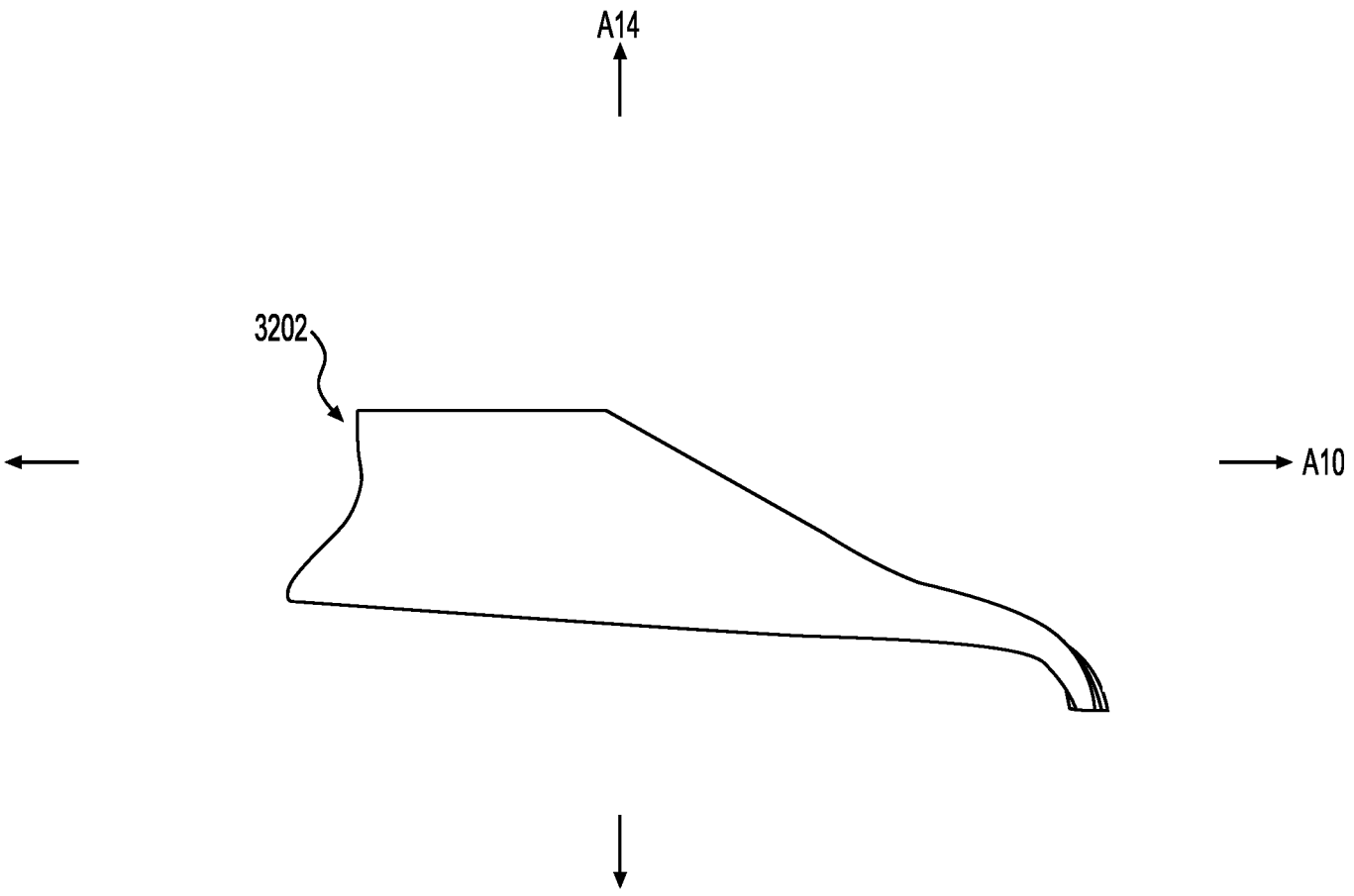
FIG. 32 is a side view of an alternative embodiment of the heel clip of FIG. 4A.

FIG. 32 shows an alternative embodiment of the heel clip 2802 including a support 3202. Support 3202 is substantially similar to the support 2402.

Figure 33:
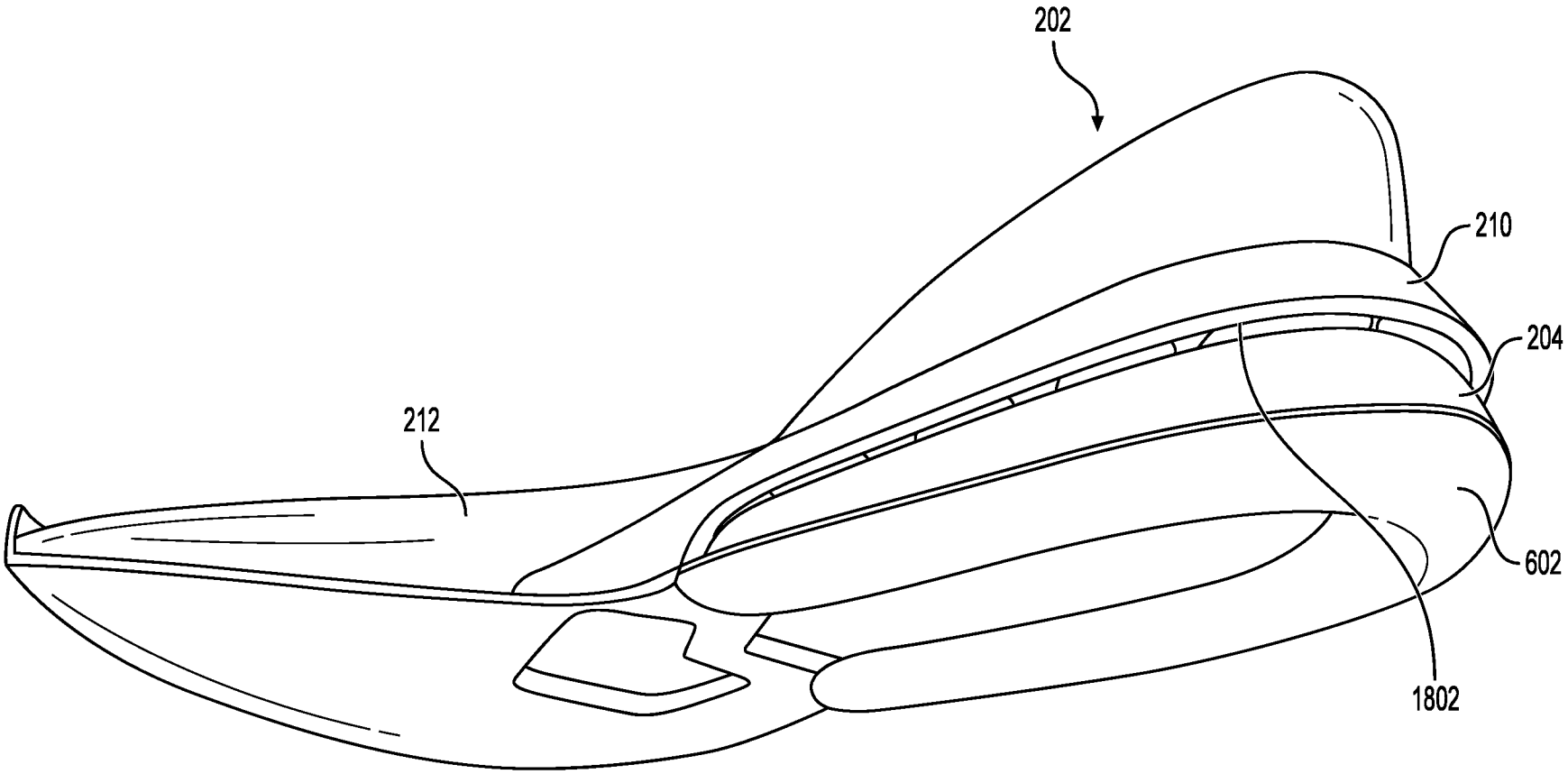
FIG. 33 is a perspective view of an alternative embodiment of the sole structure of FIG. 11A.
Figure 34:
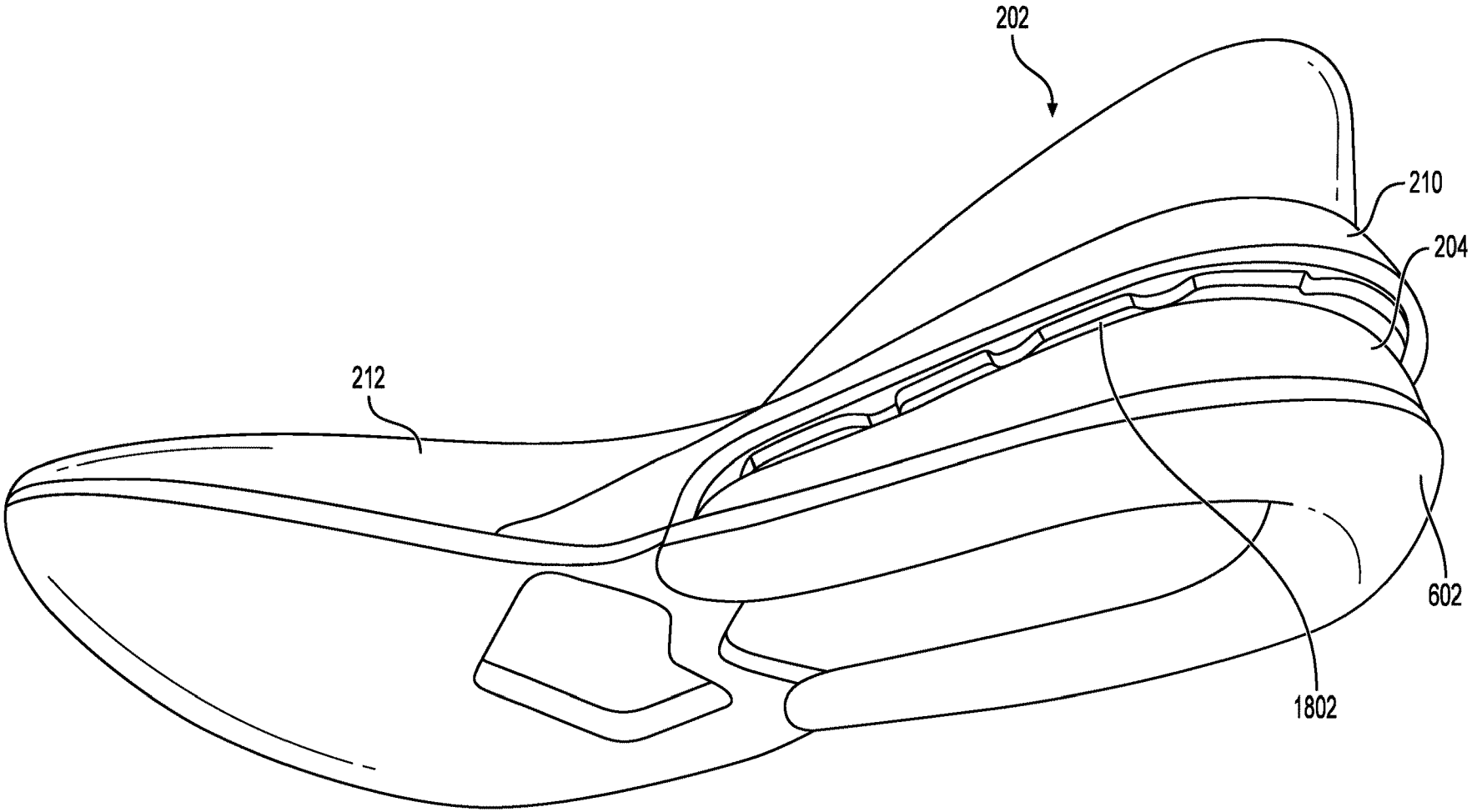
FIG. 34 is a perspective view of an alternative embodiment of the sole structure of FIG. 33.
Figure 35:
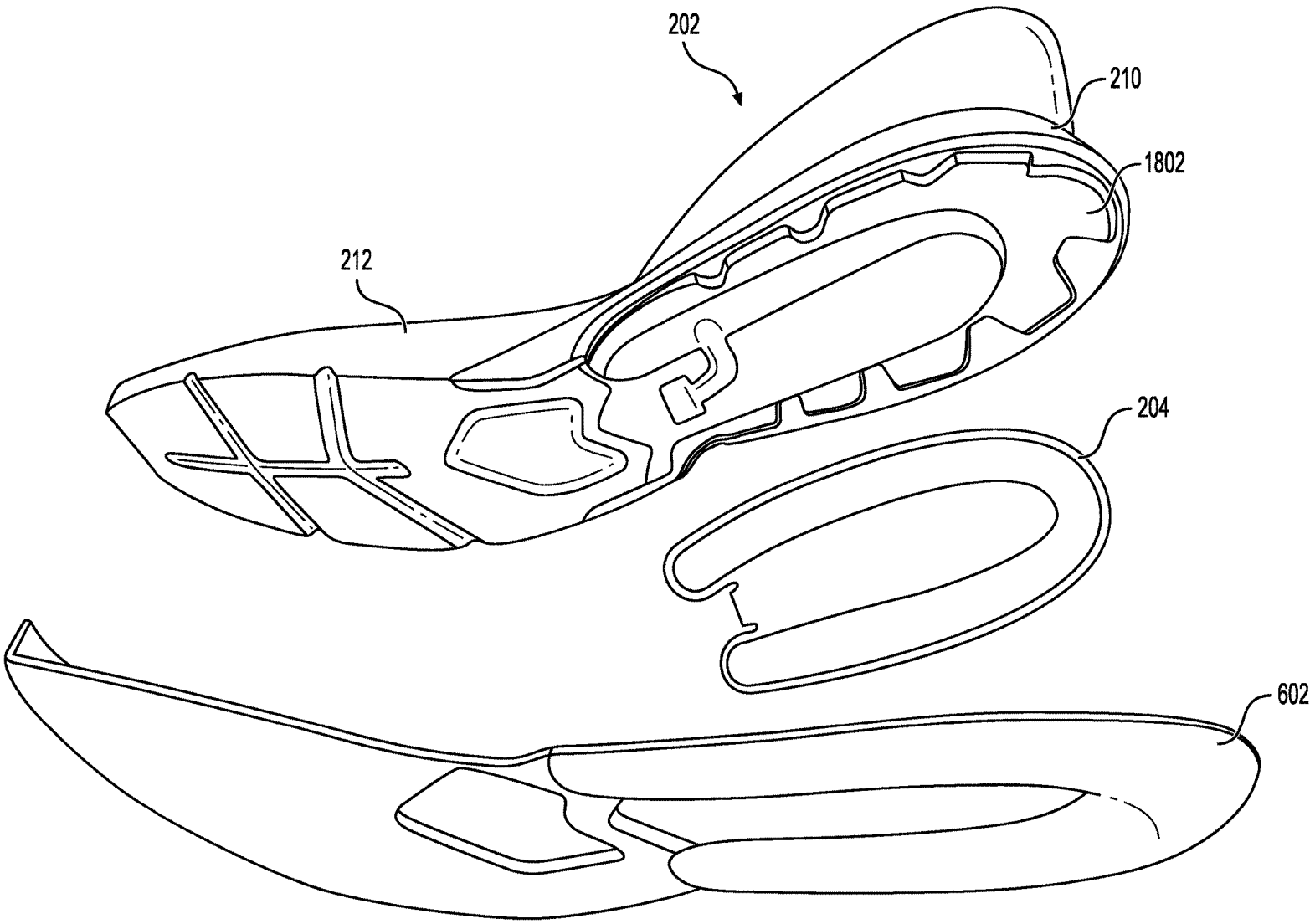
FIG. 35 is an exploded view of an alternative embodiment of the sole structure of FIG. 33.

FIGS. 33-35 show assembly of an alternative embodiment of the sole structure including the unitary protruding portion 1802. Each protruding segment 1804*a*, 1804*b*, 1804*c*, 1804*d*, 1804*e*, 1804*f*, and 1804*g* communicates with a top surface of the cushioning element 204. In this manner, the protruding segments are said to point load the cushioning element 204 to provide a desired form of cushioning.

Figure 36A:
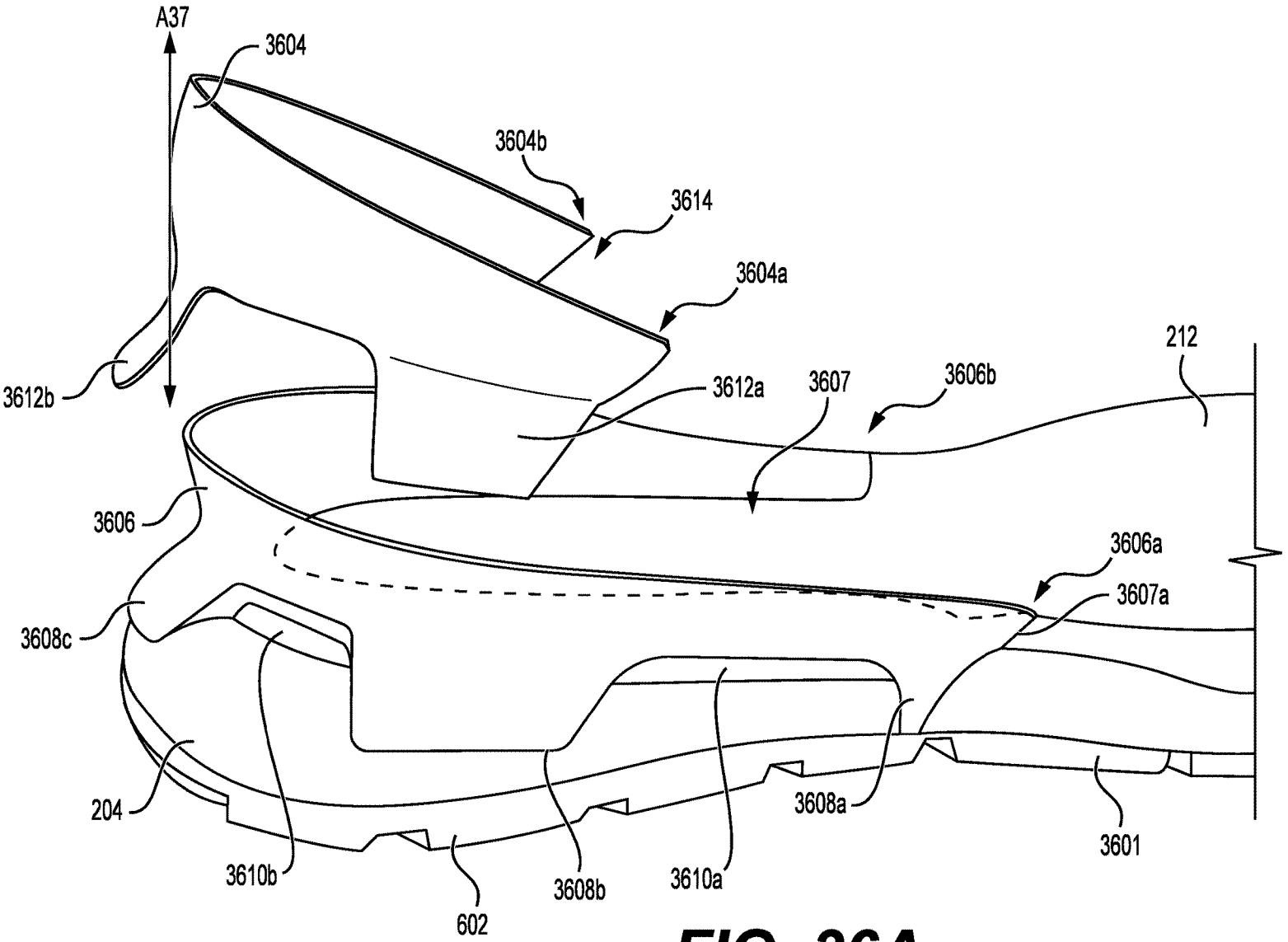
FIG. 36A is a perspective exploded view of an alternative embodiment of the sole structure of FIG. 11B.
Figure 36B:
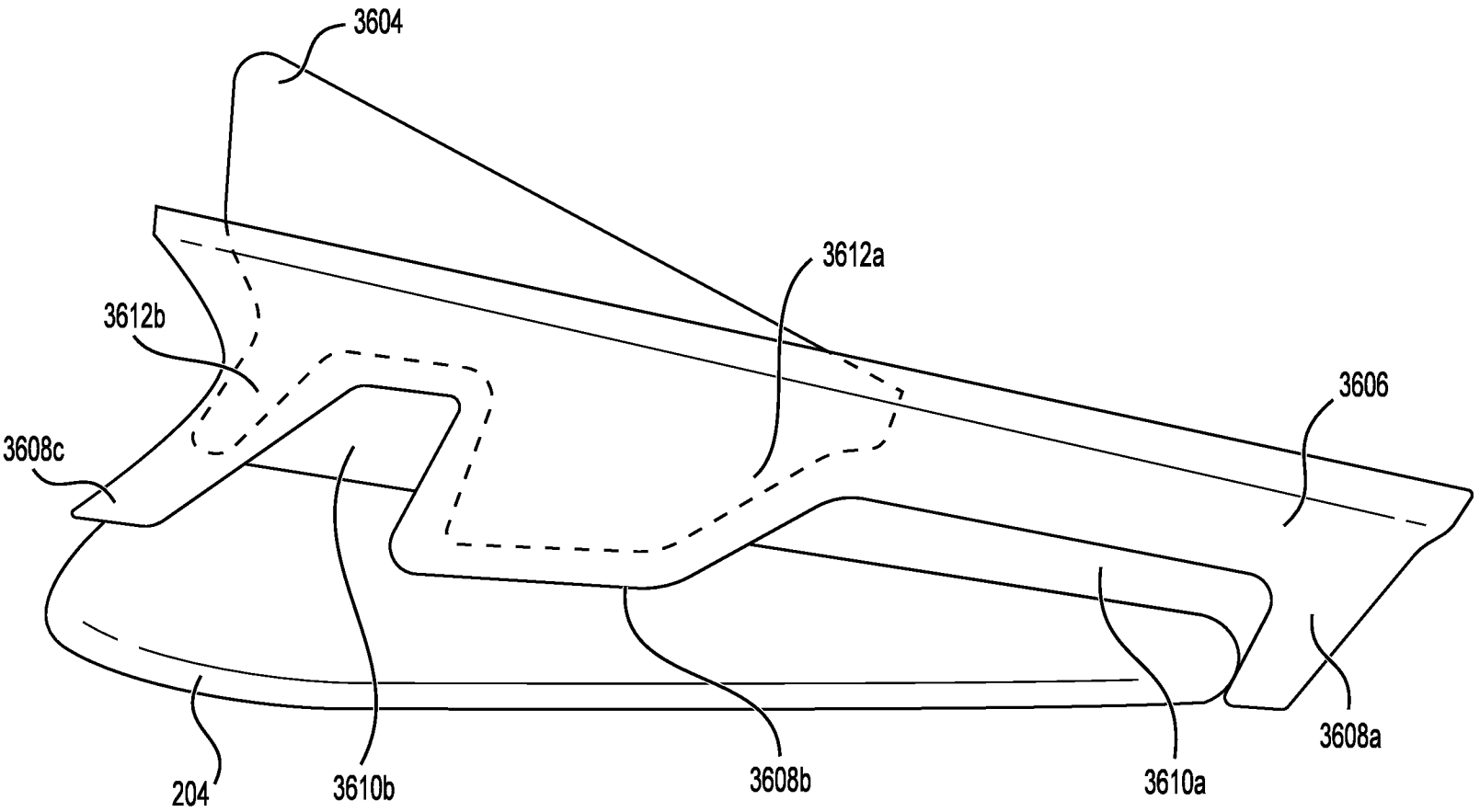
FIG. 36B is a side view of the alternative embodiment of the sole structure of FIG. 36A.

FIGS. 36A and 36B show an alternative embodiment of the sole structure 102, depicted as sole structure 3602. Sole structure 3602 shows like reference numerals where similar to sole structure 102. Sole structure 3602 includes a heel counter 3604 and a shell 3606. Sole structure 3602 includes first cushioning element 212 and second cushioning element 204. The sole structure 3602 also includes heel cup 602 and an outsole layer 3601.

As shown in FIG. 36A, the shell 3606 is coupled (e.g. directly coupled) to one or both of the first cushioning element 212 (similar to heel wrap 210) and the second cushioning element 204. The shell 3606 includes an anterior medial end 3606*a* and an anterior lateral end 3606*b*. The shell 3606 extends from the anterior medial end 3606*a* disposed at a portion of the mid-foot region 22, to the anterior lateral end 3606*b* disposed at a portion of the mid-foot region 22 opposite the anterior medial end 3606*a*. The anterior medial end 3606*a* contacts a portion of the midsole 212 at a first posterior-facing contact area 3607*a*. The anterior lateral end 3606 contacts a portion of the midsole 212 at a second posterior-facing contact area 3607*b* (shown in FIG. 37B). The shell 3606 extends through the heel region 24 and around the posterior end 14 of an article of footwear 3600. The shell 3606 is substantially "U" shaped having an opening (or gap) 3607 between the anterior medial end 3606*a* and the anterior lateral end 3606*b*.

The shell 3606 includes a body and one or more protrusions extending away from the body. The one or more protrusions includes a first protrusion 3608*a*, a second protrusion 3608*b*, a third protrusion 3608*c*, a fourth protrusion 3608*d*, and a fifth protrusion 3608*e* (shown in FIG. 37B). The first protrusion 3608*a* is disposed adjacent the anterior medial end 3606*a*. The second protrusion 3608*b* is disposed on the medial side 16. The fourth protrusion 3608*d* is disposed on the lateral side 18 (best shown in FIG. 37B). The third protrusion 3608*c* is disposed at the posterior end 14 and disposed between the second protrusion 3608*b* and the fourth protrusion 3608*d* in the medial-lateral direction. The fifth protrusion 3608*e* is disposed adjacent the anterior lateral end 3606*b*.

The first protrusion 3608*a* is a portion of the shell 3606 extending toward the ground. The second protrusion 3608*b* is a portion of the shell 3606 extending toward the ground. The third protrusion 3608*c* is a portion of the shell 3606 extending toward the ground. The fourth protrusion 3608*d* is a portion of the shell 3606 extending toward the ground. The fifth protrusion 3608*e* is a portion of the shell 3606 extending toward the ground. Each of the protrusions 3608*a*, 3608*b*, 3608*c*, 3608*d*, and 3608*e* include a respective anterior-facing edge. The protrusions 3608*a*, 3608*b*, 3608*c*, 3608*d*, and 3608*e*, specifically the bottom most surfaces of the protrusions 3608*a*, 3608*b*, 3608*c*, 3608*d*, and 3608*e*, have a downward taper in the anterior direction. When the article of footwear is oriented so that the outsole 206 is in contact with the ground, the protrusions 3608*a*, 3608*b*, 3608*c*, 3608*d*, and 3608*e* extend toward the ground.

The first protrusion 3608*a* and the fifth protrusion 3608*e* are disposed at similar and/or overlapping longitudinal positions on opposing sides of the central longitudinal axis of the shell 3606. The second protrusion 3608*b* and the fourth protrusion 3608*d* are disposed at similar and/or overlapping longitudinal positions on opposing sides of the central longitudinal axis of the shell 3606. In some embodiments, first protrusion 3608*a* and fifth protrusion 3608*e* are symmetrical about the central longitudinal axis, although it is contemplated that they may have different shapes or orientations. In some embodiments, second protrusion 3608*b* and fourth protrusion 3608*d* are symmetrical about the central longitudinal axis, although it is contemplated that they may have different shapes or orientations.

In an example, each protrusion 3608*a*, 3608*b*, 3608*c*, 3608*d*, and 3608*e* is coupled to a respective portion of the second cushioning element 204. In the example, each protrusion 3608*a*, 3608*b*, 3608*c*, 3608*d*, and 3608*e* includes a concave surface to aid in the coupling to the respective portion of the second cushioning element 204.

Disposed between circumferentially adjacent protrusions 3608*a*, 3608*b*, 3608*c*, 3608*d*, and 3608*e* is a gap. In an example, a first gap 3610*a* extends between the first protrusion 3608*a* and the second protrusion 3608*b*. In an example, a second gap 3610*b* extends between the second protrusion 3608*b* and the third protrusion 3608*c*. In an example, a third gap 3610*c* extends between the third protrusion 3608*c* and the fourth protrusion 3608*d* (shown in FIG. 37B). In an example, a fourth gap 3610*d* (shown in FIG. 37B) extends between the fourth protrusion 3608*d* and the fifth protrusion 3608*e*.

Still referring to FIG. 36A, the heel counter 3604 includes an anterior medial end 3604*a* and an anterior lateral end 3604*b*. The heel counter 3604 extends from the anterior medial end 3604*a* disposed at a portion of the heel region 24, to the lateral medial end 3604*b* disposed at a portion of the heel region 24 opposite the anterior medial end 3604*a*. The heel counter 3604 extends around the posterior end 14 of the article of footwear 10. The heel counter 3604 is substantially "U" shaped having an opening (or gap) 3614 between the anterior medial end 3604*a* and the anterior lateral end 3604*b*.

The heel counter 3604 includes a first protrusion 3612*a*, a second protrusion 3612*b*, and a third protrusion 3612*c*. The first protrusion 3612*a* is disposed on the medial side 16 adjacent the anterior medial end 3604*a*. The third protrusion 3612*c* is disposed on the lateral side 18 adjacent the anterior lateral end 3604*b*. For illustrative purposes, third protrusion 3612*c* is not shown. The second protrusion 3612*b* is disposed at the posterior end 14 and disposed in a medial-lateral direction between the first protrusion 3612*a* and the third protrusion 3612*c*. In an example, each of the protrusions 3612*a*, 3612*b*, and 3612*c* are concave relative to an exterior of the heel counter 3604 such that each of the protrusions 3612*a*, 3612*b*, and 3612*c* extend radially outward from a bottom surface of a body of the heel counter 3604.

The first protrusion 3612*a* is a portion of the heel counter 3604 extending toward the ground. The second protrusion 3612*b* is a portion of the heel counter 3604 extending toward the ground. The third protrusion 3612*c* is a portion of the heel counter 3604 extending toward the ground. Each of the protrusions 3612*a*, 3612*b*, and 3612*c* include a respective anterior-facing edge. The protrusions 3612*a*, 3612*b*, and 3612*c* have a downward taper in the anterior direction. When the article of footwear is oriented so that the outsole 206 is in contact with the ground, the protrusions 3612*a*, 3612*b*, and 3612*c* extend toward the ground. The first protrusion 3612*a* and the third protrusion 3612*c* are disposed at similar and/or overlapping longitudinal positions on opposing sides relative to the central longitudinal axis of the heel counter 3604. In some embodiments, first protrusion 3612*a* and second protrusion 3612*b* are symmetrical, although it is contemplated that they may have different shapes or orientations.

As shown in FIG. 36B, when assembled, the heel counter 3604 is disposed within a cavity of the shell 3606. The first protrusion 3612*a* couples with the first protrusion 3608*a*. The second protrusion 3612*b* couples with the second protrusion 3608*b*. The third protrusion 3612*c* couples with the second protrusion 3608*c*. The angle of each protrusion 3612*a*, 3612*b*, and 3612*c* aids the heel counter 3604 in remaining coupled to the shell 3606. The assembly of the heel counter 3604 and the shell 3606 being coupled to the second cushioning element 204 allows for point loading of the second cushioning element 204. In some examples, the heel counter 3604 and shell 3606 may be formed as a unitary construction. In other examples, the heel counter 3604 and the shell 3606 may be compositely formed. In some examples, the shell 3606 is a clear thermoplastic urethane (TPU). In some examples, the heel counter 3604 is an opaque thermoplastic urethane (TPU).

Figure 37A:
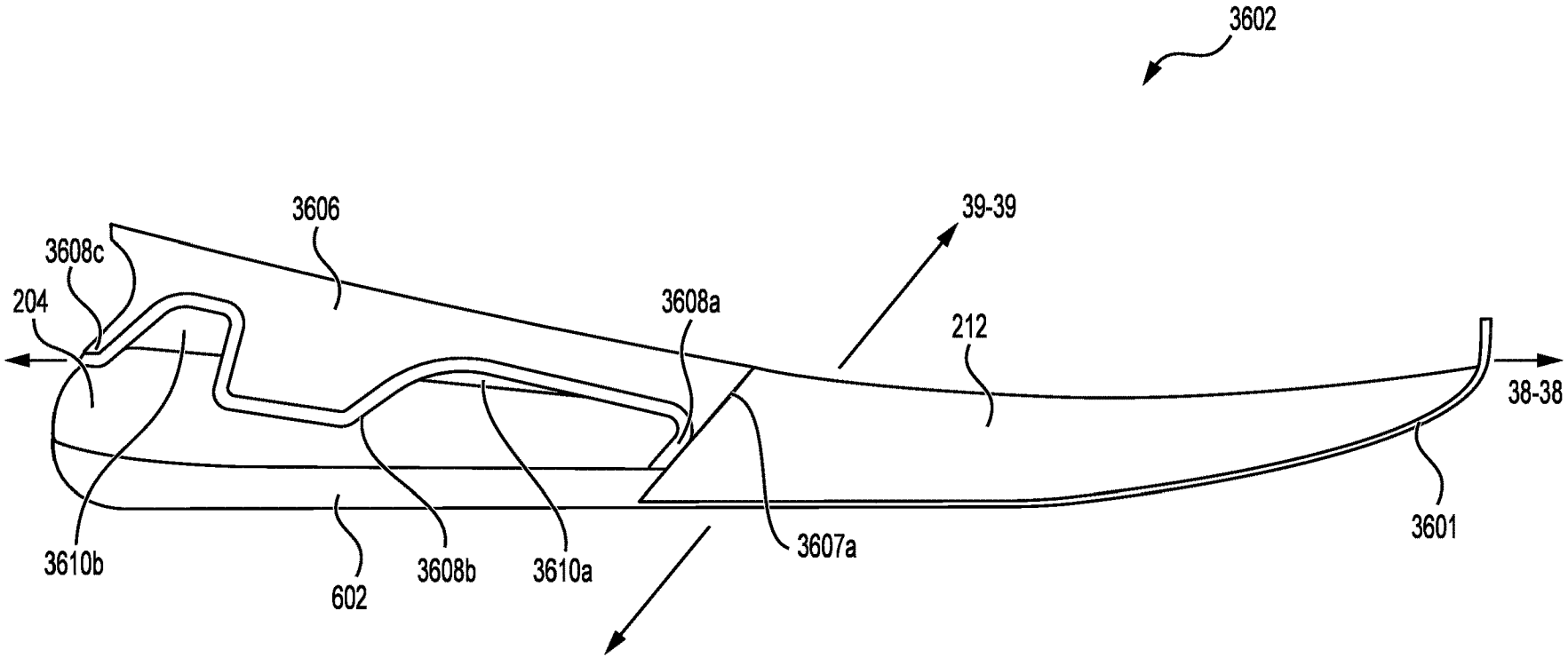
FIG. 37A is a side view of the alternative embodiment of the sole structure of FIG. 36A.
Figure 37B:
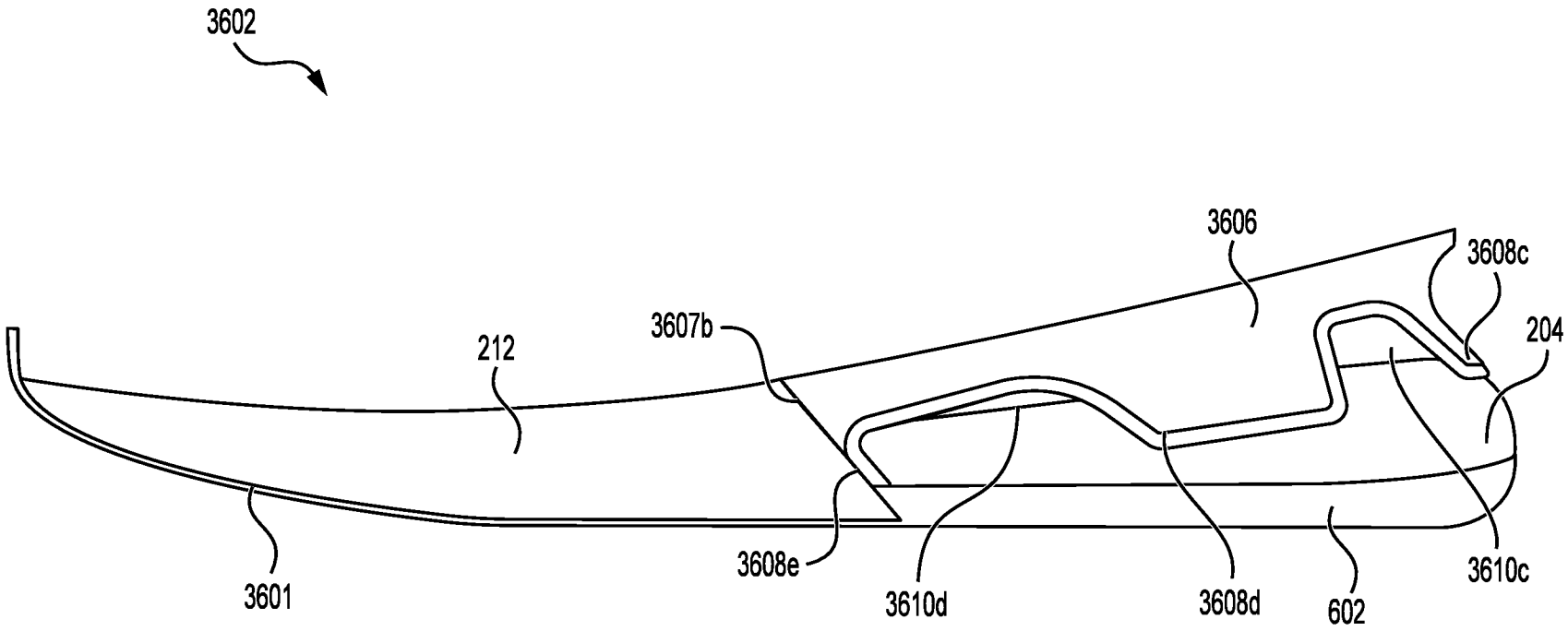
FIG. 37B is a side view of the alternative embodiment of the sole structure of FIG. 36A.

FIG. 37A depicts sole structure 3602 in a medial view. FIG. 37B depicts sole structure 3602 in a lateral view.

Figure 38:
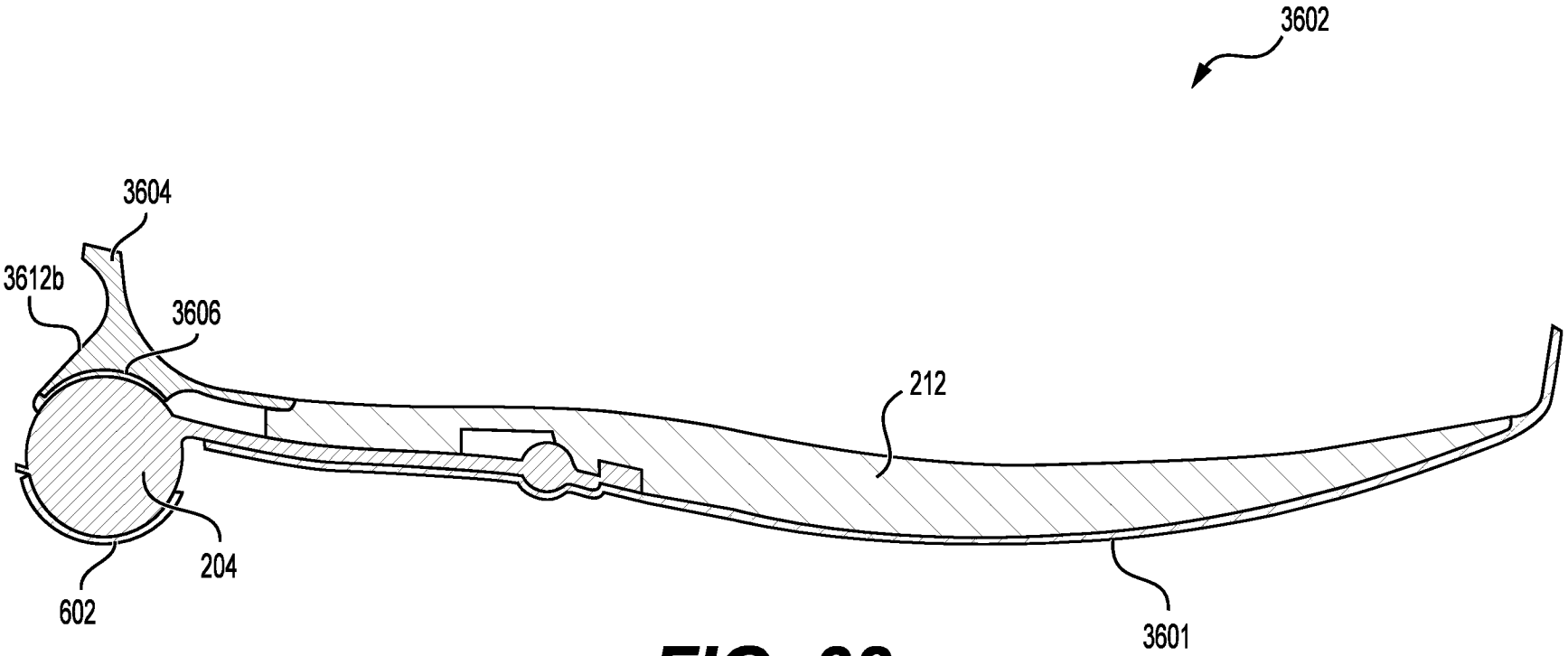
FIG. 38 is a cross-sectional view of the alternative embodiment of the sole structure of FIG. 37A taken along line 38-38.

FIG. 38 depicts a cross-section of the sole structure 3602 taken along line 38-38, shown in FIG. 36A.

Figure 39:
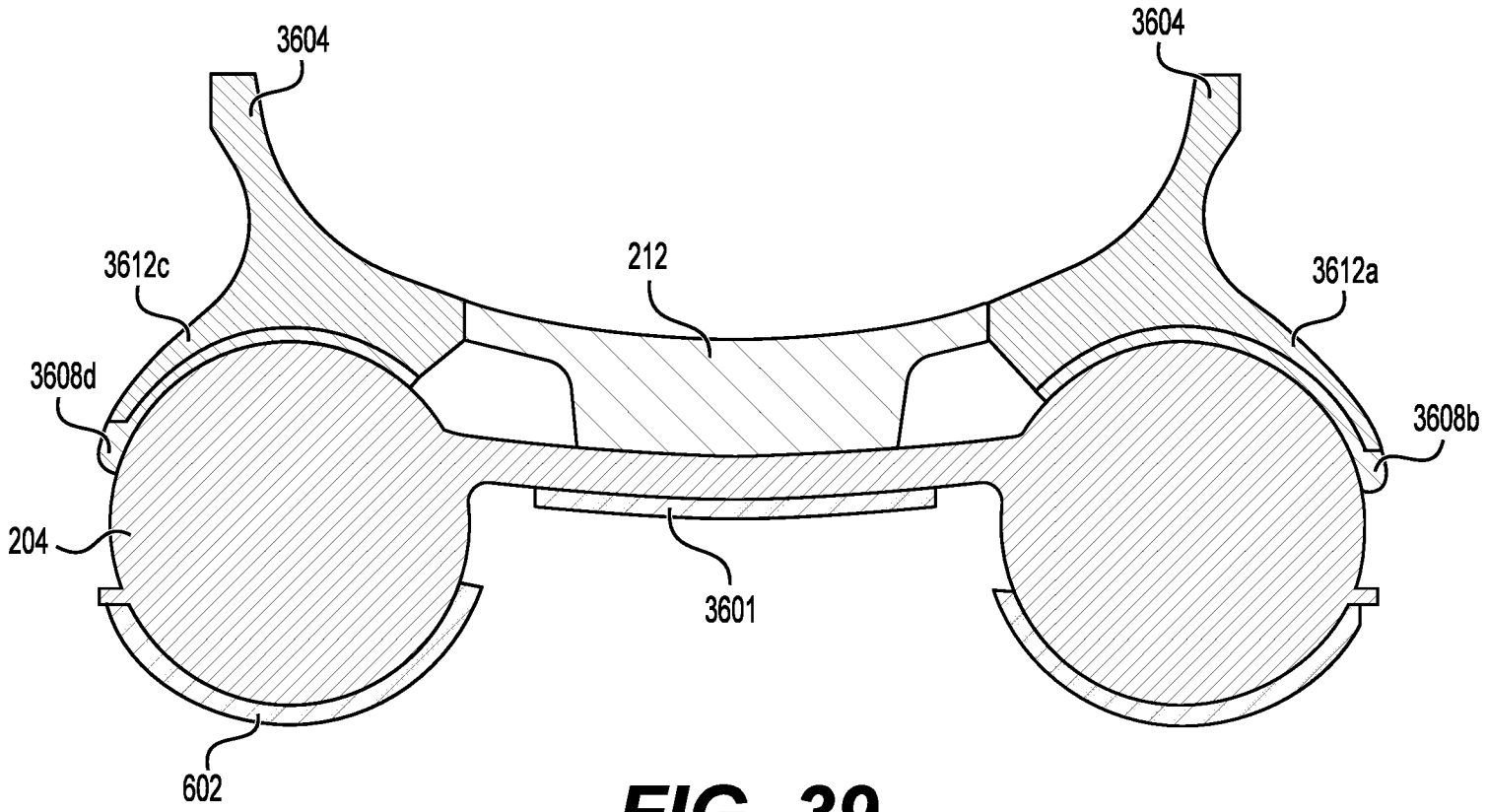
FIG. 39 is a cross-sectional view of the alternative embodiment of the sole structure of FIG. 37A taken along line 39-39.

FIG. 39 depicts a cross-section of the sole structure 3602 taken along line 39-39, shown in FIG. 36A. As shown, inner portions of the combination of the heel counter 3604 and the shell 3606 are coupled to the midsole 212. Each of the heel counter 3604 and the shell 3606 includes respective concave surfaces. The concave surface of the heel counter 3604 couples with a first concave surface of the shell 3606. A second concave surface of the shell 3606 opposite the first concave surface of the shell 3606 couples with a convex surface of the cushioning element 204.

Figure 40:
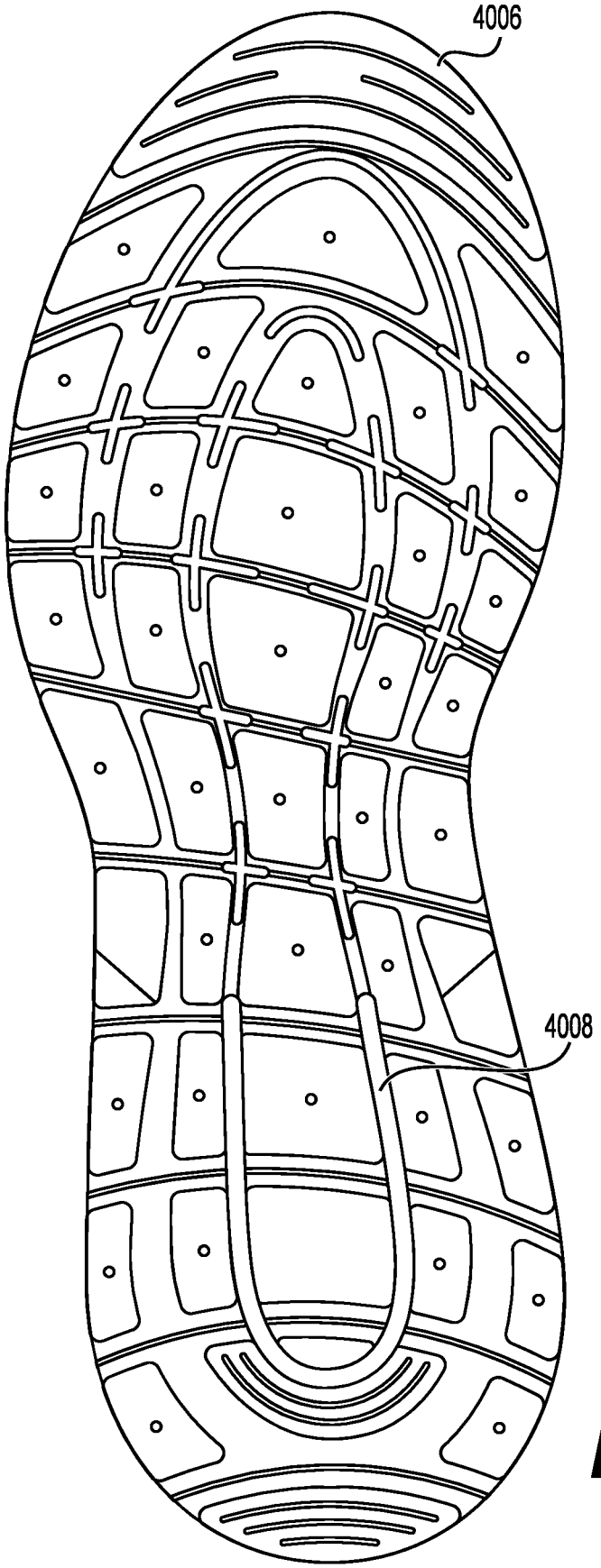
FIG. 40 is a bottom view of the alternative embodiment of the sole structure of FIG. 36A.

FIG. 40 depicts a bottom view of the sole structure 3602 including an alternative embodiment of the outsole 206. The alternative embodiment of the outsole 206, shown as outsole 4006, includes a plurality of gaps 4008. The gaps 4008 may be of a substantially plus shape, a curved arc, or a shape. The gaps 4008 may be shaped in any manner suitable for viewing portions of the sole structure 3602 through the outsole 4006. The outsole 4006 may include any other shapes or may include any other elements to aid in traction of the article of footwear.

Figure 41:
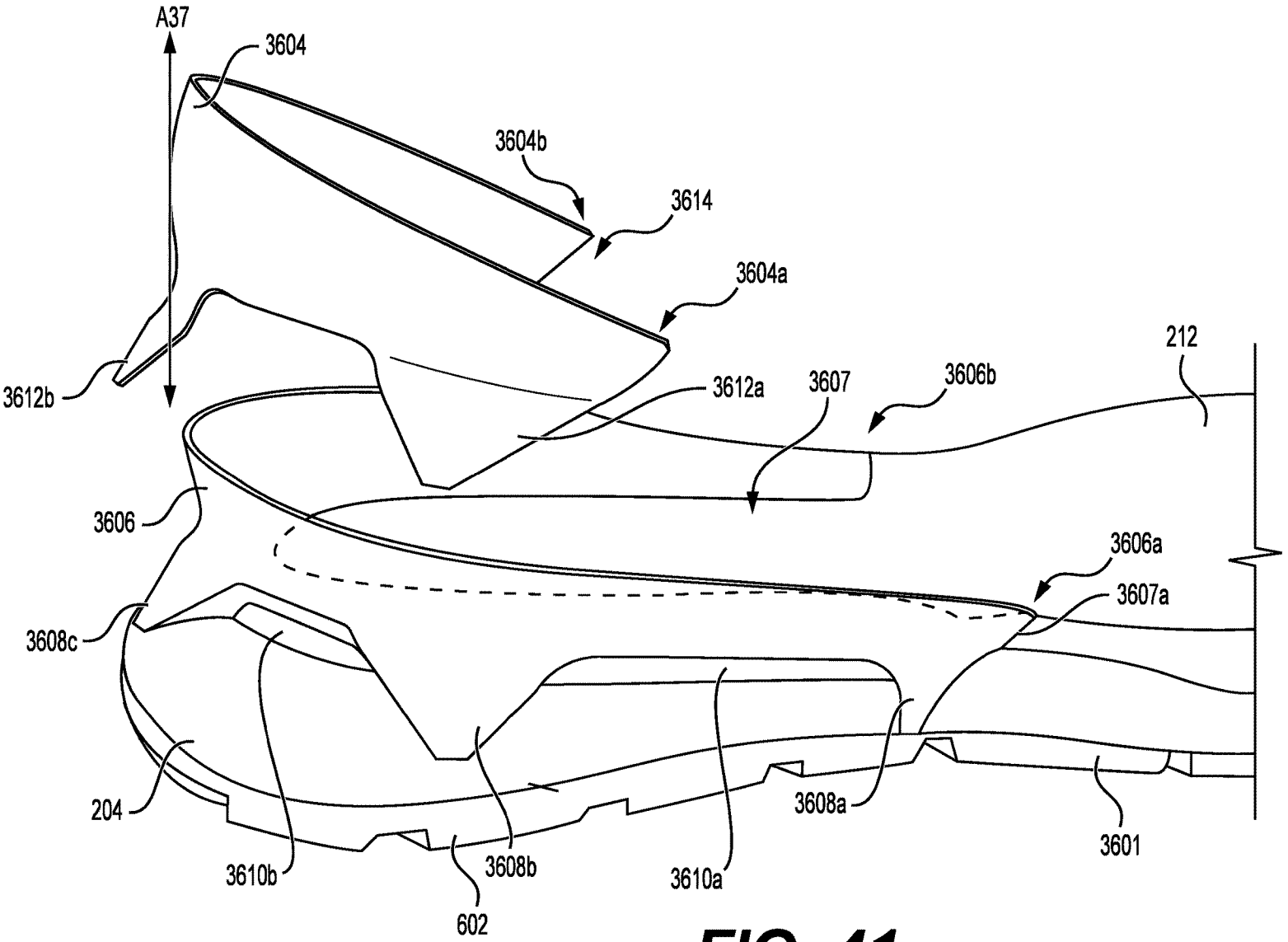
FIG. 41 is a perspective exploded view of an alternative embodiment of the sole structure of FIG. 11B.
Figure 42:
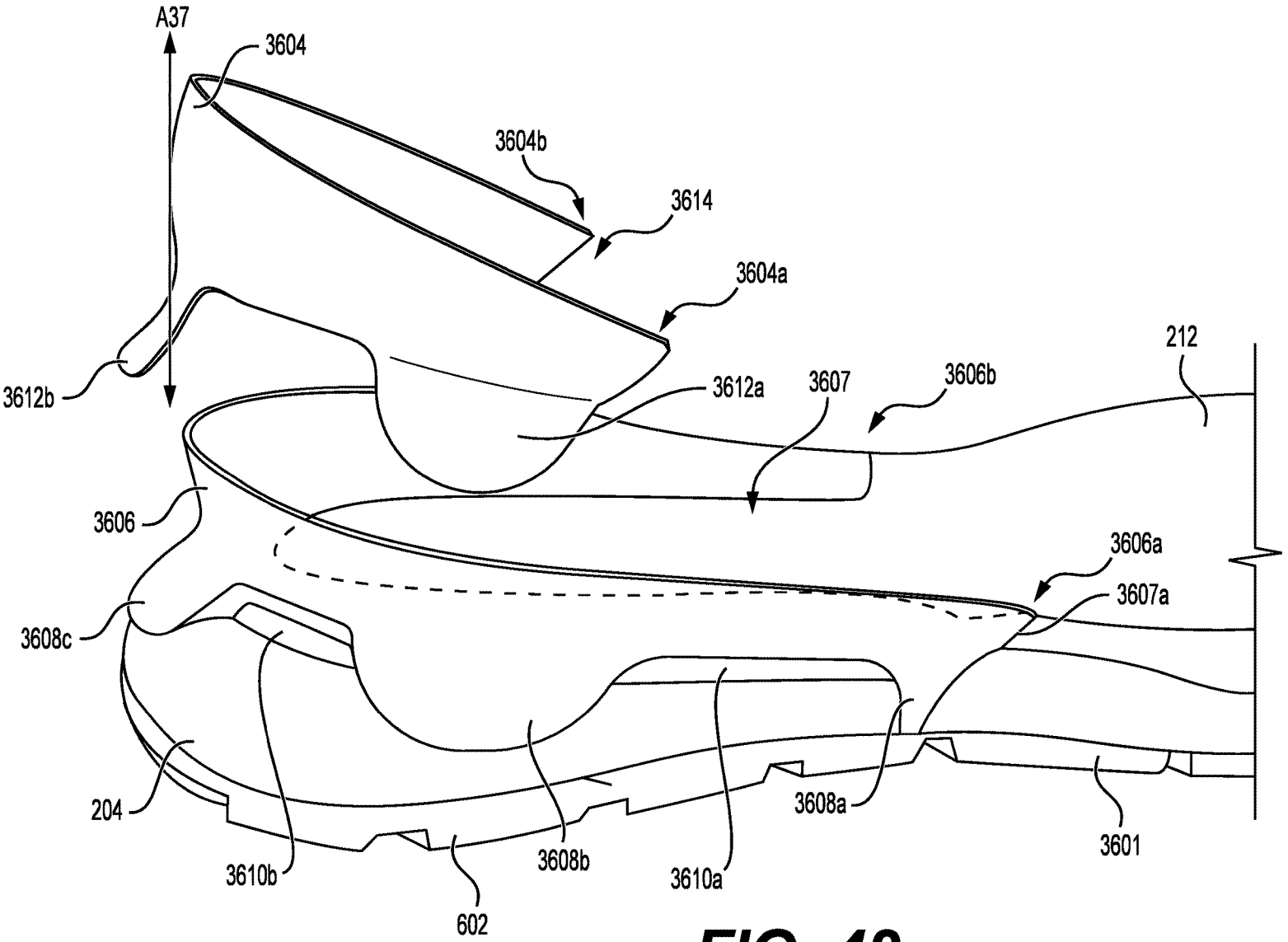
FIG. 42 is a perspective exploded view of an alternative embodiment of the sole structure of FIG. 11B.
Figure 43:
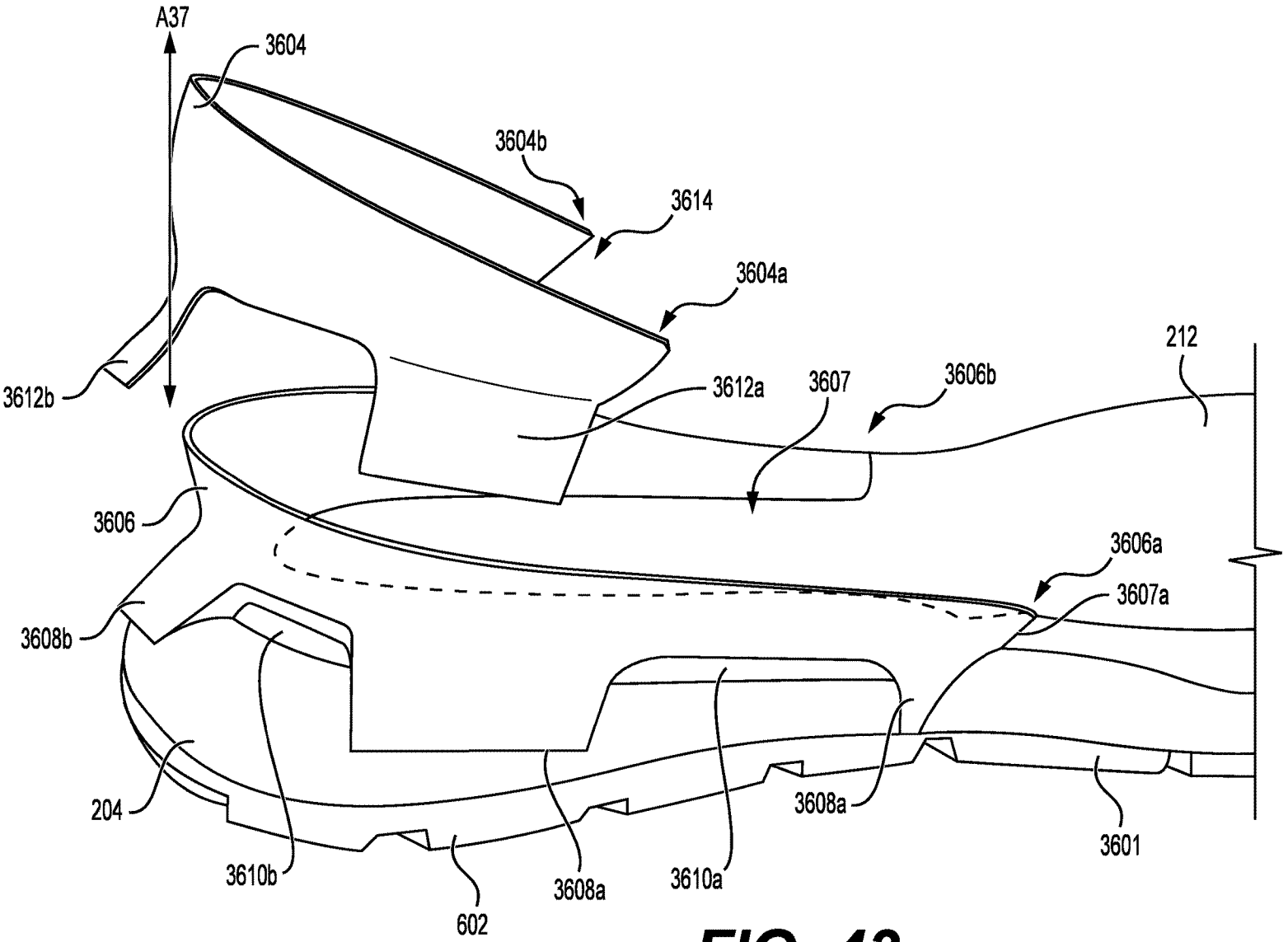
FIG. 43 is a perspective exploded view of an alternative embodiment of the sole structure of FIG. 11B.

FIGS. 41, 42, and 43 depict the heel counter 3604 and the shell 3606 including alternative shapes. For example, the protrusions 3612*a*, 3612*b*, and 3612*c* may have a substantially triangular shape, a substantially rounded shape, a substantially rounded shape, or the like. For example, the protrusions 3608*a*, 3608*b*, 3608*c*, 3608*d*, and 3608*e* may have a substantially triangular shape, a substantially rounded shape, a substantially rounded shape, or the like. The protrusions 3612*a*, 3612*b*, and 3612*c* and the protrusions 3608*a*, 3608*b*, 3608*c*, 3608*d*, and 3608*e* may have corresponding shapes.

In one embodiment, the heel wrap 210 is made from or otherwise includes a textile wrapped foam. In one embodiment, the heel wrap 210 is made from or otherwise includes any suitable molded plastic. In the alternative, heel wrap 210 may be made from or may otherwise include a metal. Depending upon the material chosen, padding may be provided on the inside of the heel wrap 210 for the comfort of the wearer. If desired, heel wrap 210 includes a plurality of parts to permit adjustability, or, as shown in the figures, heel wrap 210 may be unitary in construction (i.e., may have a single-piece construction). In some examples, heel stabilizing element may be 3-D printed or formed from any suitable additive manufacturing method. In some examples, the heel wrap 210 may include, e.g., a molded thermoplastic polyurethane member, or another suitable material.

In an exemplary embodiment, the heel clip 202 is formed of a TPU material, such as, e.g., a transparent or non-transparent TPU material. It is contemplated that in alternative embodiments, the heel clip 202 may be an elastomeric material or any material suitable for providing support to a heel of a user of the article of footwear 10.

In some implementations, the upper and lower barrier films 502 and 504 may be formed by respective mold portions. The respective mold portions may each define various surfaces for forming depressions and pinched surfaces corresponding to locations where the web area 508 and/or the peripheral seam 510 are formed when the upper barrier film 502 and the lower barrier film 504 are joined and bonded together. In some implementations, adhesive bonding may join the upper barrier film 502 and the lower barrier film 504 to form the web area 508 and the peripheral seam 510. In other implementations, the upper barrier film 502 and the lower barrier film 504 may be joined to form the web area 508 and the peripheral seam 510 by thermal bonding.

In some examples, one or both of the barrier films 502 and 504 may be heated to a temperature that facilitates shaping and melding. In some examples, the barrier films 502 and 504 may be heated prior to being located between their respective molds. In other examples, the mold may be heated to raise the temperature of the barrier films 502 and 504. In some implementations, a molding process used to form the fluid-filled chamber 506 may incorporate vacuum ports within mold portions to remove air such that the upper and lower barrier films 502 and 504 are drawn into contact with respective mold portions. In other implementations, fluids such as air may be injected into areas between the upper and lower barrier films 502 and 504 such that pressure increases cause the barrier films 502 and 504 to engage with surfaces of their respective mold portions.

As used herein, the term "barrier film" or "barrier membrane" (e.g., barrier films 502 and 504) encompasses both monolayer and multilayer films. In some embodiments, one or both of barrier films 502 and 504 may each be produced (e.g., thermoformed or blow molded) from a monolayer film (a single layer). In other embodiments, one or both of barrier films 502 and 504 may each be produced (e.g., thermoformed or blow molded) from a multilayer film (multiple sublayers). The multi-layered film may comprise a plurality of layers. The plurality of layers may comprise one or more barrier layers. The one or more barrier layers may comprise a barrier material. The barrier material may comprise or consist essentially of one or more gas barrier compounds. The multi-layered film may comprise at least 5 layers or at least 10 layers. In other embodiments, the multi-layered film may comprise from about 5 layers to about 400 layers. In one aspect of a multi-layered film, the plurality of layers may include a series of alternating layers, in which the alternating layers include two or more barrier layers. Each of the two or more barrier layers may individually comprise a barrier material, the barrier material comprising or consisting essentially of one or more gas barrier compounds. In the series of alternating layers, adjacent layers may be individually formed of materials which differ from each other at least in their chemical compositions based on the individual components present (e.g., the materials of adjacent layers may differ based on whether or not a gas barrier compound is present, or differ based on class or type of gas barrier compound present), the concentration of the individual components present (e.g., the materials of adjacent layers may differ based on the concentration of a specific type of gas barrier compound present), or may differ based on both the components present and their concentrations.

The plurality of layers of the multi-layered film may include first barrier layers comprising a first barrier material and second barrier layers comprising a second barrier material, wherein the first and second barrier materials differ from each other as described above. The first barrier material may be described as comprising a first gas barrier component consisting of all the gas barrier compounds present in the first barrier material, and the second barrier material may be described as comprising a second barrier material component consisting of all the gas barrier compounds present in the second barrier material. In a first example, the first barrier component may consist only of one or more gas barrier polymers, and the second barrier component may consist only of one or more inorganic gas barrier compounds. In a second example, the first barrier component may consist of a first one or more gas barrier polymers, and the second component may consist of a second one or more gas barrier polymers, wherein the first one or more gas barrier polymers differ from the second one or more gas barrier polymers in polymer class, type, or concentration. In a third example, the first barrier component and the second barrier component both may include the same type of gas barrier compound, but the concentration of the gas barrier compound may differ. Optionally the concentrations may differ by at least 5 weight percent based on the weight of the barrier material. In these multi-layered films, the first barrier layers and the second barrier layers may alternate with each other, or may alternate with additional barrier layers (e.g., third barrier layers comprising a third barrier material, fourth barrier layers comprising a fourth barrier material, etc., wherein each of the first, second, third and fourth, etc., barrier materials differ from each other as described above).

In either aspect, each layer or sublayer can have a film thickness ranging from about 0.2 micrometers to about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers. In yet further embodiments, the film thickness for each layer or sublayer can range from about 72 micrometers to about 320 micrometers.

The lower barrier film 504 may have a greater thickness than the upper barrier film 502, or vice versa. When thicker than the upper barrier film 502, the lower barrier film 504 is configured to provide a portion of the ground-contacting surface of the article of footwear 10. Alternatively, the lower barrier film 504 and upper barrier film 502 may have equal thicknesses.

One or both of barrier films 502 and 504 may independently be transparent, translucent, and/or opaque. For example, the upper barrier film 502 is transparent, while the lower barrier film 504 is opaque. It is contemplated that upper barrier film 502 may be transparent or translucent, while lower barrier film 504 is opaque, or upper barrier film 502 may be opaque, while lower barrier film 504 is transparent or translucent, etc. As used herein, the term "transparent" for a barrier film and/or a fluid-filled chamber means that light passes through the barrier film in substantially straight lines and a viewer can see through the barrier film. In comparison, for an opaque barrier film, light does not pass through the barrier film and one cannot see clearly through the barrier film at all. A translucent barrier film falls between a transparent barrier film and an opaque barrier film, in that light passes through a translucent film but some of the light is scattered so that a viewer cannot see clearly through the film.

The chamber 506 is produced from barrier films 502 and 504 using any suitable technique, such as thermoforming (e.g., vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, barrier films 502 and 504 may be produced by co-extrusion followed by vacuum thermoforming to produce an inflatable chamber 506, which may optionally include one or more valves 512 (e.g., one way valves) that allows the chamber 506 to be filled with a fluid (e.g., gas).

The chamber 506 may be provided in a fluid-filled (e.g., as provided in footwear 10) or in an unfilled state. The chamber 506 may be filled to include any suitable fluid, such as a gas or liquid. In an aspect, the gas can include air, nitrogen (N2), oxygen gases (O2), inert gases, or any other suitable gas. In other aspects, the chamber 506 may alternatively include other media, such as pellets, beads, ground recycled material, and the like (e.g., foamed beads and/or rubber beads). The chamber 506 may be a membrane having a relatively low rate of transmittance of a fluid. When used alone or in combination with other materials in an airbag or bladder, the barrier membrane resiliently retains the fluid. Depending upon the structure and use of the airbag or bladder, the barrier membrane may retain the fluid at a pressure which is above, at, or below atmospheric pressure. The fluid provided to the chamber 506 may result in the chamber 506 being pressurized. The chamber 506 may have a pressure ranging from about atmospheric pressure to about 40 PSI. The chamber 506 may have a pressure ranging from about 10 PSI to about 25 PSI. The chamber 506 may have a pressure ranging from about 12 PSI to about 25 PSI. In an exemplary embodiment, the chamber 506 may have a pressure of about 15 PSI. It is contemplated that the chamber 506 may be pressurized to a pressure for desired characteristics of cushioning. Alternatively, the fluid provided to the chamber 506 may be at atmospheric pressure such that the chamber 506 is not pressurized but, rather, simply contains a volume of fluid at atmospheric pressure.

The chamber 506 desirably may have a low gas transmission rate to preserve its retained gas pressure. In some embodiments, the chamber 506 may have a gas transmission rate for nitrogen gas that is at least about ten (10) times lower than a nitrogen gas transmission rate for a butyl rubber layer of substantially the same dimensions. In an aspect, the chamber 506 may have a nitrogen gas transmission rate of 15 cubic-centimeter/square-meter-atmosphere-day (cm3/m2·atm·day) or less for an average film thickness of 500 micrometers (based on thicknesses of barrier films 502 and 504). In further aspects, the transmission rate is 10 cm3/m2·atm·day or less, 5 cm3/m2·atm·day or less, or 1 cm3/m2·atm·day or less.

The multi-layered films may be produced by various means such as co-extrusion, lamination, layer-by-layer deposition, and the like. When co-extruding one or more barrier layers alone or with one or more second layers, selecting materials (e.g., a first barrier material and a second barrier material, or a single barrier material and a second material) having similar processing characteristics such as melt temperature and melt flow index, may reduce interlayer shear during the extrusion process, and may allow the alternating barrier layers and second layers to be co-extruded while retaining their structural integrities and desired layer thicknesses. In one example, the one or more barrier materials and optionally the second material when used, may be extruded into separate individual films, which may then be laminated together to form the multi-layered films.

The multi-layered films may be produced using a layer-by-layer deposition process. A substrate, which optionally may comprise a second material or a barrier material, may be built into a multi-layered film by depositing a plurality of layers onto the substrate. The layers may include one or more barrier layers (e.g., first barrier layers, second barrier layers, etc.). Optionally, the layers may include one or more second layers. The one or more barrier layers and/or second layers may be deposited by any means known in the art such as, for example, dipping, spraying, coating, or another method. The one or more barrier layers may be applied using charged solutions or suspensions, e.g., cationic solutions or suspensions or anionic solutions or suspensions, including a charged polymer solution or suspension. The one or more barrier layers may be applied using a series of two or more solutions having opposite charges, e.g., by applying a cationic solution, followed by an anionic solution, followed by a cationic solution, followed by an anionic solution, etc.

The barrier membranes, including the multi-layered films, have an overall thickness of from about 40 micrometers to about 500 micrometers, or about 50 micrometers to about 400 micrometers, or about 60 micrometers to about 350 micrometers. In one aspect, each individual layer of the plurality of layers of the multi-layered film has a thickness of from about 0.001 micrometers to about 10 micrometers. For example, the thickness of an individual barrier layer can range from about 0.001 micrometers to about 3 micrometers thick, or from about 0.5 micrometers to about 2 micrometers thick, or from about 0.5 micrometers to about 1 micrometer thick. The thickness of an individual second layer may range from about 2 micrometers to about 8 micrometers thick, or from about 2 micrometers to about 4 micrometers thick.

In a further aspect, thickness of the films and/or their individual layers may be measured by any method known in the art such as, for example, ASTM E252, ASTM D6988, ASTM D8136, or using light microscopy or electron microscopy.

In some aspects, the barrier membranes, including the multi-layered films, may have a Shore hardness of from about 35 A to about 95 A, optionally from about 55 A to about 90 A. In these aspects, hardness may be measured using ASTM D2240 using the Shore A scale.

In one aspect, when a co-extrusion process is used to form the barrier membrane from a plurality of alternating barrier layers and second layers, the barrier material may have a melt flow index of from about 5 to about 7 grams per 10 minutes at 190 degrees Celsius when using a weight of 2.16 kilograms, while the second material may have a melt flow index of from about 20 to about 30 grams per 10 minutes at 190 degrees Celsius when using a weight of 2.16 kilograms. In a further aspect, the melt flow index of the barrier material may be from about 80 percent to about 120 percent of the melt flow index of the barrier material per 10 minutes when measured at 190 degrees Celsius when using a weight of 2.16 kilograms. In these aspects, melt flow index may be measured using ASTM D1238. Alternatively or additionally, the barrier material or the second material or both may have a melting temperature of from about 165 degrees Celsius to about 183 degrees Celsius, or from about 155 degrees Celsius to about 165 degrees Celsius. In one such example, the barrier material may have a melting temperature of from about 165 degrees Celsius to about 183 degrees Celsius, while the second material has a melting temperature of from about 155 degrees Celsius to about 165 degrees Celsius. Further in these aspects, melting temperature can be measured using ASTM D3418.

Barrier films 502 and 504 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier films 502 and 504 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier films 502 and 504 include two or more sublayers, examples of suitable multilayer films include microlayer films, such as those disclosed in Bonk et al., U.S. Pat. No. 6,582,786, which is incorporated by reference in its entirety. In further embodiments, barrier films 502 and 504 may each independently include alternating sublayers of one or more TPU copolymer materials and one or more EVOH copolymer materials, where the total number of sublayers in each of barrier films 502 and 504 includes at least four (4) sublayers, at least ten (10) sublayers, at least twenty (20) sublayers, at least forty (40) sublayers, and/or at least sixty (60) sublayers.

In one aspect, the barrier material may comprise or consist essentially of one or more inorganic gas barrier compounds. The one or more inorganic gas barrier compounds can take the form of fibers, particulates, platelets, or combinations thereof. The fibers, particulates, platelets may comprise or consist essentially of nanoscale fibers, particulates, platelets, or combinations thereof. Examples of inorganic barrier compounds includes, for example, carbon fibers, glass fibers, glass flakes, silicas, silicates, calcium carbonate, clay, mica, talc, carbon black, particulate graphite, metallic flakes, and combinations thereof. The inorganic gas barrier component may comprise or consist essentially of one or more clays. Examples of suitable clays include bentonite, montmorillonite, kaolinite, and mixtures thereof. In one example, the inorganic gas barrier component consists of clay. Optionally, the barrier material may further comprise one or more additional ingredients, such as a polymer, processing aid, colorant, or any combination thereof. In aspects where the barrier material comprises or consists essentially of one or more inorganic barrier compounds, the barrier material may be described as comprising an inorganic gas barrier component consisting of all inorganic barrier compounds present in the barrier material. When one or more inorganic gas barrier compounds are included in the barrier material, the total concentration of the inorganic gas barrier component present in the barrier material may be less than 60 weight percent, or less than 40 weight percent, or less than 20 weight percent of the total composition. Alternatively, in other examples, the barrier material may consist essentially of the one or more inorganic gas barrier materials.

In one aspect, the gas barrier compound comprises or consists essentially of one or more gas barrier polymers. The one or more gas barrier polymers can include thermoplastic polymers. In one example, the barrier material can comprise or consist essentially of one or more thermoplastic polymers, meaning that the barrier material comprises or consists essentially of a plurality of thermoplastic polymers, including thermoplastic polymers which are not gas barrier polymers. In another example, the barrier material comprises or consists essentially of one or more thermoplastic gas barrier polymers, meaning that all the polymers present in the barrier material are thermoplastic gas barrier polymers. The barrier material may be described as comprising a polymeric component consisting of all polymers present in the barrier material. For example, the polymeric component of the barrier material may consist of a single class of gas barrier polymer, such as, for example, one or more polyolefin, or can consist of a single type of gas barrier polymer, such as one or more ethylene-vinyl alcohol copolymers. Optionally, the barrier material may further comprise one or more non-polymeric additives, such as one or more filler, processing aid, colorant, or combination thereof.

Many gas barrier polymers are known in the art. Examples of gas barrier polymers include vinyl polymers such as vinylidene chloride polymers, acrylic polymers such as acrylonitrile polymers, polyamides, epoxy polymers, amine polymers, polyolefins such as polyethylenes and polypropylenes, copolymers thereof, such as ethylene-vinyl alcohol copolymers, and mixtures thereof. Examples of thermoplastic gas barrier polymers include thermoplastic vinyl homopolymers and copolymers, thermoplastic acrylic homopolymers and copolymers, thermoplastic amine homopolymers and copolymers, thermoplastic polyolefin homopolymers and copolymers, and mixtures thereof. In one example, the one or more gas barrier polymers comprise or consist essentially of one or more thermoplastic polyethylene copolymers, such as, for example, one or more thermoplastic ethylene-vinyl alcohol copolymers. The one or more ethylene-vinyl alcohol copolymers can include from about 28 mole percent to about 44 mole percent ethylene content, or from about 32 mole percent to about 44 mole percent ethylene content. In yet another example, the one or more gas barrier polymers can comprise or consist essentially of one or more one or more polyethyleneimine, polyacrylic acid, polyethyleneoxide, polyacrylamide, polyamidoamine, or any combination thereof.

The second material of the one or more second layers can comprise one or more polymers. Depending upon the class of gas barrier compounds used and the intended use of the multi-layered film, the second material may have a higher gas transmittance rate than the barrier material, meaning that the second material is a poorer gas barrier than the barrier material. In some aspects, the one or more second layers may act as substrates for the one or more barrier layers, and may serve to increase the strength, elasticity, and/or durability of the multi-layered film. Alternatively or additionally, the one or more second layers may serve to decrease the amount of gas barrier material(s) needed, thereby reducing the overall material cost. Even when the second material has a relatively high gas transmittance rate, the presence of the one or more second layers, particularly when the one or more second layers are positioned between one or more barrier layers, may help maintain the overall barrier properties of the film by increasing the distance between cracks in the barrier layers, thereby increasing the distance gas molecules must travel between cracks in the barrier layers in order to pass through the multi-layered film. While small fractures or cracks in the barrier layers of a multi-layered film may not significantly impact the overall barrier properties of the film, using a larger number of thinner barrier layers can avoid or reduce visible cracking, crazing or hazing of the multi-layered film. The one or more second layers can include, but are not limited to, tie layers adhering two or more layers together, structural layers providing mechanical support to the multi-layered films, bonding layers providing a bonding material such as a hot melt adhesive material to the multi-layered film, and/or cap layers providing protection to an exterior surface of the multi-layered film.

In some aspects, the second material is an elastomeric material comprising or consisting essentially of at least one elastomer. Many gas barrier compounds are brittle and/or relatively inflexible, and so the one or more barrier layers may be susceptible to cracking when subjected to repeated, excessive stress loads, such as those potentially generated during flexing and release of a multi-layered film. A multi-layered film which includes one or more barrier layers alternating with second layers of an elastomeric material results in a multi-layered film that is better able to withstand repeated flexing and release while maintaining its gas barrier properties, as compared to a film without the elastomeric second layers present.

The second material comprises or consists essentially of one or more polymers. As used herein, the one or more polymers present in the second material are referred to herein as one or more "second polymers" or a "second polymer", as these polymers are present in the second material. References to "second polymer(s)" are not intended to indicate that a "first polymer" is present, either in the second material, or in the multi-layered film as a whole, although, in many aspects, multiple classes or types of polymers are present. In one aspect, the second material comprises or consists essentially of one or more thermoplastic polymers. In another aspect, the second material comprises or consists essentially of one or more elastomeric polymers. In yet another aspect, the second material comprises or consists essentially of one or more thermoplastic elastomers. The second material can be described as comprising a polymeric component consisting of all polymers present in the second material. In one example, the polymeric component of the second material consists of one or more elastomers. Optionally, the second material can further comprise one or more non-polymeric additives, such as fillers, processing aids, and/or colorants.

Many polymers which are suitable for use in the second material are known in the art. Exemplary polymers which can be included in the second material (e.g., second polymers) include polyolefins, polyamides, polycarbonates, polyimines, polyesters, polyacrylates, polyesters, polyethers, polystyrenes, polyureas, and polyurethanes, including homopolymers and copolymers thereof (e.g., polyolefin homopolymers, polyolefin copolymers, etc.), and combinations thereof. In one example, the second material comprises or consists essentially of one or more polymers chosen from polyolefins, polyamides, polyesters, polystyrenes, and polyurethanes, including homopolymers and copolymers thereof, and combinations thereof. In another example, the polymeric component of the second material consists of one or more thermoplastic polymers, or one or more elastomers or one or more thermoplastic elastomers, including thermoplastic vulcanizates. Alternatively, the one or more second polymers can include one or more thermoset or thermosettable elastomers, such as, for example, natural rubbers and synthetic rubbers, including butadiene rubber, isoprene rubber, silicone rubber, and the like.

Polyolefins are a class of polymers which include monomeric units derived from simple alkenes, such as ethylene, propylene and butene. Examples of thermoplastic polyolefins include polyethylene homopolymers, polypropylene homopolymers polypropylene copolymers (including polyethylene-polypropylene copolymers), polybutene, ethylene-octene copolymers, olefin block copolymers; propylene-butane copolymers, and combinations thereof, including blends of polyethylene homopolymers and polypropylene homopolymers. Examples of polyolefin elastomers include polyisobutylene elastomers, poly(alpha-olefin) elastomers, ethylene propylene elastomers, ethylene propylene diene monomer elastomers, and combinations thereof.

Polyamides are a class of polymers which include monomeric units linked by amide bonds. Naturally-occurring polyamides include proteins such as wool and silk, and synthetic amides such as nylons and aramids. The one or more second polymers can include thermoplastic polyamides such as nylon 6, nylon 6-6, nylon-11, as well as thermoplastic polyamide copolymers.

Polyesters are a class of polymers which include monomeric units derived from an ester functional group, and are commonly made by condensing dibasic acids such as, for example, terephthalic acid, with one or more polyols. In one example, the second material can comprise or consist essentially of one or more thermoplastic polyester elastomers. Examples of polyester polymers include homopolymers such as polyethylene terephthalate, polybutylene terephthalate, poly-1,4-cyclohexylene-dimethylene terephthalate, as well as copolymers such as polyester polyurethanes.

Styrenic polymers are a class of polymers which include monomeric units derived from styrene. The one or more second polymers can comprise or consist essentially of styrenic homopolymers, styrenic random copolymers, styrenic block copolymers, or combinations thereof. Examples of styrenic polymers include styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

Polyurethanes are a class of polymers which include monomeric units joined by carbamate linkages. Polyurethanes are most commonly formed by reacting a polyisocyanate (e.g., a diisocyanate or a triisocyanate) with a polyol (e.g., a diol or triol), optionally in the presence of a chain extender. The monomeric units derived from the polyisocyanate are often referred to as the hard segments of the polyurethane, while the monomeric units derived from the polyols are often referred to as the soft segments of the polyurethane. The hard segments can be derived from aliphatic polyisocyanates, or from organic isocyanates, or from a mixture of both. The soft segments can be derived from saturated polyols, or from unsaturated polyols such as polydiene polyols, or from a mixture of both. When the multilayered film is to be bonded to natural or synthetic rubber, including soft segments derived from one or more polydiene polyols can facilitate bonding between the rubber and the film when the rubber and the film are crosslinked in contact with each other, such as in a vulcanization process.

Examples of suitable polyisocyanates from which the hard segments of the polyurethane can be derived include hexamethylene diisocyanate (HDI), isophorone diisocyanate (IPDI), butylenediisocyanate (BDI), bisisocyanatocyclohexylmethane (HMDI), 2,2,4-trimethylhexamethylene diisocyanate (TMDI), bisisocyanatomethylcyclohexane, bisisochanatomethyltricyclodecane, norbornane diisocyanate (NDI), cyclohexane diisocyanate (CHDI), 4,4'-dicyclohexhylmethane diisocyanate (H12MDI), diisocyanatododecane, lysine diisocyanate, toluene diisocyanate (TDI), TDI adducts with trimethylolpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and any combination thereof. In one aspect, the polyurethane comprises or consists essentially of hard segments derived from toluene diisocyanate (TDI), or from methylene diphenyl diisocyanate (MDI), or from both.

The soft segments of the polyurethane can be derived from a wide variety of polyols, including polyester polyols, polyether polyols, polyester-ether polyols, polycarbonate polyols, polycaprolactone polyethers, and combinations thereof. In one aspect, the polyurethane comprises or consist essentially of monmeric units derived from C4-C12 polyols, or C6-C10 polyols, or C8 or lower polyols, meaning polyols with 4 to 12 carbon molecules, or with 6 to 10 carbon molecules, or with 8 or fewer carbon molecules in their chemical structures. In another aspect, the polyurethane comprises or consists essentially of monomeric units derived from polyester polyols, polyester-ether polyols, polyether polyols, and any combination thereof. In yet another aspect, the polyurethane comprises or consists essentially of soft segments derived from polyols or diols having polyester functional units. The soft segments derived from polyols or diols having polyester functional units can comprise about 10 to about 50, or about 20 to about 40, or about 30 weight percent of the soft segments present in the polyurethane.

In an alternative embodiment, instead of being a fluid-filled bladder, the cushioning element 204 comprises a material, such as a foam or an unfoamed solid, to impart properties of cushioning, responsiveness, and energy distribution to the foot of the wearer. For example, the sole structure 102 may include the cushioning element 204. The cushioning element 204 may comprise a foam. The foam may comprise a material. Example materials for the alternate cushioning element 204 may include those based on foaming or molding material, e.g., a resilient material, comprising one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the material is a thermoplastic material when it is combined with other elements to make the midsole, sole structure, or article of footwear, and remains thermoplastic, and is a thermoplastic material in the final product (e.g., in the finished midsole, finished sole structure or finished article of footwear). In other aspects, the material is a thermoplastic material when it is combined with other elements to make the midsole, sole structure, or article of footwear, and is subsequently cured into a crosslinked material in the manufacturing process, and thus is a crosslinked material in the final product. In yet other aspects, the material is crosslinked before being combined with other elements of the midsole, sole structure or article of footwear during the manufacturing process, and thus is a crosslinked material in the final product.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Examples of suitable polyurethanes include those discussed above for barrier films 502 and 504. Alternatively, the one or more polymers may include one or more natural and/or synthetic rubbers, such as polybutadiene and polyisoprene.

In one aspect, the resilient material is a foam. When the material is foamed, the resilient material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foam may be a crosslinked foam. In these embodiments, a peroxide-based crosslinking agent such as dicumyl peroxide may be used. Furthermore, the foam may include one or more fillers such as pigments, modified or natural clays, modified or unmodified synthetic clays, talc glass fiber, powdered glass, modified or natural silica, calcium carbonate, mica, paper, wood chips, and the like.

In another example, when the resilient material is a foam, the material may be foamed during a molding process, such as an injection molding process. A thermoplastic material may be melted in the barrel of an injection molding system and combined with a physical or chemical blowing agent and optionally a crosslinking agent (in order to make a crosslinked foam), and then injected into a mold under conditions which activate the blowing agent, forming a molded foam.

Optionally, when the resilient material is a foam, the foam may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a material, e.g., a resilient material, by forming foamed particles or beads, by cutting foamed sheet stock, and the like. The compression molded foam may then be made by placing the one or more foam preforms in a compression mold, and applying sufficient pressure to the one or more preforms to compress the one or more foam preforms in a closed mold. Once the mold is closed, sufficient heat and/or pressure is applied to the one or more foam preforms in the closed mold for a sufficient duration of time to alter the foam preform(s), to form a skin on the outer surface of the compression molded foam, or to fuse individual foam particles to each other, to permanently or semi-permanently increase the density of the foam(s), or any combination thereof. Following the heating and/or application of pressure, the mold is opened and the molded foam article is removed from the mold.

In another aspect, the resilient material is an unfoamed solid. The material may be shaped using a molding process, including an injection molding process. In one example, when the material is an elastomeric material, the elastomeric material (e.g., uncured rubber) may be mixed in a Banbury mixer with an optional filler and a curing package such as, for example, a UV curing package or a thermal curing package including a sulfur-based or peroxide-based curing package, calendared, formed into shape, placed in a mold, and cured (e.g., using a UV curing process or a thermal curing process such as a vulcanization process).

The components of the sole structure disclosed herein (e.g., the first cushioning element, the optional second cushioning element, the heel wrap, the heel clip, the optional outsole, etc.) may comprise, consist essentially of, or consist of one or more polymeric materials (e.g., polymeric first cushioning material, a polymeric second cushioning material, a polymeric heel clip material, a polymeric heel clip material, a polymeric outsole material, etc.). Accordingly, the polymeric materials described herein are understood to comprise, consist essentially of, or consist of one or more polymers. All the one or more polymers present in a polymeric material constitute the polymeric component of the polymeric material. Similarly, when a polymeric material comprises one or more non-polymer additives, all of the non-polymer additives present in the polymeric material constitute the non-polymeric component of the polymeric material. The polymeric material may be a thermoplastic material, in which the one or more polymers of the polymeric material comprises, consists essentially of, or consists of one or more thermoplastic. A thermoplastic is a polymer that is a solid when cooled, and which can be repeatedly softened and melted on heating. The polymeric material may be an elastomeric material, in which the one or more polymers of the elastomeric material comprises, consists essentially of, or consist of one or more elastomer. An elastomer is a polymer having an elongation at break of greater than 100 percent, such as of greater than 200 percent, or of greater than 400 percent, as determined using ASTM D-412-98 at 25 degrees Celsius. An elastomeric material is a composition having an elongation at break of greater than 100 percent, such as of greater than 200 percent, of or greater than 400 percent, as determined using ASTM D-412-98 at 25 degrees Celsius.

The one or more polymers of a polymeric material may include one or more of a variety of polymers, including homopolymers and copolymers and combinations of homopolymers and copolymers. The one or more polymers may comprise, consist essentially of, or consist of a polymer chosen from a polyurethane, a polyurea, a polyester, a polyether, a polyamide, a polyimide, a polyolefin, a polystyrene, a polysilane, a polysiloxane, a polycarbonate, a polyacetate, including homopolymers and copolymers thereof, and any combination thereof. The one or more polymers may comprise, consist essentially of, or consist of a polymer chosen from a polyurethane, a polyester, a polyamide, a polystyrene, a polyolefin, including homopolymers and copolymers thereof, and any combination thereof. The one or more polymers may comprise, consist essentially of, or consist of one or more polyurethane. Examples of polyurethanes include thermoplastic polyurethanes (TPUs), such as polyester-polyurethane copolymers and polyether-polyurethane copolymers, including thermoplastic elastomeric polyurethanes. The one or more polymers may comprise, consist essentially of, or consist of one or more polyester. Examples polyesters include polyester homopolymers such as polyethylene terephthalate (PET), and polyester copolymers such as polyetheresters, including thermoplastic polyester copolymers. The one or more polymers may comprise, consist essentially of, or consist of one or more polyamide. Examples of polyamide homopolymers include thermoplastic polyamide homopolymers such as Nylon-6, Nylon-6,6, and Nylon-11. Examples of polyamide copolymers include thermoplastic polyamide copolymers such as thermoplastic elastomeric polyamide block copolymers, for example polyether block amide (PEBA) thermoplastic elastomers. The one or more polymers may comprise, consist essentially of, or consist of one or more polystyrene. The one or more polystyrene may comprise, consist essentially of, or consist of thermoplastic polystyrene homopolymers, for example one or more thermoplastic polystyrene homopolymers. Examples of polystyrenes also include polystyrene copolymers such as thermoplastic polystryrene copolymers and thermoplastic polystyrene copolymer elastomers. Examples of polystyrene copolymers include styrene-butadiene-styrene (SBS) copolymers and styrene-ethylene-butadiene-styrene (SEBS) copolymers. The one or more polymers may comprise, consist essentially of, or consist of one or more polyolefin. The one or more polyolefin may comprise, consist essentially of, or consist of one or more thermoplastic polyolefin, for example one or more thermoplastic polyolefin elastomer, including one or more thermoplastic polyolefin homopolymer elastomer, or one or more thermoplastic polyolefin copolymer elastomer, or a combination of both. Examples of polyolefin homopolymers include polyethylene and polypropylene. Examples of polyolefin copolymers include copolymers comprising two olefinic monomeric units, such as polyethylene-polypropylene copolymers, as well as copolymers comprising one olefinic monomeric unit, such as ethylene-vinyl acetate copolymers (EVA) and ethylene-vinyl alcohol (EVOH) copolymers.

The polymeric material may comprise from about 5 weight percent to about 100 weight percent of the polymeric component based on a total weight of the polymeric material. The polymeric component can comprise from about 15 weight percent to about 100 weight percent, from about 30 weight percent to about 100 weight percent, from about 50 weight percent to about 100 weight percent, or from about 70 weight percent to about 100 weight percent of the polymeric material. When the polymeric material comprises a non-polymeric component, the non-polymeric component may comprise from about 1 weight percent to about 20 weight percent, or from about 1 weight percent to about 10 weight percent, or from about 1 weight percent to about 5 weight percent based on a total weight of the polymeric material. As used herein, the terms "consist essentially of", "consists essentially of" and "consisting essentially of" refer to compositions which consist of less than 1 weight percent of materials other than those recited, based on a total weight of the composition. For example, "a polymeric material consisting essentially of thermoplastics" is understood to be a polymeric material which included less than 1 weight percent of non-thermoplastic polymers and non-polymeric materials; while "a polymeric material comprising a polymeric component consisting essentially of thermoplastics" is understood to include a polymeric component in which less than 1 weight percent of the polymers present are non-thermoplastic polymers, but this polymeric material may include more than 1 weight percent of non-polymeric materials.

The polymeric material may be a material which polymerizes or crosslinks or both polymerizes and crosslinks during the process of forming the component or during the process of forming the sole structure. The polymerization or crosslinking may be initiated by including a chemical polymerization or crosslinking initiator in the polymeric material (e.g., a chemical which initiates polymerization or crosslinking reactions within the polymeric material when it is exposed to thermal energy, UV light, or another form of actinic radiation), or the polymerization or crosslinking may be initiated by mixing together two compositions which react to produce polymerization or crosslinking reactions, or by exposing a polymeric material to a form of actinic radiation in sufficient quantity to polymerize pre-polymers or oligomers present in the exposed material, or to crosslink polymers present in the exposed polymeric material. In compositions in which polymerization occurs, the material may initially comprise one or more pre-polymers or oligomers which react and polymerize during the manufacturing process, resulting in a support or sole structure comprising the reacted polymeric material. In compositions in which crosslinking occurs, the material may initially comprise one or more crosslinkable pre-polymers, oligomers, or polymers which react with crosslinking agents or crosslinking energy and form crosslinked polymers during the manufacturing process, resulting in a component or sole structure comprising a crosslinked polymeric material. The resulting reacted polymeric material may be a thermoset material. Similarly, the initial polymeric material may be a thermosetting thermoplastic material (e.g., a polymeric material which comprises one or more thermoplastics and a crosslinking agent before it is thermally processed), with the resulting crosslinked polymeric material being a thermoset material (e.g., after the crosslinking agent reacts with the thermoplastics and crosslinks them, and the resulting thermoset material solidifies). One example of this is a thermosettable molten thermoplastic material comprising a thermally-activated crosslinking agent and a foaming agent, where the thermally-activated crosslinking agent is activated during a foaming process, producing in a thermoset foam material.

Optionally, the polymeric material may comprise one or more additives. Examples of additives include fillers, polymerization initiators, crosslinking agents, UV light absorbers, anti-oxidants, processing aids such as lubricants and plasticizers, and colorants, such as pigments and dyes. Fillers may include non-polymeric fillers such as silica, clay, and titanium dioxide. Fillers may include polymeric fillers such as polymeric fibers and finely-ground polymeric powders, including ground thermoset rubber. Colorants such as naturally-occurring and synthetic pigments and dyes may be used. The polymeric material may comprise one or more additives at a concentration of from about 0.1 weight percent to about 20 weight percent, or from about 0.2 weight percent to about 10 weight percent, or from about 0.5 weight percent to about 5 weight percent, based on a total weight of the polymeric material.

The polymeric material may be a solid polymeric material, meaning that the polymeric material is unfoamed. The solid polymeric material may be an extruded material, which results in the component comprising the extruded material being an extruded component, such as an extruded film or sheet. The solid polymeric material may be a molded material, which results in the component comprising the molded material being a molded component. Various methods may be used, including compression molding and injection molding. For example, the solid polymeric material may be an injection molded material, which results in the component comprising the injection molded material being an injection molded component.

The polymeric material may be a foamed polymeric material, meaning that the polymeric material has a multi-cellular foam structure. The foamed polymeric material may have an open-cell structure, meaning that the majority of the cells of the multi-cellular foam are open cells. Alternatively, the foamed polymeric material may have a closed-cell structure, meaning that the majority of the cells of the multi-cellular foam are closed cells.

The foamed polymeric material may be an extruded foamed material, which results in the component comprising the extruded foamed material being an extruded foamed component, such as an extruded foam sheet. The foamed polymeric material may be a molded foamed material, which results in the component comprising the molded foamed material being a molded foamed component. Various methods may be used, including compression molding and injection molding. For example, the foamed polymeric material may be an injection molded and foamed material, meaning that the material was foamed and molded using an injection molding process, which results in the component comprising the injection molded and foamed material being an injection molded foamed component.

The polymeric material may comprise one or more foaming (blowing) agents. As understood in the art, foaming agents are substances that react, decompose or vaporize to produce quantities of gases or vapors. A chemical foaming agent is a compound which, when reacted with a second chemical or on decomposition, release a gas. Examples of chemical foaming agents include sodium bicarbonate, ammonium carbonate, ammonium bicarbonate, calcium azide, azodicarbonamide, hydrazocarbonamide, benzenesulfonyl hydrazide, dinitrosopentamethylene tetramine, toluenesulfonyl hydrazide, p,p'-oxybis(benzenesulfonylhydrazide), azobisisobutyronitrile, barium azodicarboxylate, and any combination thereof. A physical blowing agent is a compound which phase transitions from a solid, liquid or supercritical fluid to a gas when the temperature, pressure, or temperature and pressure are changed. Physical blowing agents include low-boiling-point hydrocarbons, including hydrocarbons such as isobutene and pentane, and partially halogenated hydrocarbons such as partially halogenated fluorochlorohydrocarbons, inert gasses, and supercritical fluids. The foaming agent may be a supercritical fluid, such as supercritical carbon dioxide (CO2) or supercritical nitrogen (N2). The polymeric material may comprise one or more foaming agents, and the one or more foaming agents may include a chemical foaming agent, a physical foaming agent, or a combination of both a chemical foaming agent and a physical foaming agent. The foamed material may be a chemically-blown foamed material, meaning that a chemical foaming agent was used to foam the polymeric material. The foamed material may be a physically-blown foamed material, meaning that a physical foaming agent was used to foam the polymeric material. The foamed material may be both a physically-blown and chemically-blown foamed material, meaning that both physical and chemical blowing agents were used to foam the polymeric material.

When a foaming agent is used, prior to the foaming step, the foaming agent may be present in the polymeric material in an amount effective to foam the polymeric material into a multicellular foam during the manufacturing process. The amount of foaming agent may be measured as the concentration of foaming agent by weight in the polymeric material prior to the foaming step. An amount of foaming agent is considered effective when the foaming process results in at least a 10 percent increase in the volume of the polymeric material. The foaming process may result at least a 20 percent increase in the volume of the polymeric material, or in at least a 30 percent increase in the volume of the polymeric material. The polymeric material may comprise from about 1 percent to about 30 percent by weight based on a total weight of the polymeric material, or from about 1 percent to about 20 percent by weight, or from about 1 percent to about 10 percent by weight of the foaming agent based on a total weight of the polymeric material. The polymeric material may comprise a concentration of the foaming agent sufficient to expand the polymeric material by at least 100 percent by volume based on an initial volume of the polymeric material prior to foaming, optionally by 100 percent to 900 percent by volume, or by 200 percent to 500 percent by volume, or by 300 percent to 400 percent by volume, based on an initial volume of the polymeric material prior to foaming.

The foamed polymeric material may have a density of from about 0.01 to about 0.7 grams per cubic centimeter, or of from about 0.05 to about 0.5 grams per cubic centimeter, or of from about 0.1 to about 0.4 grams per cubic centimeter. The specific gravity (S.G.) and/or density may be measured using a digital balance or a Densicom Tester (Qualitest, Plantation, Florida, USA). Each sample is weighed and then is submerged in a distilled water bath (at 22 degrees Celsius plus or minus 2 degrees Celsius). To avoid errors, air bubbles on the surface of the samples are removed, e.g., by wiping isopropyl alcohol on the sample before immersing the sample in water, or using a brush after the sample is immersed. The weight of the sample in the distilled water is recorded. The specific gravity is calculated by dividing the weight (in grams) of the sample in air by (the weight (in grams) of the sample in air minus the weight (in grams) of the sample in water). The density of the sample (in grams per cubic centimeter) is calculated by multiplying the S.G. by the density of water.

The foamed polymeric material may have a split-tear strength ranging from about 1.0 to about 10 kilograms per centimeter, or ranging from about 1.6 to about 5.0 kilograms per centimeter, or ranging from about 2.0 to about 4.0 kilograms per centimeter. Split tear for foams can be measured using ASTM D3574-95. Although this method is directed to bonded and molded urethane foams, it can be used on other foamed materials in accordance with the present disclosure. A sample of foamed material having a thickness of 10 mm±1 mm. If the foamed material has an outer skin, the outer skin should not be present on the test sample. A 3 cm long cut is placed in the center of one end of the sample, and marked in five successive 2 cm portions along the edge of the sample. The sample is tested as described in ASTM D3574-95.

The foamed polymeric material may have a tensile strength ranging from about 5 to about 25 kilograms per centimeter squared, or ranging from about 10 to about 23 kilograms per centimeter squared, or ranging from about 15 to about 22 kilograms per centimeter squared. The tensile strength may be measured on a die cut sample of the foamed material in the shape of a dumbbell of a standard size such as a 2.5 centimeters in width by 11.5 centimeters in length, with a minimum thickness of 3 to 4 millimeters. The dumbbell follows the shape described in ASTM D412, die C. The sample is loaded symmetrically into and tested using a long travel extensometer such as the Instron 2603-080 which allows for a minimum of 1000 percent strain with a gauge length of 25 millimeters and a resolution of at least 0.1 millimeters. The tensile value at the failure point of the sample (the point during testing when the load value initially drops) is the tensile strength of the sample.

The foamed polymeric material may have an energy return of at least 50 percent, or at least 65 percent, or at least 70 percent, or at least 75 percent. The energy return of the foamed polymeric material may range from about 50 to about 95 percent, or from about 60 to about 90 percent, or from about 65 to about 85 percent. Force/displacement behavior for a foamed material or cushioning element, including energy return, may be measured using an Instron Electropuls E10000 (Instron, Norwood, Massachusetts, USA) with a stainless-steel 45 mm circular cross section impact geometry, using a foam sample having a thickness of approximately 10 mm. Samples may be was evaluated using a "running" and/or "walking" compression cycle. A "running" compression cycle may consists of compressing samples under displacement control from ON to 300N and back to ON in 180 ms, followed by a pause of 400 ms for a total of ~1.7 Hz. The "walking" compression cycle may consist of compression samples from ON to 144N and back to ON in 600 ms followed by a pause of 400 ms for a total of ~1 Hz. The corresponding force-displacement data can be used to calculate modulus (stiffness), energy return, compression set, fatigue behavior, and other properties over many cycles. Typical characterization using the compression sequence above are run for 5000 cycles, which simulates approximately ~5-10 miles of walking/running and takes about 45 minutes of testing time on the Electropuls. Longer runs up to 100,000 compression cycles are done to simulate accelerated materials response to ~100-200 miles of use. Energy input is taken as the integral of the force-displacement curve during compression force loading. Energy output is taken as the integral of the force displacement curve during unloading. Hysteresis is taken as the ratio: (energy output)/(energy input), which, when multiplied by 100, is the percentage of energy returned by the foam.

The sole structures and components of the sole structures disclosed herein, particularly the cushioning elements, may be resilient structures configured to retain a fluid, particularly a gas. Typically, the fluid needs to be retained over an intended lifetime of the cushioning element, including when the cushioning element is exposed to repeated cycles of applying and releasing force or pressure, as would be encountered when the cushioning element is used in an article of footwear. As many of the polymeric materials conventionally used to manufacture consumer goods are relatively impermeable to water and aqueous solutions but are permeable to small gas molecules such as air, oxygen (O2) gas and nitrogen (N2) gas and inert gasses, barrier materials, i.e., materials which have relatively low rates of fluid transmittance, and so provide relatively high levels of liquid and gas retention to the cushioning element, may be used alone or in combination with conventional polymeric materials. Thus, the sole structures disclosed herein, including components of the sole structures such as cushioning elements, may comprise, consist essentially of, or consist of a barrier material. The inclusion of the barrier material in the component or sole structure may allow the component or sole structure to retain a fluid, such as small gas molecules, over its lifetime. The inclusion of the barrier material may allow the sole structure or component such as a cushioning element to remain adequately pressurized over its lifetime. For example, the cushioning element may retain a minimum pressure of about 2 PSI-40 PSI over a minimum duration of about 5 years-30 years.

As used herein, a barrier material refers to a material comprising, consisting essentially of, or consisting of one or more gas barrier compounds. The gas barrier compound may be a polymeric gas barrier compound (i.e., a gas barrier polymer), or may be a non-polymeric gas barrier compound, such as an inorganic gas barrier compound. The barrier material may be a polymeric barrier material comprising, consisting essentially of, or consisting of one or more gas barrier polymers. The barrier material may be a polymeric barrier material comprising, consisting essentially of, or consisting of a mixture of one or more non-gas barrier polymers and one or more gas barrier polymers, or a barrier material comprising, consisting essentially of, or consisting of a mixture of one or more non-gas barrier polymers and one or more non-polymeric gas barrier compounds. The barrier material may comprise, consist essentially of, or consist of a non-polymeric barrier material, i.e., a material comprising, consisting essentially of, or consisting of a non-polymeric gas barrier compound. The barrier material may be present in a structure which includes regions of polymeric materials and non-polymeric barrier materials, such as a polymeric film coated with one or more layers of a non-polymeric barrier material. The gas transmission rate of the portion of the cushioning element comprising the barrier material may be less than 4 or less than 3 or less than 2 cubic centimeters per square meter per atmosphere per day per day. The portion of the cushioning element comprising the barrier material may be a portion of a tube, an entire tube, a portion of a web area, an entire web area, or any combination thereof. The cushioning element may comprise a barrier film comprising the barrier material. The portion of the cushioning element comprising the barrier film may be a portion of a tube, an entire tube, a portion of a web area, an entire web area, or any combination thereof. The gas transmission rate of the barrier film may be less than 4 or less than 3 or less than 2 cubic centimeters per square meter per atmosphere per day per day for a barrier film having a thickness of from about 72 micrometers to about 320 micrometers, as measured at 23 degrees Celsius and 0 percent relative humidity. The gas transmission rate of the barrier film may be from about 0.1 to about 3, or from about 0.5 to about 3, or from about 0.5 to about 3 cubic centimeters per square meter per atmosphere per day per day, including from about 0.1 to about 3, or from about 0.5 to about 3, or from about 0.5 to about 3 cubic centimeters per square meter per atmosphere per day per day for a film having a thickness of from about 72 micrometers to about 320 micrometers, as measured at 23 degrees Celsius and 0 percent relative humidity. The gas transmission rate, such as the oxygen gas or nitrogen gas transmission rate, may be measured using ASTM D1434.

The barrier material may comprise, consist essentially of, or consist of one or more non-polymeric gas barrier compounds, including one or more inorganic gas barrier compounds. The one or more inorganic gas barrier compounds may be chosen from a form of carbon, silica, silicate, clay, a metal, an any combination thereof. The metal may include a metal oxide or a metal alloy. The one or more inorganic gas barrier compounds may take the form of fibers, particulates, platelets, or combinations thereof. The fibers, particulates, or platelets may be nanoscale structures, including nanoscale fibers, nanoscale particulates, nanoscale platelets, and combinations thereof. Examples of inorganic barrier compounds include carbon fibers, glass fibers, glass flakes, silica particles, silica platelets, silica flakes, silicate particles, silicate platelets, silicate flakes, calcium carbonate particles, clay particles, clay platelets, mica platelets, talc particles, carbon black particles, graphite particles, graphite platelets, graphite flakes, metallic particles, metallic platelets, metallic flakes, and the like. The barrier material may comprise an inorganic gas barrier component consisting of all the inorganic gas barrier compounds present in the barrier material. The inorganic gas barrier component may consist of one or more clays. Suitable clays include bentonite, montmorillonite, kaolinite, and mixtures thereof. Optionally, in addition to the one or more non-polymeric gas barrier compounds, the barrier material may further comprise one or more additional ingredients, such as a polymer, processing aid, colorant, or any combination thereof. When one or more inorganic gas barrier compounds are included in the barrier material, the total concentration of the inorganic gas barrier component present in the barrier material may be less than 60 weight percent, or less than 40 weight percent, or less than 20 weight percent of the barrier material.

The one or more gas barrier compounds of the barrier material may comprise, consist essentially of one, or consist of one or more gas barrier polymers. The barrier material may be a thermoplastic material, meaning that the polymeric component of the barrier material consists of one or more thermoplastic polymers, optionally including thermoplastic polymers which are not gas barrier polymers. The barrier material may comprise, consist essentially of, or consist of one or more thermoplastic gas barrier polymers. The barrier material comprises a gas barrier polymer component consisting of all gas barrier polymers present in the barrier material. The gas barrier polymer component of the barrier material may consist of one or more gas barrier polymer of a single class of polymers such as, for example, one or more polyolefins. The gas barrier polymer component may consist of gas barrier polymers having similar or the same chemical structures, such as one or more ethylene-vinyl alcohol copolymers. Optionally, the barrier material may further comprise one or more non-polymeric additives, such as one or more fillers, processing aids, colorants, or any combination thereof; or one or more non-polymeric barrier compounds, such as one or more inorganic barrier compounds. Many gas barrier polymers are known in the art. Examples of gas barrier polymers include vinyl polymers such as vinylidene chloride polymers, acrylic polymers such as acrylonitrile polymers, polyamides, epoxy polymers, amine polymers, polyolefins such as polyethylenes and polypropylenes, copolymers thereof, such as ethylene-vinyl alcohol copolymers, and mixtures thereof. When the barrier material comprises, consists essentially of, or consists of one or more gas barrier polymers, the one or more gas barrier polymers may be chosen from a vinyl polymer, an acrylic polymer, an amide polymer, an imide polymer, an epoxy polymer, an olefin polymer, any homopolymer thereof, any copolymer thereof, and any mixture thereof. The one or more gas barrier polymer may comprise, consist essentially of, or consist of one or more thermoplastic gas barrier polymers. Examples of thermoplastic gas barrier polymers include thermoplastic vinyl homopolymers and copolymers, thermoplastic acrylic homopolymers and copolymers, thermoplastic amine homopolymers and copolymers, thermoplastic polyolefin homopolymers and copolymers, and mixtures thereof. The one or more gas barrier polymers may comprise, consist essentially of, or consist of one or more thermoplastic polyethylene copolymers. The one or more gas barrier polymers may comprise, consist essentially of, or consist of one or more thermoplastic ethylene-vinyl alcohol copolymers. The thermoplastic ethylene-vinyl alcohol copolymer may be an ethylene-vinyl alcohol copolymer having from about 28 mole percent to about 44 mole percent ethylene content, or from about 32 mole percent to about 44 mole percent ethylene content. The one or more gas barrier polymers may comprise, consist essentially of, or consist of one or more one or more polyethyleneimine, polyacrylic acid, polyethyleneoxide, polyacrylamide, polyamidoamine, or any combination thereof.

The barrier material (including a first barrier material, a second barrier material, etc.) may have a low gas transmittance rate. For example, when formed into a single-layer film consisting essentially of the barrier material, the single-layer film may have a gas transmittance rate of less than 4 cubic centimeters per square meter per atmosphere per day per day for a film having a thickness of from about 72 micrometers to about 320 micrometers, as measured at 23 degrees Celsius and 0 percent relative humidity, and may be measured using ASTM D1434. The barrier material may comprise, consists essentially of, or consist of one or more gas barrier compounds. The one or more gas barrier compounds may comprise, consist essentially of, or consist of one or more gas barrier polymers, or may comprise one or more non-polymeric gas barrier compounds, including one or more inorganic gas barrier compounds. The barrier material may comprise, consist essentially of, or consist of a combination of at least one gas barrier polymer and at least one inorganic gas barrier compound. The combination of at least one gas barrier polymer and at least one inorganic gas barrier compound may comprise a blend or mixture, or may comprise a composite in which fibers, particles, or platelets of the inorganic gas barrier compound are surrounded by the gas barrier polymer.

The cushioning elements disclosed herein may comprise or consist of a barrier film comprising one or more barrier materials. The barrier film may be a thermoformed, welded or molded barrier film. The barrier film may be thermoformed, welded or molded into the shape of a portion of a tube or into an entire tube, or into the shape of a portion of a web or into an entire web, or both into the shape of a portion of a tube or an entire tube and into the shape of a portion of a web or an entire web of a cushioning element. The barrier film comprises a barrier material as described herein. The barrier material of the barrier film may comprise, consist essentially of, or consist of a polymeric gas barrier compound (i.e., a gas barrier polymer); or the barrier material of the barrier film may comprise, consist essentially of, or consist of a non-polymeric gas barrier compound; or the barrier material of the barrier film may comprise, consist essentially of, or consist of or a mixture of a polymeric gas barrier compound and a non-polymeric gas barrier compound. The barrier film may have a gas transmission rate as described above. When used alone or in combination with other materials in a cushioning element, the barrier film resiliently retains the fluid. Depending upon the structure and use of the cushioning element, the barrier film may retain the fluid at a pressure which is above, at, or below atmospheric pressure. The fluid may be a liquid or a gas, such as air, oxygen gas, or nitrogen gas. The barrier film may comprise a polymeric barrier material which is a nitrogen gas barrier material having a nitrogen gas transmission rate as described above.

The barrier film may be a multi-layered film comprising a plurality of layers, the plurality of layers including one or more layers comprising, consisting essentially of, or consisting of one or more barrier materials, the one or more barrier materials comprising, consisting essentially of, or consisting of one or more gas barrier compounds. The one or more gas barrier compounds may comprise, consist essentially of, or consist of one or more gas barrier polymers. The multi-layered film may comprise a total of at least 5 layers or at least 10 layers. The multi-layered film may comprise at least 5 barrier layers or at least 10 barrier layers. The multi-layered film may comprise a total of from about 5 to about 200 layers, from about 10 to about 100 layers, from about 20 to about 80 layers, from about 20 to about 50 layers, or from about 40 to about 90 layers. The multi-layered film may comprise from about 5 to about 200 barrier layers, from about 10 to about 100 barrier layers, from about 20 to about 80 barrier layers, from about 20 to about 50 barrier layers, or from about 40 to about 90 barrier layers.

The plurality of layers of the multi-layered film may include a series of alternating layers, wherein the alternating layers include two or more barrier layers, each of the two or more barrier layers individually comprising a barrier material, the barrier material comprising, consisting essentially of, or consisting of one or more gas barrier compounds. Optionally, the one or more gas barrier compounds may comprise, consist essentially of, or consist of one or more gas barrier polymers, one or more non-polymeric gas barrier compounds, or a mixture of one or more gas barrier polymers and one or more non-polymeric gas barrier compounds. In the series of alternating layers, adjacent layers are individually formed of materials which differ from each other at least in their chemical compositions based on the individual components present in the materials forming the adjacent layers. For example, the materials of adjacent layers may differ based on whether or not a gas barrier compound is present, or may differ based on a class or type of gas barrier compound present (e.g., may differ based on whether or not a gas barrier polymer is present, or whether or not a non-polymeric gas barrier compound is present), or may differ based on a concentration of an individual compound present (e.g., may differ based on the concentration of a gas barrier compound present), or any combination thereof. In one example, the series of alternating layers of a multi-layer barrier film may include barrier layers comprising, consisting essentially of, or consisting of a polymeric barrier compound, and layers which are substantially free of the polymeric barrier compound. In another example, the series of alternating layer of a multi-layer barrier film may include barrier layers consisting essentially of a polymeric barrier compound, and layers of a polymeric material comprising a mixture of one or more non-barrier polymers and less than about 20 weight percent of the polymeric barrier compound based on the total weight of the polymeric material. The multi-layered film may have a gas transmittance rate as described herein.

The plurality of layers of the multi-layered film may include first barrier layers comprising a first barrier material and second barrier layers comprising a second barrier material, wherein the first and second barrier materials comprise first and second gas barrier compounds which differ from each other either based on their chemical structures or based on their concentration in the barrier material or based on both their chemical structures and their concentrations in the barrier material. The first barrier material may comprise, consist essentially of, or consist of a first gas barrier component, the first gas barrier component consisting of all the gas barrier compounds present in the first barrier material. Similarly, the second barrier material may comprise, consist essentially of, or consist of a second gas barrier component, the second barrier material component consisting of all the gas barrier compounds present in the second barrier material. In a first example, the first barrier component may consist of one or more one gas barrier polymers, and the second barrier component may consist of one or more inorganic gas barrier compounds. In a second example, the first barrier component may consist of a first gas barrier polymer, and the second component may consist of a second gas barrier polymer, wherein the first gas barrier polymer differs from the second gas barrier polymer based on its chemical structure, for example, based on the chemical structures of the monomers or oligomers used to make the polymers, or based on molecular weight of the polymers, or based on both. In a third example, the first barrier component and the second barrier component may both include one or more of the same gas barrier compounds, but the concentration of the gas barrier compounds in the first barrier material and the second barrier material may differ, optionally the concentrations may differ by at least 5 weight percent based on the weight of the barrier material. In the multi-layered film, the first barrier layers and the second barrier layers may alternate with each other, or may alternate with additional barrier layers (e.g., third barrier layers comprising a third barrier material, fourth barrier layers comprising a fourth barrier material, etc., wherein each of the first, second, third and fourth, etc., barrier materials differ from each other as described above). The multi-layer film may have a gas transmittance rate as described herein.

In addition to the one or more barrier layers (e.g., one or more first barrier layers, one or more second barrier layers, etc.), the multi-layered film may further comprise one or more second layers, the one or more second layers comprising a second material. The one or more second layers may comprise or consist of non-barrier layers, i.e., layers which do not include a barrier material, and which may have a relatively high gas permeation rate. The second layers, including the non-barrier layers, may comprise a polymeric material, such as a thermoplastic material, an elastomeric material, or a thermoplastic elastomeric material. The second material of the second layers may comprises one or more polymers. In one such configuration of the multi-layered film, the one or more barrier layers comprise or consist of a plurality of barrier layers alternating with a plurality of second layers. Each of the one or more barrier layers may be positioned between two second layers (e.g., with one second layer positioned on a first side of the barrier layer, and another second layer on a second side of the barrier layer, the second side opposing the first side).

Depending upon the gas barrier compounds used and the intended use of the multi-layered film, the second material may have a higher gas transmittance rate than the barrier material, meaning that the second material is a poorer gas barrier than the barrier material. The one or more second layers may act as substrates for the one or more barrier layers, and may serve to increase the strength, elasticity, and/or durability of the multi-layered film. The one or more second layers may serve to decrease the amount of gas barrier material(s) needed, thereby reducing the overall material cost. Even when the second material has a relatively high gas transmittance rate, the presence of the one or more second layers, particularly when the one or more second layers are positioned between one or more barrier layers, may help maintain the overall barrier properties of the film by increasing the distance between cracks in the barrier layers, thereby increasing the distance gas molecules must travel between cracks in the barrier layers in order to pass through the multi-layered film. While small fractures or cracks in the barrier layers of a multi-layered film may not significantly impact the overall barrier properties of the film, using a larger number of thinner barrier layers may avoid or reduce visible cracking, crazing, or hazing of the multi-layered film. The one or more second layers may include, but are not limited to, a tie layer located between and promoting adhesion between two different layers of the multi-layered film, a structural layer providing mechanical support to the multi-layered film, a bonding layer including a bonding material such as a hot melt adhesive material, on an exterior surface of the multi-layered film, a cap layer providing protection to an exterior surface of the multi-layered film, and any combination thereof.

The second material may be an elastomeric material comprising, consisting essentially of, or consist of one or more elastomers. The one or more elastomers may consist of one or more thermoplastic elastomers. Many gas barrier compounds (including gas barrier polymers) are brittle and/or relatively inflexible, and so the one or more barrier layers may be susceptible to cracking when subjected to repeated, excessive stress loads, such as those potentially generated during when a multi-layered film is exposed to repeated flexing and releasing cycles. A multi-layered film which includes one or more barrier layers alternating with second layers, wherein the second layers consist of one or more elastomeric materials, may produce a multi-layered film which is better able to withstand repeated flexing and releasing cycles while maintaining its gas barrier properties, as compared to a film comprising the same materials except without the elastomeric second layers.

The second material may comprise, consist essentially of, or consist of one or more polymers. As used herein, the one or more polymers present in the second material are referred to as "second polymers" or a "second polymer", as these polymers are present in the second material. References to "second polymer(s)" are not intended to indicate that a "first polymer" necessarily is present, either in the second material, or in the multi-layered film as a whole, although multiple polymers may be present. The second material may comprise, consist essentially of, or consist of one or more thermoplastic polymers. The second material may comprise, consist essentially of, or consist of one or more elastomeric polymers. The second material may comprise, consist essentially of, or consist of one or more thermoplastic elastomers. The second material may include a polymeric component consisting of all polymers present in the second material. The polymeric component of the second material may comprise, consist essentially of, or consist of one or more elastomers, such as one or more thermoplastic elastomers. Alternatively, the polymeric component may comprise, consist essentially of, or consist of one or more thermoset elastomers, or thermosetting elastomers which react to become thermoset in the finished cushioning element. Examples of thermoset and thermosetting elastomers include natural and synthetic rubbers such as a butadiene rubber, an isoprene rubber, a silicone rubber, and the like. Optionally, the second material may further comprise one or more non-polymeric additives, such as fillers, processing aids, and/or colorants. Many polymers which are suitable for use in the second material are known in the art. Exemplary polymers which may be included in the second material (e.g., second polymers) include a polymer chosen from a polyolefin, a polyamide, a polyimide, a polycarbonate, a polyester, a polyether, a polyacrylate, a polystyrene, a polyvinyl, a polyurea, a polyurethane, a polysilane, a polysiloxane, any copolymer thereof, and any mixture thereof. The one or more second polymers of the second material may comprise, consist essentially of, or consist of a polymer chosen from a polyolefin, a polyamide, a polyester, a polystyrene, and a polyurethane.

The second material may comprise one or more polyolefin. The polymeric component of the second material may comprise, consist essentially of, or consist of one or more polyolefin, including a thermoplastic polyolefin, for example a thermoplastic polyolefin elastomer. Polyolefins are a class of polymers which include monomeric units derived from simple alkenes, such as ethylene, propylene, and butene. The one or more polyolefin may be a polyolefin homopolymer, a polyolefin copolymer, or any mixture thereof. Examples of polyolefins include ethylene homopolymers, propylene homopolymers, propylene copolymers (including polyethylene-polypropylene copolymers), polybutene, ethylene-octene copolymers, olefin block copolymers, propylene-butane copolymers, and combinations thereof, including blends of ethylene homopolymers and propylene homopolymers. Ethylene-vinyl acetate (EVA) is an example of an ethylene copolymer. Examples of polyolefin elastomers include polyisobutylene elastomers, poly (alpha-olefin) elastomers, ethylene propylene elastomers, ethylene propylene diene monomer elastomers, and combinations thereof.

The second material may comprise one or more polyamide. The polymeric component of the second material may comprise, consist essentially of, or consist of one or more polyamide, including a thermoplastic polyamide, for example a thermoplastic polyamide elastomer. Polyamides are a class of polymers which include monomeric units linked by amide bonds. Naturally-occurring polyamides include proteins such as wool and silk, while synthetic amides include polymers such as nylons and aramids. The one or more second polymers may include thermoplastic polyamides such as nylon 6, nylon 6-6, and/or nylon-11, as well as thermoplastic amide copolymers and thermoplastic amide copolymer elastomers, such as a polyether block amide (PEBA) copolymer.

The second material may comprise one or more polyester. The polymeric component of the second material may comprise, consist essentially of, or consist of one or more polyester, including a thermoplastic polyester, for example a thermoplastic polyester elastomer. Polyesters are a class of polymers which include monomeric units derived from an ester functional group, and are commonly made by condensing dibasic acids such as, for example, terephthalic acid, with one or more polyols. The one or more polyesters may include polyesters such as polyethylene terephthalate (PET), polybutylene terephthalate (PBT), and poly-1,4-cyclohexylene-dimethylene terephthalate, as well as copolymers such as polyester-ether copolymers and polyester-polyurethane copolymers.

The second material may comprise one or more polystyrene. The polymeric component of the second material may comprise, consist essentially of, or consist of one or more polystyrene, including a thermoplastic polystyrene, for example a thermoplastic polystyrene elastomer. Polystyrenes are a class of polymers which include monomeric units derived from styrene. The one or more polymers may include a polystyrene homopolymer, a styrenic random copolymer, a styrenic block copolymer, such as a acrylonitrile-butadiene-styrene (ABS) block copolymer, a styrene acrylonitrile block copolymer, a styrene-ethylene-butylene-styrene (SEBS) block copolymer, a styrene-butadiene-styrene (SBS) block copolymer, a styrene-ethylene-propylene-styrene (SEPS) block copolymer, or a mixture thereof.

The second material may comprise one or more polyurethane. The polymeric component of the second material may comprise, consist essentially of, or consist of one or more polyurethane, including a thermoplastic polyurethane (often referred to as a thermoplastic polyurethane (TPU), for example a thermoplastic polyurethane elastomer. Polyurethanes are a class of polymers which include monomeric units joined by carbamate linkages. Polyurethanes are commonly formed by reacting a polyisocyanate (e.g., a diisocyanate or a triisocyanate) with a polyol (e.g., a diol or triol), optionally in the presence of a chain extender. The monomeric units derived from the polyisocyanate are often referred to as the hard segments of the polyurethane, while the monomeric units derived from the polyols are often referred to as the soft segments of the polyurethane. The hard segments may be derived from aliphatic polyisocyanates, or from organic isocyanates, or from a mixture of both. The soft segments may be derived from saturated polyols, or from unsaturated polyols such as polydiene polyols, or from a mixture of both. When the second material is to be bonded to natural or synthetic rubber, the presence of soft segments derived from one or more polydiene polyols may facilitate bonding between the rubber and the second material when the rubber and the second material are crosslinked in contact with each other, such as in a vulcanization process. Examples of suitable polyisocyanates from which the hard segments of the polyurethane may be derived include hexamethylene diisocyanate (HDI), isophorone diisocyanate (IPDI), butylenediisocyanate (BDI), bisisocyanatocyclohexylmethane (HMDI), 2,2,4-trimethylhexamethylene diisocyanate (TMDI), bisisocyanatomethylcyclohexane, bisisochanatomethyltricyclodecane, norbornane diisocyanate (NDI), cyclohexane diisocyanate (CHDI), 4,4'-dicyclohexhylmethane diisocyanate (H12MDI), diisocyanatododecane, lysine diisocyanate, toluene diisocyanate (TDI), TDI adducts with trimethylolpropane (TMP), methylene diphenyl diisocyanate (MDI), xylylene diisocyanate (XDI), tetramethylxylylene diisocyanate (TMXDI), hydrogenated xylylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and any combination thereof. In one aspect, the polyurethane comprises or consists essentially of hard segments derived from toluene diisocyanate (TDI), or from methylene diphenyl diisocyanate (MDI), or from both. The soft segments of the polyurethane may be derived from a wide variety of polyols, including polyester polyols, polyether polyols, polyester-ether polyols, polycarbonate polyols, polycaprolactone polyethers, and combinations thereof. The polyurethane may comprise, consist essentially of, or consist of monomeric units derived from C4-C12 polyols, or C6-C10 polyols, or C8 or lower polyols, meaning polyols with 4 to 12 carbon molecules, or with 6 to 10 carbon molecules, or with 8 or fewer carbon molecules in their chemical structures. The polyurethane may comprise, consist essentially of, or consist of monomeric units derived from polyester polyols, polyester-ether polyols, polyether polyols, or any combination thereof. In yet another aspect, the polyurethane comprises or consists essentially of soft segments derived from polyols or diols having polyester functional units. The soft segments derived from polyols or diols having polyester functional units may comprise about 10 to about 50, or about 20 to about 40, or about 30 weight percent of the soft segments present in the polyurethane. The one or more polymers may include a urethane copolymer. Examples of urethane copolymers include polyester-polyurethane copolymers, including polyester-polyurthane elastomers.

The multi-layered film may be produced by various means such as co-extrusion, lamination, layer-by-layer deposition, or the like. When co-extruding one or more barrier layers alone or with one or more second layers, selecting materials (e.g., a first barrier material and a second barrier material, or a single barrier material and a second material) having similar processing characteristics such as melt temperature and melt flow index, may reduce interlayer shear during the extrusion process, and may allow the alternating barrier layers and second layers to be co-extruded while retaining their structural integrities and desired layer thicknesses. In one example, the one or more barrier materials and, optionally, the second material when used, may be extruded into separate individual films, which may then be laminated together to form the multi-layered film.

The multi-layered film may be produced using a layer-by-layer deposition process. A substrate, which optionally may comprise a second material or a barrier material, may be built into a multi-layered film by depositing a plurality of layers onto the substrate. The layers may include one or more barrier layers (e.g., first barrier layers, second barrier layers, etc.). Optionally, the layers may include one or more second layers. The one or more barrier layers and/or second layers may be deposited by any means known in the art such as, for example, dipping, spraying, coating, or another method. The one or more barrier layers may be applied using charged solutions or suspensions, e.g., cationic solutions or suspensions or anionic solutions or suspensions, including a charged polymer solution or suspension. The one or more barrier layers may be applied using a series of two or more solutions having opposite charges, e.g., by applying a cationic solution, followed by an anionic solution, followed by a cationic solution, followed by an anionic solution, etc.

The barrier membranes, including the multi-layered film, may have an overall thickness of from about 40 micrometers to about 500 micrometers, or about 50 micrometers to about 400 micrometers, or about 60 micrometers to about 350 micrometers. Each individual layer of the plurality of layers of the multi-layered film may have a thickness of from about 0.001 micrometers to about 10 micrometers. The thickness of an individual barrier layer may range from about 0.001 micrometers to about 3 micrometers thick, or from about 0.5 micrometers to about 2 micrometers thick, or from about 0.5 micrometers to about 1 micrometer thick. The thickness of an individual second layer may range from about 2 micrometers to about 8 micrometers thick, or from about 2 micrometers to about 4 micrometers thick. The thickness of the film and/or their individual layers may be measured by any method known in the art such as, for example, ASTM E252, ASTM D6988, ASTM D8136, or using light microscopy or electron microscopy.

The barrier material, including the multi-layered film comprising the barrier material, may a Shore hardness of from about 35 A to about 95 A, optionally from about 55 A to about 90 A. In these aspects, hardness may be measured using ASTM D2240 using the Shore A scale.

When a co-extrusion process is used to form the barrier membrane from a plurality of alternating barrier layers and second layers, the barrier material may have a melt flow index of from about 5 to about 7 grams per 10 minutes at 190 degrees Celsius when using a weight of 2.16 kilograms, while the second material may have a melt flow index of from about 20 to about 30 grams per 10 minutes at 190 degrees Celsius when using a weight of 2.16 kilograms. The melt flow index of the barrier material may be from about 80 percent to about 120 percent of the melt flow index of the second material per 10 minutes when measured at 190 degrees Celsius when using a weight of 2.16 kilograms. The melt flow index may be measured using ASTM D1238. The barrier material or the second material or both may have a melting temperature of from about 165 degrees Celsius to about 183 degrees Celsius, or from about 155 degrees Celsius to about 165 degrees Celsius. The barrier material may have a melting temperature of from about 165 degrees Celsius to about 183 degrees Celsius, while the second material may have a melting temperature of from about 155 degrees Celsius to about 165 degrees Celsius. The melting temperature may be measured using ASTM D3418.

The following clauses provide an exemplary configuration for an article of footwear and sole structure described above.

Clause 1. An article of footwear comprising: a heel region including a posterior end of the article of footwear, a mid-foot region, and a forefoot region including an anterior end of the article of footwear; a lateral side, and a medial side opposite the lateral side; an upper; a sole structure, the sole structure coupled to the upper, and wherein the sole structure further comprises; a midsole having a first cushioning element extending from the posterior end to the anterior end; and wherein the article of footwear further includes a heel clip disposed adjacent to the first cushioning element in the heel region.

Clause 2. The article of footwear of Clause 1, wherein the heel clip is disposed in the heel region, and wherein the heel clip extends from a first end on the medial side to a second end on the lateral side.

Clause 3. The article of footwear of Clause 2, wherein the heel clip includes: an outer surface, an inner surface, a base extending from a first end to a second end and the base including a bottom surface, and a support, wherein the base and the support together form the outer surface of the heel clip; and a recess disposed between the support and the base within the outer surface of the heel clip, and a receiving area disposed between the support and the base on the inner surface of the heel clip.

Clause 4. The article of footwear of Clause 3, wherein: the support of the heel clip includes an inner surface having a rim extending from a third end to a fourth end, the rim forming a first boundary of the receiving area; the base includes an upper surface extending from the first end to the second end, the upper surface including one or more raised portions and forming a second boundary of the receiving area; and the first cushioning element includes a top surface and one or more receiving areas, the top surface including a first flange, wherein the first flange and the rim are complementary in shape and the first flange abuts the rim, and wherein the one or more receiving areas and the one or more raised portions are complimentary in shape and the one or more raised portions abuts the one or more receiving areas.

Clause 5. The article of footwear of Clause 3, wherein the heel clip is U-shaped.

Clause 6. The article of footwear of Clause 3, wherein the heel clip includes a pair of opposing protrusions extending from the first end of the base and the second end of the base, the pair of opposing protrusions curving away from the base.

Clause 7. The article of footwear of Clause 3, wherein the support has a parabolic shape, wherein a length of the parabolic shape decreases moving away from the base.

Clause 8. The article of footwear of Clause 3, further including: a heel wrap extending around the posterior end of the first cushioning element, the heel wrap coupled to the first cushioning element on the medial side and the lateral side, the medial side of the heel wrap including a first end and the lateral side of the heel wrap including a second end.

Clause 9. The article of footwear of Clause 3, further comprising a second cushioning element disposed in the heel region, the second cushioning element coupled to the bottom surface of the base, wherein a top surface of a medial portion, a top surface of a lateral portion, and a top surface of a base portion of the second cushioning element are covered by the base.

Clause 10. The article of footwear of Clause 9, wherein the sole structure further comprises: an outsole coupled to the midsole forming a ground-engaging surface, the outsole comprising: an outsole layer extending from a first end disposed in the heel region toward a second end disposed at the anterior end, the outsole layer including a cavity and a recess; a heel pad disposed on a bottom surface of the outsole layer; and a heel cup coupled to a bottom surface of the second cushioning element.

Clause 11. The article of footwear of Clause 10, wherein a portion of a bottom surface of the first cushioning element is exposed through the cavity and forms a portion of the outsole.

Clause 12. The article of footwear of Clause 9, wherein the second cushioning element includes a fluid-filled bladder.

Clause 13. The article of footwear of Clause 8, wherein the heel wrap is U-shaped.

Clause 14. The article of footwear of Clause 4, wherein the heel clip is coupled to the first cushioning element between the first boundary of the receiving area and the second boundary of the receiving area.

Clause 15. The article of footwear of Clause 1, wherein the first cushioning element and the heel wrap are coupled so that the midsole has a continuous and flush outer side surface, wherein the outer side surface extends between top and bottom surfaces of the midsole.

Clause 16. An article of footwear, the article of footwear comprising: a heel region including a posterior end of the article of footwear, a mid-foot region, and a forefoot region including an anterior end of the article of footwear; a midsole having: a first cushioning element extending from the posterior end to the anterior end; and wherein the article of footwear includes a heel clip disposed adjacent to the first cushioning element in the heel region.

Clause 17. The article of footwear of Clause 16, wherein the heel clip is disposed in the heel region, wherein the heel clip extends from a first end on the medial side to a second end on the lateral side, the heel clip including: an outer surface, an inner surface, a base extending from a first end to a second end and the base including a bottom surface, and a support, wherein the base and the support together form the outer surface of the heel clip; a recess disposed between the support and the base within the outer surface of the heel clip, and a receiving area disposed between the support and the base on the inner surface of the heel clip.

Clause 18. The article of footwear of Clause 17, wherein: the support of the heel clip includes an inner surface having a rim extending from a third end to a fourth end, the rim forming a first boundary of the receiving area; the base includes an upper surface extending from the first end to the second end, the upper surface including one or more raised portions and forming a second boundary of the receiving area; and the first cushioning element includes a top surface and one or more receiving areas, the top surface including a first flange, wherein the first flange and the rim are complementary in shape and the first flange abuts the rim, and wherein the one or more receiving areas and the one or more raised portions are complimentary in shape and the one or more raised portions abuts the one or more receiving areas.

Clause 19. The article of footwear of Clause 17, wherein the heel clip is U-shaped.

Clause 20. The article of footwear of Clause 17, wherein the heel clip includes a pair of opposing protrusions extending from the first end of the base and the second end of the base, the pair of opposing protrusions curving away from the base.

Clause 21. The article of footwear of Clause 17, wherein the heel clip includes a gap extending from the first end to the second end.

Clause 22. The article of footwear of Clause 17, wherein the support has a parabolic shape, wherein a length of the parabolic shape decreases moving away from the base.

Clause 23. The article of footwear of Clause 17, further including: a heel wrap extending around the posterior end of the first cushioning element, the heel wrap coupled to the first cushioning element on the medial side and the lateral side, the medial side of the heel wrap including a first end and the lateral side of the heel wrap including a second end.

Clause 24. The article of footwear of Clause 17, further comprising a second cushioning element disposed in the heel region, the second cushioning element coupled to the bottom surface of the base, wherein a top surface of a medial portion, a top surface of a lateral portion, and a top surface of a base portion of the second cushioning element are covered by the base.

Clause 25. The article of footwear of Clause 24, the article of footwear further comprising: an outsole coupled to the midsole forming a ground-engaging surface, the outsole comprising: an outsole layer extending from a first end disposed in the heel region toward a second end disposed at the anterior end, the outsole layer including a cavity and a recess; a heel pad disposed on a bottom surface of the outsole layer; and a heel cup coupled to a bottom surface of the second cushioning element.

Clause 26. The article of footwear of Clause 25, wherein a portion of a bottom surface of the first cushioning element is exposed through the cavity and forms a portion of the outsole.

Clause 27. The article of footwear of Clause 24, wherein the second cushioning element includes a fluid-filled bladder.

Clause 28. The article of footwear of Clause 23, wherein the heel wrap is U-shaped.

Clause 29. The article of footwear of Clause 18, wherein the heel clip is coupled to the first cushioning element between the first boundary of the receiving area and the second boundary of the receiving area.

Clause 30. The article of footwear of Clause 23, wherein the first cushioning element and the heel wrap are coupled so that the midsole has a continuous and flush outer side surface, wherein the outer side surface extends between top and bottom surfaces of the midsole.

Clause 31. An article of footwear, comprising: an upper; a heel region including a posterior end of the article of footwear, a mid-foot region, a forefoot region including an anterior end of the article of footwear, a medial side, and a lateral side; a sole structure coupled to the upper, the sole structure comprising: a midsole having an outer side surface, the midsole comprising: a first cushioning element extending from the posterior end toward the anterior end, the first cushioning element including one or more engagement areas; and wherein the article of footwear further includes a heel clip extending from a first end on the medial side to a second end on the lateral side, the heel clip including an outer surface, an inner surface, a base extending from a first end to a second end and the base including a bottom surface, and a support, wherein the base and the support together form the outer surface of the heel clip.

Clause 32. The article of footwear of Clause 31, further comprising: a fluid-filled bladder disposed in the heel region; a heel wrap disposed in the heel region, the heel wrap disposed adjacent to the outer surface of the heel clip, and the heel wrap coupled to the one or more engagement areas of the first cushioning element, wherein the fluid-filled bladder is coupled to the bottom surface of the heel clip.

Clause 33. The article of footwear of Clause 32, the heel clip further including: a recess disposed between the support and the base within the outer surface of the heel clip, and a receiving area disposed between the support and the base on the inner surface of the heel clip, wherein the heel wrap is coupled to the outer surface of the heel clip, and wherein the heel clip is coupled to the first cushioning element via the receiving area.

Clause 34. The article of footwear of Clause 33, wherein: the support of the heel clip includes an inner surface having a rim extending from a third end to a fourth end, the rim forming a first boundary of the receiving area; the base includes an upper surface extending from the first end to the second end, the upper surface including one or more raised portions and forming a second boundary of the receiving area; and the first cushioning element includes a top surface and one or more receiving areas, the top surface including a first flange, wherein the first flange and the rim are complementary in shape and the first flange abuts the rim, and wherein the one or more receiving areas and the one or more raised portions are complimentary in shape and the one or more raised portions abuts the one or more receiving areas.

Clause 35. The article of footwear of Clause 33, wherein the heel clip is U-shaped.

Clause 36. The article of footwear of Clause 33, wherein the heel clip includes a pair of opposing protrusions extending from the first end of the base and the second end of the base, the pair of opposing protrusion curving away from the base.

Clause 37. The article of footwear of Clause 33, wherein the heel clip includes a gap extending from the first end to the second end.

Clause 38. The article of footwear of Clause 33, wherein the support has a parabolic shape, and wherein a length of the parabolic shape decreases moving away from the base.

Clause 39. The article of footwear of Clause 33, wherein the heel clip includes a flange at a periphery of the base, the heel wrap includes a bottom surface, and the bottom surface of the heel wrap abuts the flange at the periphery of the heel clip.

Clause 40. The article of footwear of Clause 33, further comprising a second cushioning element disposed in the heel region, the second cushioning element coupled to a bottom surface of the base, wherein a top surface of a medial portion, a lateral portion, and a base portion of the second cushioning element are covered by the base.

Clause 41. The article of footwear of Clause 40, wherein the sole structure further comprises: an outsole coupled to the midsole forming a ground-engaging surface, the outsole comprising: an outsole layer extending from a first end disposed in the heel region toward a second end disposed at the anterior end, the outsole layer including a cavity and a recess; a heel pad disposed on a bottom surface of the outsole layer; and a heel cup coupled to a bottom surface of the second cushioning element.

Clause 42. The article of footwear of Clause 41, wherein a portion of a bottom surface of the first cushioning element is exposed through the cavity and forms a portion of the outsole.

Clause 43. The article of footwear of Clause 40, wherein the second cushioning element includes a fluid-filled bladder.

Clause 44. The article of footwear of Clause 32, wherein the heel wrap is U-shaped.

Clause 45. The article of footwear of Clause 34, wherein the heel clip is coupled to the first cushioning element between the first boundary of the receiving area and the second boundary of the receiving area.

Clause 46. The article of footwear of Clause 32, wherein the first cushioning element and the heel wrap are coupled so that the midsole has a continuous and flush outer side surface, wherein the outer side surface extends between top and bottom surfaces of the midsole.

Clause 47. An article of footwear, the article of footwear comprising: a heel region including a posterior end of the article of footwear, a mid-foot region, and a forefoot region including an anterior end of the article of footwear; a midsole having an outer side surface, the midsole comprising: a first cushioning element extending from the posterior end toward the anterior end, the first cushioning element including one or more engagement areas; and wherein the article of footwear further includes a heel clip extending from a first end on the medial side to a second end on the lateral side, the heel clip including an outer surface, an inner surface, a base extending from a first end to a second end and the base including a bottom surface, and a support, wherein the base and the support together form the outer surface of the heel clip.

Clause 48. The article of footwear of Clause 47, further comprising: a fluid-filled bladder disposed in the heel region; a heel wrap disposed in the heel region, the heel wrap disposed adjacent to the outer surface of the heel clip, and the heel wrap coupled to the one or more engagement areas of the first cushioning element, wherein the fluid-filled bladder is coupled to the bottom surface of the heel clip.

Clause 49. The article of footwear of Clause 48, the heel clip further including: a recess disposed between the support and the base within the outer surface of the heel clip, and a receiving area disposed between the support and the base on the inner surface of the heel clip, wherein the heel wrap is coupled to the outer surface of the heel clip, and wherein the heel clip is coupled to the first cushioning element via the receiving area.

Clause 50. The article of footwear of Clause 49, wherein: the support of the heel clip includes an inner surface having a rim extending from a third end to a fourth end, the rim forming a first boundary of the receiving area; the base includes an upper surface extending from the first end to the second end, the upper surface including one or more raised portions and forming a second boundary of the receiving area; and the first cushioning element includes a top surface and one or more receiving areas, the top surface including a first flange, wherein the first flange and the rim are complementary in shape and the first flange abuts the rim, and wherein the one or more receiving areas and the one or more raised portions are complimentary in shape and the one or more raised portions abuts the one or more receiving areas.

Clause 51. The article of footwear of Clause 49, wherein the heel clip is U-shaped.

Clause 52. The article of footwear of Clause 49, wherein the heel clip includes a pair of opposing protrusions extending from the first end of the base and the second end of the base, the pair of opposing protrusions curving away from the base.

Clause 53. The article of footwear of Clause 49, wherein the heel clip includes a gap extending from the first end to the second end.

Clause 54. The article of footwear of Clause 49, wherein the support has a parabolic shape, and wherein a length of the parabolic shape decreases moving away from the base.

Clause 55. The article of footwear of Clause 49, wherein the heel clip includes a flange at a periphery of the base, the heel wrap includes a bottom surface, and the bottom surface of the heel wrap abuts the flange at the periphery of the heel clip.

Clause 56. The article of footwear of Clause 49, further comprising a second cushioning element disposed in the heel region, the second cushioning element coupled to a bottom surface of the base, wherein a top surface of a medial portion, a lateral portion, and a base portion of the second cushioning element are covered by the base.

Clause 57. The article of footwear of Clause 56, further comprising: an outsole coupled to the midsole forming a ground-engaging surface, the outsole comprising: an outsole layer extending from a first end disposed in the heel region toward a second end disposed at the anterior end, the outsole layer including a cavity and a recess; a heel pad disposed on a bottom surface of the outsole layer; and a heel cup coupled to a bottom surface of the second cushioning element.

Clause 58. The article of footwear of Clause 57, wherein a portion of a bottom surface of the first cushioning element is exposed through the cavity and forms a portion of the outsole.

Clause 59. The article of footwear of Clause 56, wherein the second cushioning element includes a fluid-filled bladder.

Clause 60. The article of footwear of Clause 48, wherein the heel wrap is U-shaped.

Clause 61. The article of footwear of Clause 50, wherein the heel clip is coupled to the first cushioning element between the first boundary of the receiving area and the second boundary of the receiving area.

Clause 62. The article of footwear of Clause 48, wherein the first cushioning element and the heel wrap are coupled so that the midsole has a continuous and flush outer side surface, wherein the outer side surface extends between top and bottom surfaces of the midsole.

Clause 63. An article of footwear, comprising: an upper; a heel region including a posterior end of the article of footwear, a mid-foot region, and a forefoot region including an anterior end of the article of footwear; a sole structure coupled to the upper, the sole structure comprising: a midsole having: a first cushioning element extending from a first end disposed in a heel region toward a second end disposed at an anterior end of the article of footwear; and wherein the article of footwear further includes a heel wrap extending around the first end of the first cushioning element, the heel wrap being coupled to the first cushioning element so that the heel wrap and the first cushioning form a substantially continuous and flush outer side surface of the article of footwear.

Clause 64. The article of footwear of Clause 63, further including a medial side and a lateral side, wherein: the first cushioning element includes a first posterior-facing edge on the medial side and a second posterior-facing edge on the lateral side; the heel clip includes a medial portion having a first end abutting the first posterior-facing edge, and a lateral portion having a second end abutting the second posterior-facing edge.

Clause 65. The article of footwear of Clause 64, wherein the first end of the heel clip includes a first anterior-facing edge abutting the first posterior-facing edge, and the second end of the heel clip includes a second anterior-facing edge abutting the second posterior-facing edge.

Clause 66. The article of footwear of Clause 65, wherein each of the first anterior-facing edge and the second anterior-facing edge have a downward taper in the anterior direction.

Clause 67. A sole structure for an article of footwear, the sole structure comprising: a heel region including a posterior end of the article of footwear; a mid-foot region, a forefoot region including an anterior end of the article of footwear, a lateral side, and a medial side opposite the lateral side; a midsole having: a first cushioning element, having a first surface and a second surface opposite the first surface, extending from a first end disposed in a heel region toward a second end disposed at an anterior end of the article of footwear, the first cushioning element including a first posterior-facing edge on the medial side and a second posterior-facing edge on the lateral side, and the first cushioning element including one or more recessed portions.

Clause 68. An article of footwear comprising: an upper; a first cushioning element, coupled to the upper, the first cushioning element extending from a first end in a heel region to a second end at an anterior end of the article of footwear; a heel clip extending around the first end of the first cushioning element, the heel clip coupled to the first cushioning element on a medial side and a lateral side; and an exposed fluid-filled bladder coupled to the heel clip.

Clause 69. The article of footwear of Clause 68, wherein outermost side surfaces of the fluid-filled bladder are exposed and visible from an exterior of the article of footwear.

Clause 70. The article of footwear of Clause 68, the heel clip further including: an outer surface, an inner surface, a base extending from a first end to a second end and the base including a bottom surface, and a support, wherein the base and the support together form the outer surface of the heel clip; a recess disposed between the support and the base within the outer surface of the heel wrap, and a receiving area disposed between the support and the base on the inner surface of the heel clip, wherein the heel clip is coupled to the inner surface of the heel wrap, and wherein the heel clip is coupled to the first cushioning element via the receiving area.

Clause 71. The article of footwear of Clause 70, wherein: the support of the heel clip includes an inner surface having a rim extending from a third end to a fourth end, the rim forming a first boundary of the receiving area; the base includes an upper surface extending from the first end to the second end, the upper surface including one or more raised portions and forming a second boundary of the receiving area; and the first cushioning element includes a top surface and one or more receiving areas, the top surface including a first flange, wherein the first flange and the rim are complementary in shape and the first flange abuts the rim, and wherein the one or more receiving areas and the one or more raised portions are complimentary in shape and the one or more raised portions abuts the one or more receiving areas.

Clause 72. The article of footwear of Clause 71, wherein the heel clip is coupled to the first cushioning element between the first boundary of the receiving area and the second boundary of the receiving area.

Clause 73. The article of footwear of Clause 68 further including; an upper, wherein the upper is coupled to the sole structure.

Clause 74. An article of footwear, the article of footwear comprising: a first cushioning element extending from a first end in a heel region to a second end at an anterior end of the article of footwear; a heel clip extending around the first end of the first cushioning element, the heel clip coupled to the first cushioning element on a medial side and a lateral side; and an exposed fluid-filled bladder coupled to the heel clip.

Clause 75. The article of footwear of Clause 74, wherein outermost side surfaces of the fluid-filled bladder are exposed and visible from an exterior of the article of footwear.

Clause 76. The article of footwear of Clause 74, the heel clip further including: an outer surface, an inner surface, a base extending from a first end to a second end and the base including a bottom surface, and a support, wherein the base and the support together form the outer surface of the heel clip; a recess disposed between the support and the base within the outer surface of the heel clip, and a receiving area disposed between the support and the base on the inner surface of the heel clip, wherein the heel clip is coupled to the inner surface of the heel clip, and wherein the heel clip is coupled to the first cushioning element via the receiving area.

Clause 77. The article of footwear of Clause 76, wherein: the support of the heel clip includes an inner surface having a rim extending from a third end to a fourth end, the rim forming a first boundary of the receiving area; the base includes an upper surface extending from the first end to the second end, the upper surface including one or more raised portions and forming a second boundary of the receiving area; and the first cushioning element includes a top surface and one or more receiving areas, the top surface including a first flange, wherein the first flange and the rim are complementary in shape and the first flange abuts the rim, and wherein the one or more receiving areas and the one or more raised portions are complimentary in shape and the one or more raised portions abuts the one or more receiving areas.

Clause 78. The article of footwear of Clause 77, wherein the heel clip is coupled to the first cushioning element between the first boundary of the receiving area and the second boundary of the receiving area.

Clause 79. A heel clip comprising: a support extending from a first end on a medial side to a second end on a lateral side, wherein the support increases in height from the first end to an apex at a rear region of the support and decreases in height from the apex to the second end; and a base including a first surface and a second surface extending from a first end on a medial side to a second end on a lateral side, the base including a first hook at a first terminal end and a second hook at a second terminal end, wherein the based is disposed adjacent the support.

Clause 80. An article of footwear including the heel clip of Clause 79.

Clause 81. The heel clip of Clause 79, wherein the heel clip includes a gap extending from the first end to the second end.

Clause 82. The article of footwear of Clause 3, wherein the heel clip includes a gap extending from the first end to the second end.

Clause 83. The article of footwear of Clause 8, wherein the heel wrap includes an inner surface, and wherein the heel clip is coupled to the inner surface of the heel wrap, and wherein the heel clip is coupled to the first cushioning element via the receiving area.

Clause 84. The article of footwear of Clause 83, wherein the heel wrap is disposed around the heel clip, and the first and second ends of the heel wrap abut the first cushioning element.

Clause 85. The article of footwear of Clause 84, wherein the heel clip includes a flange at a periphery of the base, the heel wrap includes a bottom surface, and the bottom surface of the heel wrap abuts the flange at the periphery of the heel clip.

Clause 86. The article of footwear of Clause 23, wherein the heel wrap includes an inner surface, and wherein the heel clip is coupled to the inner surface of the heel wrap, and wherein the heel clip is coupled to the first cushioning element via the receiving area.

Clause 87. The article of footwear of Clause 86, wherein the heel wrap is disposed around the heel clip, and the first and second ends of the heel wrap abut the first cushioning element.

Clause 88. The article of footwear of Clause 87, wherein the heel clip includes a flange at a periphery of the base, the heel wrap includes a bottom surface, and the bottom surface of the heel wrap abuts the flange at the periphery of the heel clip.

Clause 89. A heel clip comprising: a support extending from a first end on a medial side to a second end on a lateral side, wherein the support increases in height from the first end to an apex at a rear region of the support and decreases in height from the apex to the second end; a base including a first surface and a second surface extending from a first end on a medial side to a second end on a lateral side; and one or more protruding portions extending from the second surface of the base.

Clause 90. An article of footwear including the heel clip of Clause 89.

Clause 91. The heel clip of Clause 89, wherein the base includes a first hook at a first terminal end and a second hook at a second terminal end.

Clause 92. The heel clip of Clause 89, wherein the one or more protruding portions includes a unitary protruding portion, the unitary protruding portion including one or more protruding sections.

Clause 93. The heel clip of Clause 92, wherein the one or more protruding segments are partially separated from an immediately adjacent protruding segment by a recess.

Clause 94. The article of footwear of Clause 1, wherein the heel clip includes a first surface and a second surface opposite the first surface, the heel clip further including one or more protruding portions extending from the second surface.

Clause 95. The article of footwear of Clause 94, wherein the one or more protruding portions include a unitary protruding portion.

Clause 96. The article of footwear of Clause 1, wherein the heel clip includes: an outer surface, an inner surface, a base extending from a first end to a second end and the base including a bottom surface, and a support, wherein the base and the support together form the outer surface of the heel clip; and one or more protruding portions extending from the bottom surface of the base.

Clause 97. The article of footwear of Clause 3, wherein the heel clip includes a gap extending from the first end to the second end.

Clause 98. The article of footwear of Clause 8, wherein the heel wrap includes an inner surface, and wherein the heel clip is coupled to the inner surface of the heel wrap, and wherein the heel clip is coupled to the first cushioning element via the receiving area.

Clause 99. The article of footwear of Clause 98, wherein the heel wrap is disposed around the heel clip, and the first and second ends of the heel wrap abut the first cushioning element.

Clause 100. The article of footwear of Clause 99, wherein the heel clip includes a flange at a periphery of the base, the heel wrap includes a bottom surface, and the bottom surface of the heel wrap abuts the flange at the periphery of the heel clip.

Clause 101. The article of footwear of Clause 23, wherein the heel wrap includes an inner surface, and wherein the heel clip is coupled to the inner surface of the heel wrap, and wherein the heel clip is coupled to the first cushioning element via the receiving area.

Clause 102. The article of footwear of Clause 101, wherein the heel wrap is disposed around the heel clip, and the first and second ends of the heel wrap abut the first cushioning element.

Clause 103. The article of footwear of Clause 102, wherein the heel clip includes a flange at a periphery of the base, the heel wrap includes a bottom surface, and the bottom surface of the heel wrap abuts the flange at the periphery of the heel clip.

Clause 104. An article of footwear comprising: a heel region including a posterior end of the article of footwear, a mid-foot region, and a forefoot region including an anterior end of the article of footwear; a lateral side, and a medial side opposite the lateral side; an upper; a sole structure, the sole structure coupled to the upper, and wherein the sole structure further comprises; a midsole including: a first cushioning element extending from the posterior end to the anterior end; a second cushioning element extending from the mid-foot region to the posterior end, the second cushioning element being formed of a different material than the first cushioning element; and a shell, wherein the shell includes a plurality of circumferentially-spaced apart protrusions, wherein each of the plurality of protrusions is directly coupled to the second cushioning element.

Clause 105. The article of footwear of Clause 104, wherein the article of footwear further includes a heel counter disposed adjacent to the first cushioning element in the heel region.

Clause 106. The article of footwear of Clause 105, wherein the shell and the one or more protrusions include a cavity.

Clause 107. The article of footwear of Clause 106, wherein the heel counter includes one or more protrusions, each protrusion of the heel counter being disposed on the shell.

Clause 108. The article of footwear of Clause 107, wherein the one or more protrusions of the heel counter extend radially outward from a first surface of the heel counter.

Clause 109. The article of footwear of Clause 108, wherein the heel counter does not directly contact the second cushioning element.

Clause 110. The article of footwear of Clause 105, wherein the shell does not directly contact the second cushioning element between circumferentially adjacent protrusions.

Clause 111. The article of footwear of Clause 105, wherein the one or more protrusions of the shell have a downward taper in an anterior direction.

Clause 112. The article of footwear of Clause 105, wherein the one or more protrusions includes a first protrusion, a second protrusion, a third protrusion, a fourth protrusion, and a fifth protrusion.

Clause 113. The article of footwear of Clause 112, wherein circumferentially adjacent protrusions of the shell are spaced apart by a circumferentially-extending gap.

Clause 114. The article of footwear of Clause 105, wherein the shell further includes an anterior lateral end and an anterior medial end, the anterior lateral end coupled to first cushioning element, and the anterior medial end coupled to the first cushioning element.

Clause 115. The article of footwear of Clause 104, wherein the second cushioning element is a pressurized airbag.

Clause 116. A sole structure for an article of footwear comprising: a first cushioning element disposed at a posterior end of the article of footwear, the first cushioning element including a first surface; a shell directly coupled to the first surface of the first cushioning element, the shell including a body and a plurality of circumferentially-spaced apart protrusions forming a first concave surface; and a heel counter coupled to the shell, the heel counter including a body and a plurality of protrusions forming a second concave surface, wherein the first concave surface of the shell is aligned with the second concave surface of the heel counter.

Clause 117. The sole structure of Clause 116, wherein the first cushioning element is a fluid-filled bladder.

Clause 118. The sole structure of Clause 117, wherein the heel counter is disposed within the hollow interior of the shell.

Clause 119. The sole structure of Clause 118, wherein the shell includes a first protrusion, a second protrusion, a third protrusion, a fourth protrusion, and a fifth protrusion.

Clause 120. The sole structure of Clause 119, wherein the first protrusion is symmetrical about a central longitudinal axis of the shell with the fifth protrusion, and wherein the second protrusion is symmetrical about a central longitudinal axis of the shell with the fourth protrusion.

Clause 121. The sole structure of Clause 119, wherein the third protrusion is disposed between the second protrusion and the fourth protrusion.

Clause 122. An article of footwear including the sole structure of Clause 116.

Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

We claim:

1. An article of footwear, comprising:

an upper;

a heel region including a posterior end of the article of footwear, a mid-foot region, a forefoot region including an anterior end of the article of footwear, a medial side, and a lateral side;

a sole structure coupled to the upper, the sole structure comprising:

a fluid-filled bladder disposed in the heel region;

a midsole having an outer side surface, the midsole comprising:

a first cushioning element extending from the posterior end toward the anterior end; and a heel clip extending from a first end on the medial side to a second end on the lateral side, the heel clip including:

an outer surface;

an inner surface;

a base extending from a first end to a second end and the base including a bottom surface, the base including a first protrusion disposed at the first end of the heel clip and a second protrusion disposed at the second end of the heel clip, each of the first protrusion and the second protrusion curving in a direction away from the base toward a ground surface and away from the upper; and a support, wherein the base and the support together form the outer surface of the heel clip, wherein the heel clip surrounds at least a portion of the first cushioning element, and wherein the fluid-filled bladder is coupled to a bottom surface of the heel clip, and wherein each of the first protrusion and the second protrusion contact the fluid-filled bladder; and a heel wrap disposed in the heel region, the heel wrap disposed adjacent to the outer surface of the heel clip, and the heel wrap coupled to one or more engagement areas of the first cushioning element.

2. The article of footwear of claim 1, the heel clip further including:

a recess disposed between the support and the base within the outer surface of the heel clip, and a receiving area disposed between the support and the base on the inner surface of the heel clip, wherein the heel wrap is coupled to the outer surface of the heel clip, and wherein the heel clip is coupled to the first cushioning element via the receiving area.

3. The article of footwear of claim 2, wherein:

the support of the heel clip includes an inner surface having a rim extending from a third end to a fourth end, the rim forming a first boundary of the receiving area;

the base includes an upper surface extending from the first end to the second end, the upper surface including one or more raised portions and forming a second boundary of the receiving area; and the first cushioning element includes a top surface and one or more receiving areas, the top surface including a first flange, wherein the first flange and the rim are complementary in shape and the first flange abuts the rim, and wherein the one or more receiving areas and the one or more raised portions are complementary in shape and the one or more raised portions abuts the one or more receiving areas.

4. The article of footwear of claim 3, wherein the heel clip is coupled to the first cushioning element between the first boundary of the receiving area and the second boundary of the receiving area.

5. The article of footwear of claim 2, wherein the heel clip is U-shaped.

6. The article of footwear of claim 2, wherein the heel clip includes a gap extending from the first end to the second end.

7. The article of footwear of claim 2, wherein the support has a parabolic shape, and wherein a length of the parabolic shape decreases moving away from the base.

8. The article of footwear of claim 2, wherein the heel clip includes a flange at a periphery of the base, the heel wrap includes a bottom surface, and the bottom surface of the heel wrap abuts the flange at a periphery of the heel clip.

9. The article of footwear of claim 2, further comprising a second cushioning element disposed in the heel region, the second cushioning element coupled to the bottom surface of the base, wherein a top surface of a medial portion, a lateral portion, and a base portion of the second cushioning element are covered by the base.

10. The article of footwear of claim 9, wherein the sole structure further comprises:

an outsole coupled to the midsole forming a ground-engaging surface, the outsole comprising:

an outsole layer extending from a first end disposed in the heel region toward a second end disposed at the anterior end, the outsole layer including a cavity and a recess;

a heel pad disposed on a bottom surface of the outsole layer; and a heel cup coupled to a bottom surface of the second cushioning element.

11. The article of footwear of claim 10, wherein a portion of a bottom surface of the first cushioning element is exposed through the cavity and forms a portion of the ground-engaging surface.

12. The article of footwear of claim 9, wherein the second cushioning element includes a fluid-filled bladder.

13. The article of footwear of claim 1, wherein the heel wrap is U-shaped.

14. The article of footwear of claim 1, wherein the first cushioning element and the heel wrap are coupled so that the outer side surface of the midsole is a continuous and flush outer side surface formed by the first cushioning element and the heel wrap, wherein the continuous and flush outer side surface extends between top and bottom surfaces of the midsole.

15. An article of footwear, the article of footwear comprising:

a heel region including a posterior end of the article of footwear, a mid-foot region, and a forefoot region including an anterior end of the article of footwear;

a fluid-filled bladder disposed in the heel region;

a midsole having an outer side surface, the midsole comprising:

a first cushioning element extending from the posterior end toward the anterior end, the first cushioning element including a top surface and one or more receiving areas, the top surface including a first flange; and a heel clip extending from a first end on a medial side to a second end on a lateral side, the heel clip including:

an outer surface;

an inner surface;

a base extending from a first end to a second end and the base including a bottom surface and an upper surface extending from the first end to the second end, the upper surface including one or more raised portions and forming a second boundary of a receiving area of the heel clip, wherein the bottom surface includes one or more protruding portions, the one or more protruding portions disposed in a plane that is offset from a plane of the bottom surface of the base; and a support including an inner surface having a rim extending from a third end to a fourth end, the rim forming a first boundary of the receiving area of the heel clip, wherein the base and the support together form the outer surface of the heel clip, wherein the heel clip surrounds at least a portion of the first cushioning element proximate the posterior end of the article of footwear;

a recess disposed between the support and the base within the outer surface of the heel clip; and a heel wrap disposed in the heel region, the heel wrap disposed adjacent to the outer surface of the heel clip, and the heel wrap coupled to one or more engagement areas of the first cushioning element, wherein the fluid-filled bladder is coupled to a bottom surface of the heel clip, wherein the receiving area of the heel clip is disposed between the support and the base on the inner surface of the heel clip, wherein the heel wrap is coupled to the outer surface of the heel clip, and wherein the heel clip is coupled to the first cushioning element via the receiving area of the heel clip, wherein the first flange of the first cushioning element and the rim of the support are complementary in shape and the first flange of the first cushioning element abuts the rim of the support, and wherein the one or more receiving areas of the first cushioning element and the one or more raised portions of the base are complementary in shape and the one or more raised portions of the base abuts the one or more receiving areas of the first cushioning element.

16. The article of footwear of claim 15, wherein the one or more protruding portions include a plurality of segments, and wherein each of the plurality of segments is at least partially separated from an immediately adjacent segment.

* * * * *